US007046223B2

(12) United States Patent
Hashimoto

(10) Patent No.: US 7,046,223 B2
(45) Date of Patent: May 16, 2006

(54) METHOD AND CIRCUIT FOR DRIVING LIQUID CRYSTAL DISPLAY, AND PORTABLE ELECTRONIC DEVICE

(75) Inventor: Yoshiharu Hashimoto, Tokyo (JP)

(73) Assignee: NEC Electronics Corporation, Kanagawa (JP)

( * ) Notice: Subject to any disclaimer, the term of this patent is extended or adjusted under 35 U.S.C. 154(b) by 199 days.

(21) Appl. No.: 10/046,155

(22) Filed: Jan. 16, 2002

(65) Prior Publication Data

US 2002/0093475 A1 Jul. 18, 2002

(30) Foreign Application Priority Data

Jan. 16, 2001 (JP) ..... 2001-008322

(51) Int. Cl.
*G09G 3/36* (2006.01)

(52) U.S. Cl. ..... 345/89; 345/211

(58) Field of Classification Search ..... 345/87–89, 345/213, 94–96, 99, 100, 211
See application file for complete search history.

(56) References Cited

U.S. PATENT DOCUMENTS

| | | | | |
|---|---|---|---|---|
| 5,365,284 | A * | 11/1994 | Matsumoto et al. | 345/99 |
| 5,414,443 | A * | 5/1995 | Kanatani et al. | 345/95 |
| 5,796,379 | A * | 8/1998 | Enomoto et al. | 345/89 |
| 6,388,653 | B1 * | 5/2002 | Goto et al. | 345/98 |
| 6,496,172 | B1 * | 12/2002 | Hirakata | 345/96 |
| 6,529,180 | B1 * | 3/2003 | Ito et al. | 345/89 |
| 6,661,402 | B1 * | 12/2003 | Nitta et al. | 345/99 |
| 6,781,605 | B1 * | 8/2004 | Kudo et al. | 345/690 |
| 6,816,144 | B1 * | 11/2004 | Tsuchi | 345/100 |
| 2003/0006955 | A1 * | 1/2003 | Tsuchi | 345/92 |

FOREIGN PATENT DOCUMENTS

| | | |
|---|---|---|
| JP | 5-173503 | 7/1993 |
| JP | A 7-334122 | 12/1995 |
| JP | A 8-76726 | 3/1996 |
| JP | A 8-227283 | 9/1996 |
| JP | A 9-222930 | 8/1997 |
| JP | A 10-301539 | 11/1998 |
| JP | A 11-282421 | 10/1999 |
| JP | 2000-3159 | 1/2000 |
| JP | 02003330429 A * | 11/2003 |

* cited by examiner

*Primary Examiner*—Amare Mengistu
(74) *Attorney, Agent, or Firm*—Young & Thompson

(57) ABSTRACT

A method for driving a liquid crystal display capable of reducing power consumption, decreasing a packaging area or a number of packaged parts, and providing an image of high quality when the liquid crystal display having a comparatively small display screen is driven by a line inverting driving method or by a frame inverting driving method.

Digital video data is output, with or without data being inverted, based on a polarity signal being inverted in every one horizontal sync period or in every one vertical sync period. A plurality of gray scale voltages is selected, being provided so as to have either of a voltage of positive or negative to match an applied voltage of positive polarity or negative polarity transmittance characteristic. Any one of the gray scale voltage out of the plurality of gray scale voltages having a selected polarity is selected based on digital video data, with or without inversion of a polarity of gray scale voltages. The selected one gray scale voltage is applied as a data signal to a corresponding data electrode.

16 Claims, 23 Drawing Sheets

| POL | INV | INV1 | Dxx | D'xx |
|---|---|---|---|---|
| L | L | H | 0 | 0 |
| L | H | L | 0 | 1 |
| H | L | L | 0 | 1 |
| H | H | H | 0 | 0 |
| L | L | H | 1 | 1 |
| L | H | L | 1 | 0 |
| H | L | L | 1 | 0 |
| H | H | H | 1 | 1 |

METHOD AND CIRCUIT FOR DRIVING LIQUID CRYSTAL DISPLAY, AND PORTABLE ELECTRONIC DEVICE

BACKGROUND OF THE INVENTION

1. Field of the Invention

The present invention relates to a method and a driving circuit for driving a liquid crystal display (LCD), and portable electronic devices employing the driving circuit and more particularly to the method and the driving circuit for driving the LCD used as a display section having a comparatively small display screen of portable electronic devices such as a notebook computer, palm-size computer, pocket computer, personal digital assistance (PDA), portable cellular phone, personal handy-phone system (PHS) or a like and to the portable electronic devices equipped with such the driving circuit for the LCD.

The present application claims priority of Japanese Patent Application No.2001-008322 filed on Jan. 16,2000, which is hereby incorporated by reference.

2. Description of the Related Art

FIG. 20 is a schematic block diagram for showing configurations of a driving circuit for a conventional color LCD 1. The conventional color LCD 1 is an active-matrix driving type color LCD in which, for example, a thin film transistor (TFT) is used as a switching element. In the color LCD 1 of the example, a region surrounded by a plurality of scanning electrodes (gate lines) placed at established intervals in a row direction and by a plurality of data electrodes (source lines) placed at established intervals in a column direction, is used as a pixel. Each pixel of the color LCD 1 has a liquid crystal cell serving as an equivalent capacitive load, common electrode, TFT used to drive the corresponding liquid crystal cell, and capacitor used to accumulate a data electrode for one vertical sync period. To drive the color LCD 1 of the example, a data red signal, data green signal, and data blue signal produced based respectively on a red data $D_R$, green data $D_G$, and blue data $D_B$ contained in digital video data are fed to the data electrode while scanning signals produced based on a horizontal sync signal $S_H$ and a vertical sync signal $S_V$ are fed to a scanning electrode, with a common potential Vcom being applied to the common electrode. This enables a color character, image, or a like to be displayed on a display screen of the color LCD 1 of the example. Moreover, the color LCD 1 of the example is a so-called "normally white mode" type LCD which provides a high transmittance while a voltage is not being applied.

Moreover, the driving circuit to drive the above color LCD 1 chiefly includes a control circuit 2, a gray scale power source 3, a common power source 4, a data electrode driving circuit 5, and a scanning electrode driving circuit 6. The control circuit 2 is made up of, for example, an application specific integrated circuit (ASIC) adapted to convert 6 bits of the red data $D_R$, 6bits of the green data $D_G$, and 6 bits of blue data $D_B$, all of which are fed from an outside, into 18 bits of display data $D_{00}$ to $D_{05}$, $D_{10}$ to $D_{15}$, $D_{20}$ to $D_{25}$ and to feed them to the data electrode driving circuit 5. Moreover, the control circuit 2 produces a strobe signal STB, clock CLK, horizontal start pulse STH, polarity signal POL, vertical start pulse STV, and data inverting signal INV, based on a dot clock DCLK, the horizontal sync signal $S_H$, the vertical sync signal $S_V$, or a like, all which are fed from the outside, and feeds them to the gray scale power source 3, common power source 4, data electrode driving circuit 5, and scanning electrode driving circuit 6. The strobe signal STB is a signal having a same period as that of the horizontal sync signal $S_H$. The clock CLK has a same frequency as that of a dot clock DCLK or has a frequency being different from that of the dot clock DCLK and, as described later, is used to produce sampling pulses $SP_1$ to $SP_{176}$ using the horizontal start pulse STH in a shift register 12 making up a data electrode driving circuit 5. The horizontal start pulse STH has a same period as the horizontal sync signal $S_H$ and is a signal being delayed by several pulses of the clock CLK behind the strobe signal STB. Moreover, the polarity signal POL is a signal that inverts in every one horizontal sync period, that is, for every one line, to drive the color LCD 1 with alternating current. The polarity signal POL inverts in every one horizontal sync period. The vertical start pulse STV is a signal having a same period as that of the vertical sync signal $S_V$. The data inverting signal INV is a signal used to reduce power consumption in the control circuit 2. When present display data $D_{00}$ to $D_{05}$, $D_{10}$ to $D_{15}$, and $D_{20}$ to $D_{26}$ each being made up of 18 bits are those resulting from inversion of previous display data $D_{00}$ to $D_{05}$, $D_{10}$ to $D_{15}$, and $D_{20}$ to $D_{25}$ each being made up of 18 bits, by 10 bits or more, instead of inverting the present display data $D_{00}$ to $D_{05}$, $D_{10}$ to $D_{15}$, and $D_{20}$ to $D_{25}$, the data inverting signal INV is inverted in synchronization with the clock CLK. The reason that the data inverting signal INV is used here will be described below. That is, in portable electronic devices equipped with the driving circuit for the above color LCD 1, usually, the control circuit 2, the gray scale power source 3, or a like are placed on a printed board, however, the data electrode driving circuit 5 is placed on a film carrier tape which connects the printed board electrically to the color LCD 1 and is packaged as a tape carrier package (TCP). The printed board is placed in an upper portion of a rear face of a backlight attached to a rear of the color LCD 1. Therefore, in order to feed the 18 bits of the display data $D_{00}$ to $D_{05}$, $D_{10}$ to $D_{15}$, and $D_{20}$ to $D_{25}$ from the control circuit 2 to the data electrode driving circuit 5, formation of 18 pieces of wirings on the film carrier tape on which the data electrode driving circuit 5 is placed is required. Each of the 18 pieces of the wirings has a wiring capacitor. Moreover, an inputting capacitor of the data electrode driving circuit 5 when viewed from the control circuit side 2 has a capacitance of about 20 pF. Therefore, if the 18 bits of the display data $D_{00}$ to $D_{15}$, $D_{10}$ to $D_{15}$, and $D_{20}$ to $D_{25}$ have to be inverted and to be fed from the control circuit 2 to the data electrode driving circuit 5, a current to be used for charging and discharging the above wiring capacitor and the inputting capacitor is required. To solve this problem, instead of inverting the 18 bits of the display data $D_{00}$ to $D_{05}$, $D_{10}$ to $D_{15}$, and $D_{20}$ to $D_{25}$ themselves, by inverting the data inverting signal INV, the charging and discharging current to be fed to the above wiring capacitor and inputting capacitor is reduced and power consumption of the control circuit 2 is reduced.

The gray scale power source 3, as shown in FIG. 21, includes resistors $7_1$ to $7_{10}$, switches 8*a*, 8*b*, 9*a*, and 9*b*, inverter 10, and voltage followers $11_1$ to $11_9$. The gray scale power source 3 amplifies gray scale voltages $V_{11}$ to $V_{19}$ which are set to make gamma correction and feeds the amplified gray scale voltages $V_{11}$ to $V_{19}$ to the data electrode driving circuit 5. A potential of each of the gray scale voltages $V_{11}$ to $V_{19}$ is inverted between positive polarity and negative polarity for one line, in response to a polarity signal POL, relative to a common potential Vcom being applied to a common electrode of the color LCD 1. Each of the resistors $7_1$ to $7_{10}$ has a different resistance value and the resistors $7_1$ to $7_{10}$ are cascade-connected to each other. To one terminal of the switch 8*a* is applied a supply voltage $V_{DD}$ and another terminal is connected to one terminal of the resistor $7_1$. When the polarity signal POL is at a high level, the switch 8*a* is turned ON and feeds the supply voltage $V_{DD}$ to one terminal of the resistors $7_1$ to $7_{10}$ that are cascade-connected. One terminal of the switch 8*b* is connected to a ground and another terminal is connected to one terminal of the resistor $7_1$. When an output signal of the inverter 10, that is, an inverted signal of the polarity signal POL is at a high level, the switch 8*b* is turned ON and causes one terminal of the resistors $7_1$ to $7_{10}$ being cascade-connected to be connected to the ground. One terminal of the switch 9*a* is connected to a ground and another terminal is connected to one terminal of the resistor $7_{10}$. When the polarity signal POL is at a high level, the switch 9*a* is turned ON and causes another terminal of the resistors $7_1$ to $7_{10}$ being cascade-connected to be connected to the ground. To one terminal of the switch 9*b* is applied the supply voltage $V_{DD}$ and another terminal of the switch 9*b* is connected to one terminal of the resistor $7_{10}$. When an inverted signal of the polarity signal POL is at a high level, the switch 9*b* is turned ON and causes the supply voltage $V_{DD}$ to be applied to another terminal of the resistors $7_1$ to $7_{10}$ being cascade-connected.

That is, the gray scale power source 3, while the polarity signal POL is at a high level, produces gray scale voltages $V_{11}$ to $V_{19}$ ($GND<V_{19}<V_{18}<V_{17}<V_{16}<V_{15}<V_{14}<V_{13}<V_{12}<V_{11}<V_{DD}$) each having positive polarity which have been obtained by dividing the supply voltage $V_{DD}$ based on a resistance ratio of the resistors $7_1$ to $7_{10}$ and, after having amplified these voltages by the voltage followers $1_1$ to $11_9$, feeds them to the data driving circuit 5. On the other hand, the gray scale power source 3, while the polarity signal POL is at a low level, produces gray scale voltages $V_{11}$ to $V_{19}$ ($GND<V_{11}<V_{12}<V_{13}<V_{14}<V_{15}<V_{16}<V_{17}<V_{18}<V_{19}<V_{DD}$) each having negative polarity which have been obtained by dividing the supply voltage $V_{DD}$ based on a resistance ratio of the resistors $7_1$ to $7_{10}$ and, after having amplified these voltages by the voltage followers $1_1$ to $11_9$, feeds them to the data driving circuit 5.

The common power source 4, while the polarity signal POL is at a high level, causes the common potential Vcom to be at a ground level and, while the polarity signal POL is at a low level, causes the common potential Vcom to be at a level of the supply voltage ($V_{DD}$) and supplies these voltages to a common electrode of the color LCD 1. The data electrode driving circuit 5 selects a predetermined gray scale voltage with timing when the strobe signal STB, clock CLK, horizontal start pulse STH and data inverting signal INV are fed from the control circuit 2 and, by using the 18 bits of the display data $D_{00}$ to $D_{05}$, $D_{10}$ to $D_{15}$, and $D_{20}$ to $D_{25}$ which are also fed from the control circuit 2, selects a predetermined gray scale voltage and then applies them to a corresponding data electrode in the color LCD 1 as a data red signal, data green signal, and data blue signal. The scanning electrode driving circuit 6 produces scanning signals, sequentially, with timing when a vertical start pulse STV is supplied from the control circuit 2, and then applies them sequentially to a corresponding scanning electrode in the color LCD 1.

Next, the data electrode driving circuit 5 is explained in detail. In the example, let it be assumed that the color LCD 1 provides 176×220 pixel resolution. Since one pixel is made up of three dot pixels including red (R), green (G), and blue (B) colors, the total number of the dot pixels is 528×220 pixels.

The data electrode driving circuit 5 includes, as shown in FIG. 22, a shift register 12, data buffer 13, data register 14, control circuit 15, data latch 6, gray scale voltage generating circuit 17, gray scale voltage selecting circuit 18 and outputting circuit 19. The shift register 12 is a serial-in parallel-out type shift register 12 made up of 176 pieces of delay flip-flops (DFF) which performs shifting operations to shift the horizontal start pulse STH fed from the control circuit 2 in synchronization with the clock CLK fed from the control circuit 2 and also outputs 176 bits of parallel sampling pulses $Sp_1$ to $SP_{176}$.

The data buffer 13, as described above, inverts 18 bits of the display data $D_{00}$ to $D_{05}$, $D_{10}$ to $D_{15}$, and $D_{20}$ to $D_{25}$ being fed from the control circuit 2, based on the data inverting signal INV used to reduce power consumption of the control circuit 2 and then feeds the inverted data to the data register 14 as display data $D'_{00}$ to $D'_{05}$, $D'_{10}$ to $D'_{15}$, and $D'_{20}$ to $D'_{25}$. Or the data buffer 13 feeds the above 18 bits of the display data $D_{00}$ to $D_{05}$, $D_{10}$ to $D_{15}$, and $D_{20}$ to $D_{25}$ being fed from the control circuit 2 without inverting them as the display data $D'_{00}$ to $D'_{05}$, $D'_{10}$ to $D'_{15}$, and $D'_{20}$ to $D'_{25}$. FIG. 23 is a schematic block diagram showing one example of configurations of part of a data buffer making up the driving circuit for the conventional color LCD 1. The data buffer 13 is made up of 18 pieces of data buffer sections $\mathbf{13}_{a1}$ to $\mathbf{13}_{a18}$ and one control section $\mathbf{13}_b$. The control section $\mathbf{13}_b$ is made up of two groups of inverters each having a plurality of inverters being connected in series to each other. The control section $\mathbf{13}_b$ causes the data inverting signal INV and the clock CLK fed from the control circuit 2 to be delayed by predetermined period of time behind corresponding inverter groups and feeds them to the data buffer sections $\mathbf{13}_{a1}$ to $\mathbf{13}_{a18}$ as a data inverting signal $INV_1$ and a clock $CLK_1$. Configurations of each of the data buffer sections $\mathbf{13}_{a1}$ to $\mathbf{13}_{a18}$ are the same except that subscripts of components differ from each other and subscripts of signals input and output from and to the data buffer sections $\mathbf{13}_{a1}$ to $\mathbf{13}_{a18}$ differ from each other and therefore only the configurations of the buffer section $\mathbf{13}_{a1}$ are described. The data buffer section $\mathbf{13}_{a1}$ as shown in FIG. 23, includes a DFF $\mathbf{20}_1$, inverters $\mathbf{21}_1$, $\mathbf{22}_1$, and $\mathbf{23}_1$, and switching unit $\mathbf{24}_1$. The DFF $\mathbf{20}_1$, after having held one bit of the display data $D_{00}$ during one pulse of the clock $CLK_1$ in synchronization with the clock $CLK_1$, outputs it. The inverter $\mathbf{21}_1$ inverts output data from the DFF $\mathbf{20}_1$. The switching unit $\mathbf{24}_1$ is made up of a switch $\mathbf{24}_{1a}$ and $\mathbf{24}_{1b}$ In the switching unit $\mathbf{24}_1$, while the data inverting signal $INV_1$ is at a high level, the switch $\mathbf{24}_{1a}$ is turned ON and outputs data fed from the DFF $\mathbf{20}_1$ and, while the data inverting signal $INV_1$ is at a low level, the switch $\mathbf{24}_{1b}$ is turned ON and outputs data fed from the inverter $\mathbf{21}_1$. The inverter $\mathbf{22}_1$ inverts data fed from the switching unit $\mathbf{24}_1$ and the inverter $\mathbf{23}_1$ inverts data fed from the inverter $\mathbf{22}_1$ and outputs it as the display data $D'_{00}$.

The data register 14 shown in FIG. 22 captures the display data $D'_{00}$ to $D'_{05}$ $D'_{10}$ to $D'_{15}$, and $D'_{20}$ to $D'_{25}$ fed from the data buffer 13 in synchronization with sampling pulses $SP_1$ to $SP_{176}$ as display data $PD_1$ to $PD_{528}$ and feeds them to the data latch 16. The control circuit 15 is made up of a plurality of inverters being connected in series. The control circuit 15 produces a strobe signal $STB_1$ obtained by delaying the strobe signal STB fed from the control circuit 2 by predetermined period of time and a switching control signal SWA being in opposite phase with the strobe signal $STB_1$. The control circuit 15 feeds the strobe signal $STB_1$ to the data latch 16 and feeds the switching control signal SWA to the outputting circuit 19. The data latch 16, in synchronization with a rise of the strobe signal $STB_1$ to be fed from the control circuit 15, captures the display data $PD_1$ to $PD_{528}$ fed from the data register 14 and holds, until the subsequent strobe signal $STB_1$ is fed, that is, during one horizontal sync period, the captured display data $PD_1$ to $PD_{528}$. The gray scale voltage generating circuit 17, as shown in FIG. 24, is made up of resistors $\mathbf{25}_1$ to $\mathbf{25}_{63}$ being cascade-connected. Each of the resistors $\mathbf{25}_1$ to $\mathbf{25}_{63}$ is so constructed that its resistance can meet an "applied voltage—transmittance characteristic" of the color LCD 1. In the gray scale voltage generating circuit 17, out of gray scale voltages $V_{I1}$ to $V_{I9}$, the gray scale voltage $V_{I1}$ is applied to one terminal of the resistor $\mathbf{25}_1$, gray scale voltage $V_{I2}$ is applied to a connection point between a resistor $\mathbf{25}_7$ and resistor $\mathbf{25}_8$, gray scale voltage $V_{I3}$ is applied to a connection point between a resistor $\mathbf{25}_{15}$ and a resistor $\mathbf{25}_{16}$, and the gray scale voltage $V_{I4}$ is applied to a connection point between a resistor $\mathbf{25}_{23}$ to a resistor $\mathbf{25}_{24}$. Moreover, in the gray scale voltage generating circuit 17, out of the gray scale voltages $V_{I1}$ to $V_{I9}$, the gray scale voltage $V_{15}$ is applied to a connection point between the resistor $\mathbf{25}_{31}$ to $\mathbf{25}_{32}$, gray scale voltage $V_{I6}$ is applied to a connection point between a resistor $\mathbf{25}_{39}$ to $\mathbf{25}_{40}$, gray scale voltage $V_{I5}$ is applied to a connection point between the resistor $\mathbf{25}_{31}$ and resistor $\mathbf{25}_{32}$, gray scale voltage $V_{I6}$ is applied to a connection point between the resistor $\mathbf{25}_{39}$ to the resistor $\mathbf{25}_{40}$, and gray scale voltage $V_{I7}$ is applied to a connection point between the resistor $\mathbf{25}_{47}$ and resistor $\mathbf{25}_{48}$, gray scale voltage $V_{I8}$ is applied to a connection point between the resistor $\mathbf{25}_{55}$ and resistor $\mathbf{25}_{56}$, gray scale voltage $V_{I9}$ is applied to one terminal of the resistor $\mathbf{25}_{13}$. As a result, the gray scale voltage generating circuit 17 divides nine kinds of the gray scale voltages $V_{I1}$ to $V_{I9}$ based on a resistance ratio of the resistors $\mathbf{25}_1$ to $\mathbf{25}_{63}$ and outputs 64 kinds of the gray scale voltages $V_1$ to $V_{64}$ whose polarity is inverted between a positive state and a negative state for every line relative to the common potential Vcom being applied to the common electrode of the color LCD 1.

The gray scale voltage selecting circuit 18 shown in FIG. 22 is made up of gray scale voltage selecting sections $\mathbf{18}_1$ to $\mathbf{18}_{528}$. Each of the gray scale voltage selecting sections $\mathbf{18}_1$ to $\mathbf{18}_{528}$, based on values of 6 bits of digital display data $PD_1$ to $PD_{528}$, selects one gray scale voltage out of 64 pieces of the gray scale voltages $V_1$ to $V_{64}$ to be fed from the gray scale voltage generating circuit 17 and feeds it to an amplifier corresponding to the outputting circuit 19. Since configurations of each of the gray scale voltage selecting sections $\mathbf{18}_1$ to $\mathbf{18}_{528}$ are the same, only the configuration of the gray scale selecting section $\mathbf{18}_1$ is explained here. The gray scale voltage selecting section $\mathbf{18}_1$, as shown in FIG. 25, is made up of a multiplexer (MPX) 26, transfer gates $\mathbf{27}_1$ to $\mathbf{27}_{64}$, and inverters $\mathbf{28}_1$ to $\mathbf{28}_{64}$. The MPX 26, based on a value of corresponding 6 bits of the display data $PD_1$, causes any one of 64 pieces of transfer gates $\mathbf{27}_1$ to $\mathbf{27}_{64}$ to be turned ON. Each of the transfer gates $\mathbf{27}_1$ to $\mathbf{27}_{64}$ is made up of a P-channel MOS transistor 29*a* and an N-channel MOS transistor 29*b*, which is turned ON by the MPX 26 and outputs a corresponding gray scale voltage as the data red signal, data green signal, or data blue signal. The outputting circuit 19 is made up of 528 pieces of outputting sections $\mathbf{19}_1$ to $\mathbf{19}_{528}$ and each of the outputting sections $\mathbf{19}_1$ to $\mathbf{19}_{528}$ has each of amplifiers $\mathbf{30}_1$ to $\mathbf{30}_{528}$, and each of 528 pieces of switches $\mathbf{31}_1$ to $\mathbf{31}_{528}$ placed on a latter stage of each of the amplifiers $\mathbf{30}_1$ to $\mathbf{30}_{528}$. The outputting circuit 19 amplifies the corresponding data red signal, data green signal, and data blue signal fed from the gray scale voltage selecting circuit 18 and then applies them through switches $\mathbf{31}_1$ to $\mathbf{31}_{528}$ which have been turned ON by a switching control signal SWA fed from the control circuit 15 to corresponding data electrode in the color LCD 1. In FIG. 25, the amplifier $\mathbf{30}_1$ placed to output a data red signal $S_1$ corresponding to the display data $PD_1$ and the switch $\mathbf{31}_1$ are shown.

Next, operations of the control circuit 2, gray scale power source 3, common power source 4, and data electrode driving circuit 5, out of operations of the driving circuit for the conventional color LCD 1, will be described by referring to a timing chart shown in FIG. 26. First, the control circuit 2 feeds a clock CLK (not shown), a strobe signal STB shown by (1) in FIG. 26, a horizontal start pulse STH being delayed by several pulses of the clock CLK behind the strobe signal STB shown by (2) in FIG. 26, and a polarity signal POL shown by (3) in FIG. 26, to a data electrode driving circuit 5. As a result, the shift register 12 in the data electrode driving circuit 5 performs shifting operations to shift the horizontal start pulse STH in synchronization with the clock CLK and outputs 176 bits of parallel sampling pulses $SP_1$ to $SP_{176}$. At almost the same time, the control circuit 2 converts each of the 6 bits of red data $D_R$, green data $D_G$, and blue data $D_B$ into 18 bits of the display data $D_{00}$ to $D_{05}$, $D_{10}$ to $D_{15}$, and $D_{20}$ to $D_{25}$ and feeds the data to the data electrode driving circuit 5 (not shown). As a result, the 18 bits of the display data $D_{00}$ to $D_{051}$ $D_{10}$ to $D_{15}$, and $D_{20}$ to $D_{25}$, after being held during one pulse of the clock $CLK_1$ by the data buffer 13 of the data electrode driving circuit 5 in synchronization with a clock $CLK_1$ being delayed by a predetermined period of time behind the clock CLK, are fed to the data register 14 as display data $D'_{00}$ to $D'_{05}$, $D'_{10}$ to $D'_{15}$, and $D'_{20}$ to $D'_{25}$. Therefore, the display data $D'_{00}$ to $D'_{05}$, $D'_{10}$ to $D'_{15}$, and $D'_{20}$ to $D'_{25}$ are captured sequentially in synchronization with sampling pulses $SP_1$ to $SP_{176}$ fed from the shift register 12 in the data register 14 as display data $PD_1$ to $PD_{528}$ and then also captured simultaneously in the data latch 16 in synchronization with a rise of the strobe signal $STB_1$ and is held during one horizontal period.

Next, in the gray scale power source 3 shown in FIG. 21, when the polarity signal POL shown by (3) in FIG. 26 is at a high level, switches 8*a* and 9*a* are turned ON and, at the same time, switches 8*b* and 9*b* are turned ON. This causes the supply voltage $V_{DD}$ to be applied to one terminal of the resistor $\mathbf{7}_1$ and one terminal of the resistor $\mathbf{7}_{10}$ to be connected to the ground and the gray scale voltages $V_{I1}$ to $V_{I9}$ ($GND<V_{19}<V_{18}<V_{17}<V_{16}<V_{15}<V_{14}<V_{13}<V_{12}<V_{11}<V_{DD}$) each having a positive polarity are produced (by (4) of FIG. 4, gray scale voltage $V_{I1}$ is shown only). The gray scale voltages $V_{I1}$ to $V_{I9}$ of positive polarity, after having been amplified by the voltage followers $\mathbf{11}_1$ to $\mathbf{11}_9$, are fed to the gray scale voltage generating circuit 17 in the data driving circuit 5 shown in FIG. 22. Therefore, in the gray scale voltage generating circuit 17, the gray scale voltages $V_{I1}$ to $V_{I9}$ of positive polarity are divided based on resistance ratio of the resistors $\mathbf{25}_1$ to $\mathbf{25}_{63}$ and, as a result, 64 pieces of the gray scale voltages $V_1$ to $V_{64}$ (the gray scale voltage $V_1$ is the nearest to the supply voltage $V_{DD}$ and the gray scale voltage $V_{64}$ is the nearest to the ground level) of the positive polarity are produced and then are fed to the gray scale voltage selecting circuit 18.

Therefore, in each of the gray scale voltage selecting sections $\mathbf{18}_1$ to $\mathbf{18}_{528}$ in the gray scale voltage selecting circuit 18, the MPX 26 turns ON any one of the 64 pieces of the transfer gates $\mathbf{27}_1$ to $\mathbf{27}_{64}$ based on values of the corresponding 6 bits of the display data $PD_1$ to $PD_{528}$. This causes the corresponding gray scale voltage to be output as the data red signal, data green signal, and data blue signal from the transfer gate 27 that have been turned ON. The data red signal, data green signal, and data blue signal are amplified by corresponding amplifiers $\mathbf{30}_1$ to $\mathbf{30}_{528}$ in the outputting circuit 19. An output signal from each of the amplifiers $\mathbf{30}_1$ to $\mathbf{30}_{528}$ is applied through switches $\mathbf{31}_1$ to $\mathbf{31}_{528}$ having been turned ON by a switching control signal SWA (see (6) in FIG. 26) which rises with timing when the strobe signal STB shown by (1) in FIG. 26, as the data red signal, data green signal, and data blue signal $S_1$ to $S_{528}$, to corresponding data electrodes in the color LCD 1. A waveform of the data red signal $S_1$ provided when a value of the display data $PD_1$ is "000000" is shown by (7) in FIG. 26. In this case, in the gray scale voltage selecting section $\mathbf{18}_1$, the MPX 26, based on a value of the corresponding display data $PD_1$ of "000000", has the transfer gate $\mathbf{27}_1$ turned ON to cause the gray scale voltage $V_1$ of the positive polarity to be output as the data red signal $S_1$. Referring to (7) in FIG. 26, a reason why part of the data red signal $S_1$ is shown by the dotted lines when the strobe signal STB is at a high level is that, since the switch $\mathbf{31}_1$ is turned OFF, the voltage to be applied in response to the data red signal $S_1$ output from the outputting section $\mathbf{19}_1$ to the corresponding data electrode in the color LCD 1 is put into a stage of high impedance. On the other hand, the common power source 4, based on the high-level polarity signal POL, makes the common potential Vcom be at a ground level (see (5) in FIG. 26) and then feeds it to the common electrode in the color LCD 1. Therefore, a black color is displayed in a corresponding pixel in the color LCD 1 which is of normally white type.

Then, in the gray scale power source 3 shown in FIG. 21, when the polarity signal POL shown by (3) in FIG. 26 is at a high level, the switches 8*a* and 9*a* are turned OFF and the switches 8*b* and 9*b* are turned ON. This causes one terminal of the resistor $\mathbf{7}_1$ to be connected to the ground and the supply power $V_{DD}$ to be applied to one terminal of the resistor $\mathbf{7}_{10}$ and the gray scale voltages $V_{11}$ to $V_{19}$ of negative polarity ($GND<V_{11}<V_{12}<V_{13}<V_{14}<V_{15}<V_{16}<V_{17}<V_{18}<v_{19}<V_{DD}$)

are generated (by (4) in FIG. 26, only the gray scale voltage $V_{11}$ is shown). The gray scale voltages $V_{11}$ to $V_{19}$ of negative polarity, after having been amplified by the voltage followers $\mathbf{11}_1$ to $\mathbf{11}_9$, are fed to the gray scale voltage generating circuit 17 in the data driving circuit 5 shown in FIG. 22. Therefore, the gray scale voltages $V_{11}$ to $V_{19}$ of negative polarity are divided, based on the resistance ratio of the resistors $\mathbf{25}_1$ to $\mathbf{25}_{63}$ and, as a result, 64 pieces of gray scale voltages $V_1$ to $V_{64}$ of negative polarity (gray scale voltage $V_1$ is the nearest to a ground while the gray scale voltage $V_{64}$ is nearest to the supply power $V_{DD}$) are generated and are fed to the gray scale voltage selecting circuit 18. Therefore, in each of the gray scale voltage selecting sections $\mathbf{18}_1$ to $\mathbf{18}_{528}$ in the gray scale voltage selecting circuit 18, the MPX 26, based on a value of the corresponding 6 bits of the display data $PD_1$ to $PD_{528}$, turns ON any one of the 64 pieces of the transfer gates $\mathbf{27}_1$ to $\mathbf{27}_{64}$. This causes corresponding voltages to be generated from the transfer gate 27 having been turned ON as the data red signal, data green signal, and data blue signal. The data red signal, data green signal, and data blue signal are amplified by the corresponding amplifiers $\mathbf{30}_1$ to $\mathbf{30}_{528}$ in the outputting circuit 19. Each of signals output from each of the amplifiers $\mathbf{30}_1$ to $\mathbf{30}_{528}$ is applied, as the data red signal, data green signal, and data blue signal, to corresponding data electrode in the color LCD 1 through switches $\mathbf{31}_1$ to $\mathbf{31}_{528}$ having been turned ON in response to the switching control signal SWA (refer to (6) in FIG. 26) which rises with timing when the strobe signal STB shown by (1) in FIG. 26 falls. One example of a waveform of the data red signal $S_1$ appearing when a value of the display data $PD_1$ is "000000" is shown by (7) in FIG. 26. In this case, in the gray scale voltage selecting section $\mathbf{18}_1$, the MPX 26, based on the value "000000" of the corresponding display data $PD_1$, causes the transfer gate $\mathbf{27}_1$ to be turned ON and the gray scale voltage $V_1$ of negative polarity to be output as the data red signal $S_1$. On the other hand, the common power source 4, based on the low-level polarity signal POL, makes the common voltage be at a level of the supply voltage ($V_{DD}$) and applies it to the common electrode in the color LCD 1. Therefore, a black color is displayed on a corresponding pixel in the normally-white type color LCD 1.

Thus, the method in which a data signal whose potential is inverted for every line relative to the common potential Vcom being applied to the common electrode in the color LCD 1 is fed to the data electrode and, at the same time, the common potential Vcom is inverted so as to be at the ground level and to be at a $V_{DD}$ level for every line is called a "line inverting driving method". The line inverting driving method is conventionally used because continuous application of a voltage of a same polarity to a liquid crystal cell causes a life of the color LCD 1 to be shortened and, even if a voltage being applied to the liquid crystal cell is of opposite polarity, the liquid crystal cell has almost the same transmittance characteristic.

As described above, in the conventional driving circuit for the color LCD 1, each of the gray scale voltage selecting sections $\mathbf{18}_1$ to $\mathbf{18}_{528}$ in the gray scale voltage selecting circuit 18 is made up of each of the transfer gates $\mathbf{27}_1$ to $\mathbf{27}_{64}$. Therefore, the gray scale voltage selecting circuit 18 has 528×64 pieces of the transfer gates and a parasitic capacitance of about 500 pF as a whole. Also, as described above, in the conventional driving circuit for the color LCD 1, since the line inverting driving method is employed, in the gray scale power source 3 shown in FIG. 21, the gray scale voltage of positive polarity or of negative polarity are output by alternately changing over the switches 8*a* and 9*a* and switches 8*b* and 9*b* for every line. Moreover, as shown in FIG. 24, in the conventional driving circuit in the color LCD 1, the gray scale voltage generating circuit 17 is made up of resistors $\mathbf{25}_1$ to $\mathbf{25}_{63}$ being cascade-connected to each other.

If a sum total of resistances of the resistors $\mathbf{25}_1$ to $\mathbf{25}_{63}$ is "R", after the switches 8*a* and 9*a* or switches 8*b* and 9*b* have been changed over, time T of at least 8×C×R (μsec) (99.97% of a final value) is required before the gray scale voltages $V_1$ to $V_{64}$ of positive or negative polarity being fed to the transfer gates $\mathbf{27}_1$ to $\mathbf{27}_{64}$ making up each of the gray scale voltage selecting sections $\mathbf{18}_1$ to $\mathbf{18}_{528}$ reaches a predetermined value. In the case of the color LCD 1 which provides 176×220 pixel resolution, the time T is about 50 μsec. Therefore, the sum total of the resistance values is 12.5 k□($=50\times10^{-6}/8/500\times10^{-12}$). If the supply voltage $V_{DD}$ is 5 volts, since a current I flowing through the resistors $\mathbf{25}_1$ to $\mathbf{25}_{63}$ being cascade-connected becomes 0.4 mA ($=5/12.5\times10^3$) power consumption in the gray scale voltage generating circuit 17 is as high as 2 mW ($=0.4\times10^3\times5$). This power of 2 mW is consumed all the time in the gray scale voltage generating circuit 17. Moreover, as described above, the gray scale voltage selecting circuit 18 has a parasitic capacitance of about 500 pF. When the polarity of a voltage being applied to the resistors $\mathbf{25}_1$ to $\mathbf{25}_{63}$ is changed for every line by the line inverting driving method, since a charging or discharging current flows through the parasitic capacitor C, the power consumption in the gray scale voltage selecting circuit 18 is 0.125 mW. The total power consumption of 2.125 mW is a value being not negligible in the portable electronic devices being driven by a battery or a like such as the notebook computer, palm-size computer, pocket computer, PDA, portable cellular phone, PHS or a like.

Moreover, as described above, since the parasitic capacitance C of the gray scale voltage selecting circuit 18 is as large as about 500 pF as a whole, it takes time charging or discharging the parasitic capacitor C at the time of the line inverting driving operation, which causes inferior contrast on the screen of the color LCD 1.

Furthermore, it is inevitably necessary to make small and lightweight the portable electronic devices being driven by the battery or the like such as the notebook computer, palm-size computer, pocket computer, PDA, portable cellular phone, PHS, or the like. However, in the conventional driving circuit for the color LCD 1, not only the gray scale power source 3 is placed separately outside of the data electrode driving circuit 5, but also the gray scale voltage selecting circuit 18 is made up of as many as 528×64 pieces of transfer gates. Therefore, the printed board requires an area sufficiently enough to house such the gray scale power source 3 and, as a result, the semiconductor integrated circuit (IC) making up the data electrode driving circuit 5 having such the gray scale voltage selecting circuit 18 naturally becomes large in size. This produces a bottleneck in scaling down and making lightweight the portable electronic devices.

Moreover, in the portable cellular phone or PHS, when the color LCD 1 providing 176×220 pixel resolution is driven at a frequency of about 60 Hz, one horizontal sync period is 60 to 70 μsec. On the other hand, an actual driving time of the color LCD 1 is about 40 μsec per one horizontal sync period. However, in the driving circuit of the color LCD 1, even during a period (about 20 to 30 μsec) not required for driving the color LCD 1, the amplifiers $\mathbf{30}_1$ to $\mathbf{30}_{528}$ to drive the outputting circuit 19 are put in an active state and, therefore, power consumption is as large as about 24 mW. This produces a bottleneck in reducing power consumption in the above portable electronic devices.

Also, as described above, in the conventional driving circuit for the color LCD 1, assuming that, even if the polarity of the voltage being applied to a liquid crystal cell becomes opposite, the liquid crystal has a same transmittance characteristic, in the gray scale power voltage 3 shown in FIG. 21, the gray scale voltages $V_{I1}$ to $V_{I9}$ each having a same voltage are used, by inverting only the polarity. However, the applied voltage—transmittance characteristic in actual liquid cells differs between when a voltage of positive polarity is applied and when a voltage of negative polarity is applied, due to switching noises of the TFT serving as the switching element. Therefore, when the gray scale voltages $V_{I1}$ to $V_{I9}$ each having the same voltage but the opposite polarity are used, there is a problem in that color correction is difficult and an image of high quality cannot be obtained.

Inconveniences or shortcomings described above also occur even when the display screen of the color LCD 1 is comparatively small in size and a frame inverting driving method in which a data signal whose potential is inverted relative to common potentials being applied to the common electrode for every line and for every frame is fed to a data electrode, is employed. Moreover, the above inconveniences occur even in a driving circuit of a monochrome LCD in the same manner as described above.

SUMMARY OF THE INVENTION

In view of the above, it is an object of the present invention to provide a method and a driving circuit for driving an LCD, being capable of reducing power consumption, decreasing a packaging area or a number of packaged parts and providing an image of high quality when the LCD having a comparatively small display screen is driven by a line inverting driving method or by a frame inverting driving method and portable electronic devices employing the above driving circuit.

According to a first aspect of the present invention, there is provided a method for driving an LCD for sequentially feeding a scanning signal to a plurality of scanning electrodes and a data signal to a plurality of data electrodes to drive the LCD in which a liquid crystal cell is arranged at a point of intersection between each of the plurality of the scanning electrodes placed at regular intervals in a row direction and each of the plurality of the data electrodes placed at regular intervals in a column direction, the method including:

a step of outputting digital video data, with or without the digital video data being inverted, based on a polarity signal which is inverted in every one horizontal sync period or in every one vertical sync period;

a step of selecting, based on the polarity signal, a plurality of gray scale voltages having either of positive polarity or negative polarity out of the plurality of the gray scale voltages of positive polarity and the plurality of the gray scale voltages of negative polarity both having been in advance set so as to match a transmittance characteristic to an applied voltage of positive polarity and a transmittance characteristic to an applied voltage of negative polarity in the LCD; and a step of selecting, based on the inverted digital video data or the non-inverted digital video data, one gray scale voltage out of the plurality of the gray scale voltages having a selected polarity to apply the one selected gray scale voltage as the data signal to a corresponding data electrode.

In the foregoing, a preferable mode is one that wherein includes a step of amplifying the selected one gray scale voltage only for a predetermined period of time in an approximate middle of one horizontal sync period and applying the amplified selected one gray scale voltage as the data signal to the corresponding data electrode and feeding the selected one gray scale voltage as the data signal, as it is, to the corresponding data electrode during a period after the predetermined period of time in the approximate middle of the one horizontal sync period.

Also, a preferable mode is one that wherein includes a step of determining whether the digital video data is output, with or without the digital video data being inverted, based on a combination of a logic between a data inverting signal and the polarity signal, instead of inverting the digital video data, in order to reduce power consumption.

According to a second aspect of the present invention, there is provided a driving circuit to drive an LCD for sequentially feeding a scanning signal to a plurality of scanning electrodes and a data signal to a plurality of data electrodes to drive the LCD in which a liquid crystal cell is arranged at a point of intersection between each of the plurality of the scanning electrodes placed at regular intervals in a row direction and each of the plurality of the data electrodes placed at regular intervals in a column direction, the driving circuit including: a data latch used to output digital video data, with or without the digital video data being inverted, based on a polarity signal which is inverted in every one horizontal sync period or in every one vertical sync period;

a gray scale voltage generating circuit used to produce a plurality of gray scale voltages of positive polarity and a plurality of gray scale voltages of negative polarity both having been in advance set so as to match a transmittance characteristic to an applied voltage of positive polarity and a transmittance characteristic to an applied voltage of negative polarity in the LCD;

a polarity selecting circuit used to select, based on the polarity signal, a plurality of gray scale voltages having either of positive polarity or negative polarity out of the plurality of the gray scale voltages of positive polarity and the plurality of the gray scale voltages of negative polarity;

a gray scale voltage selecting circuit used to select, based on the inverted digital video data or non-inverted digital video data, any one of gray scale voltage out of the plurality of the gray scale voltages having the selected polarity; and an outputting circuit used to apply the one selected gray scale voltage as the data signal to a corresponding data electrode.

In the foregoing, a preferable mode is one wherein the gray scale voltage generating circuit is made up of a plurality of resistors being cascade-connected and each having a same resistance, of a first switch used to selectively apply either of a highest voltage to be fed from a gray scale power source placed outside or an internal supply voltage to one terminal of the plurality of the resistors, and a second switch used to selectively apply either of a lowest voltage to be fed from the gray scale power source placed outside or an internal ground voltage to another terminal of the plurality of the resistors, in synchronization with the first switch and wherein, out of connection points of adjacent resistors in the plurality of the resistors, a plurality of connection points where voltages to be used as a plurality of the gray scale voltages of positive polarity occur and a plurality of connection points where voltages to be used as a plurality of the gray scale voltages of negative polarity are connected to a plurality of corresponding terminals in the polarity selecting circuit and wherein, when the highest voltage and the lowest voltage are applied by the first switch and second switch across each of the plurality of the resistors, at least one voltage of an intermediate voltage between the highest voltage and the lowest voltage is applied to any one of the connection points of the adjacent resistors in the plurality of the resistors.

Also, a preferable mode is one wherein the gray scale voltage generating circuit is made up of a first plurality of resistors being cascade-connected and each of their resistances having been set in advance so that a voltage to be used as the plurality of the gray scale voltages of positive polarity occurs at each of the connection points, of a second plurality of the resistors being cascade-connected and each of their resistances having been set in advance so that a voltage to be used as the plurality of the gray scale voltages of negative polarity occurs at each of the connection points, and a switching circuit used to apply a supply voltage across each of the first plurality of the resistors or across each of the second plurality of the resistors by the polarity signal.

Also, a preferable mode is one wherein the gray scale voltage generating circuit has a first switch group used to selectively feed either of a highest voltage to be fed from a gray scale power source placed outside or an internal supply power to one terminal of the first plurality of the resistors and the second plurality of the resistors, a second switch group used to selectively feed either of a lowest voltage to be fed from the gray scale power source placed outside or an internal ground voltage to another terminal of the first plurality of the resistors and the second plurality of the resistors, and wherein, when the highest voltage and the lowest voltage are applied by the first switch group and the second switch groups across each of the first plurality of the resistors and the second plurality of the resistors, at least one voltage of an intermediate voltage between the highest voltage and the lowest voltage is applied to any one of the connection points of the adjacent resistors in the first plurality of the resistors and the second plurality of the resistors.

Also, a preferable mode is one wherein the gray scale voltage selecting circuit has a plurality of P-channel MOS transistors each being supplied with a plurality of gray scale voltages being generated on a high voltage side, out of a plurality of gray scale voltages including a supply voltage to a ground voltage, of a plurality of N-channel MOS transistors each being supplied with a plurality of gray scale voltages being generated on a low voltage side and wherein any one of the N-channel MOS transistors and the P-channel MOS transistors is turned ON in response to the digital video data to output a corresponding gray scale voltage.

Also, a preferable mode is one wherein the outputting circuit is made up of a first amplifier to amplify the one selected gray scale voltage, a third switch placed on an output side of the first amplifier and a fourth switch being connected in parallel across the first amplifier and the third switch both being connected in series and wherein, during a predetermined period of time approximately in a middle of one horizontal sync period, the third switch is turned ON and gray scale voltage amplified by the first amplifier is applied to a corresponding data electrode as the data signal and, during a period after the predetermined period of time approximately in the middle of the one horizontal sync period, the third switch is turned OFF and the fourth switch is turned ON and the selected one gray scale voltage is applied, as it is, to the corresponding data electrode as the data signal and a bias current is interrupted to put the first amplifier into a state of non-operation.

Also, a preferable mode is one wherein the outputting circuit has a bias current control circuit made up of a constant current circuit, a second amplifier used to amplify a bias current fed from the constant current circuit, a fifth switch placed at an output terminal of the second amplifier and a sixth switch being connected in parallel across the second amplifier and the fifth switch both being connected in series and wherein, during the predetermined period of time approximately in the middle of the one horizontal sync period, the constant current circuit performs constant current operations and, during a first half of the predetermined period of time in the middle of the one horizontal sync period, the fifth switch is turned ON and the bias current amplified by the second amplifier is fed to the first amplifier and, during a second half of the predetermined period of time in the middle of the one horizontal sync period, the fifth switch is turned ON and, at the same time, the sixth switch is turned ON and the bias current fed from the constant current circuit is fed, as it is, to the first amplifier.

Also, a preferable mode is one wherein, when the one horizontal sync period is 60 μsec to 70 μsec, the predetermined period of time in the middle of one horizontal sync period is 10 μsec and the period after the predetermined period of time in the middle of the one horizontal sync period is 30 μsec.

Also, a preferable mode is one wherein the data latch has a latch used to capture the digital video data in synchronization with a strobe signal having a same period as that of a horizontal sync signal and to hold the captured digital video data during the one horizontal sync period, a level shifter used to convert a voltage of output data of the latch into a fixed voltage and an exclusive OR gate used to output data output from the level shifter, with or without the output data being inverted, based on the polarity signal.

Also, a preferable mode is one wherein the data latch has a latch used to capture the digital video data in synchronization with a strobe signal having a same period as that of a horizontal sync signal and to hold the captured digital video data during the one horizontal sync period, a level shifter used to output first data obtained by converting a voltage of data output from the latch into a fixed voltage and second data obtained by performing both voltage conversion and inversion and an output switching unit to output either of the first data or the second data, based on the polarity signal.

According to a third aspect of the present invention, there is provided portable electronic devices being provided with the driving circuit for LCDs stated above.

With the above configurations, the driving circuit is constructed so that digital video data is output, with or without the digital video data being inverted, based on a polarity signal which is inverted in every one horizontal sync period or in every one vertical sync period, that a plurality of gray scale voltages is selected which is provided so as to have either of a voltage of positive or negative out of a plurality of gray scale voltages of positive and negative polarity set in advance to match an applied voltage of positive or negative polarity—transmittance characteristic in the LCD, that any one of the gray scale voltage out of a plurality of gray scale voltages having a selected polarity is selected based on digital video data, with or without a polarity of the gray scale voltage being inverted, and that the selected one gray scale voltage is applied as a data signal to corresponding data electrode. Therefore, even when an LCD being used as a display screen whose area is comparatively small is driven by a line invert driving method or by a frame invert driving method, power consumption can be reduced.

With another configuration, irrespective of whether or not a gray scale power source is placed outside, component counts making up the gray scale power source can be smaller compared in the conventional case. Moreover, when the gray scale power source is constructed of ICs, its chip can be made smaller in size.

With still another configuration, the gray scale voltage selecting circuit has a plurality of P-channel MOS transistors to which a plurality of gray scale voltages on a high voltage side, out of a plurality of gray scale voltages including a supply voltage to a ground voltage, is applied and a plurality of N-channel MOS transistors to which a plurality of gray scale voltages on a low voltage side is applied and is adapted to turn ON any one of the N-channel MOS transistors and the P-channel MOS transistors based on digital video data and outputs a corresponding voltage. Therefore, unlike the conventional case, use of a transfer gate is not required to construct the gray scale voltage. As a result, the number of component elements can be reduced to a half. Therefore, packaging area on a printed board can be reduced. An IC circuit such as a Chip on Glass (COG) making up the data electrode driving circuit can be made small in size, that is, a chip size can be made smaller. This enables it to make small and lightweight portable electronic devices which are driven by the battery, such as the notebook computer, palm-size computer, pocket computer, PDAs, portable cellular phone, PHS or a like. Also, since the number of the MOS transistors required to construct the gray scale voltage selecting circuit can be reduced to a half of those used in the conventional case, their parasitic capacitance can be reduced to a half which enables power consumption in the gray scale voltage generating circuit and the gray scale voltage selecting circuit to be reduced to about a half. This makes it possible to reduce power consumption in portable electronic devices described above and possible to make use time longer. Moreover, since amounts of charging and discharging currents flowing through the gray scale voltage generating circuit and time during which the charging and discharging currents flow can be reduced, unlike in the conventional case, no inferior contrast in the screen of the color LCD occurs. Furthermore, since the applied voltage—transmittance characteristic differs depending on whether the applied voltage is of positive polarity or of negative polarity, the driving circuit is so configured that the gray scale voltage of positive polarity and negative polarity, which makes it easy to make color correction and possible to obtain image of high quality.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings.

First Embodiment

Figure 1:
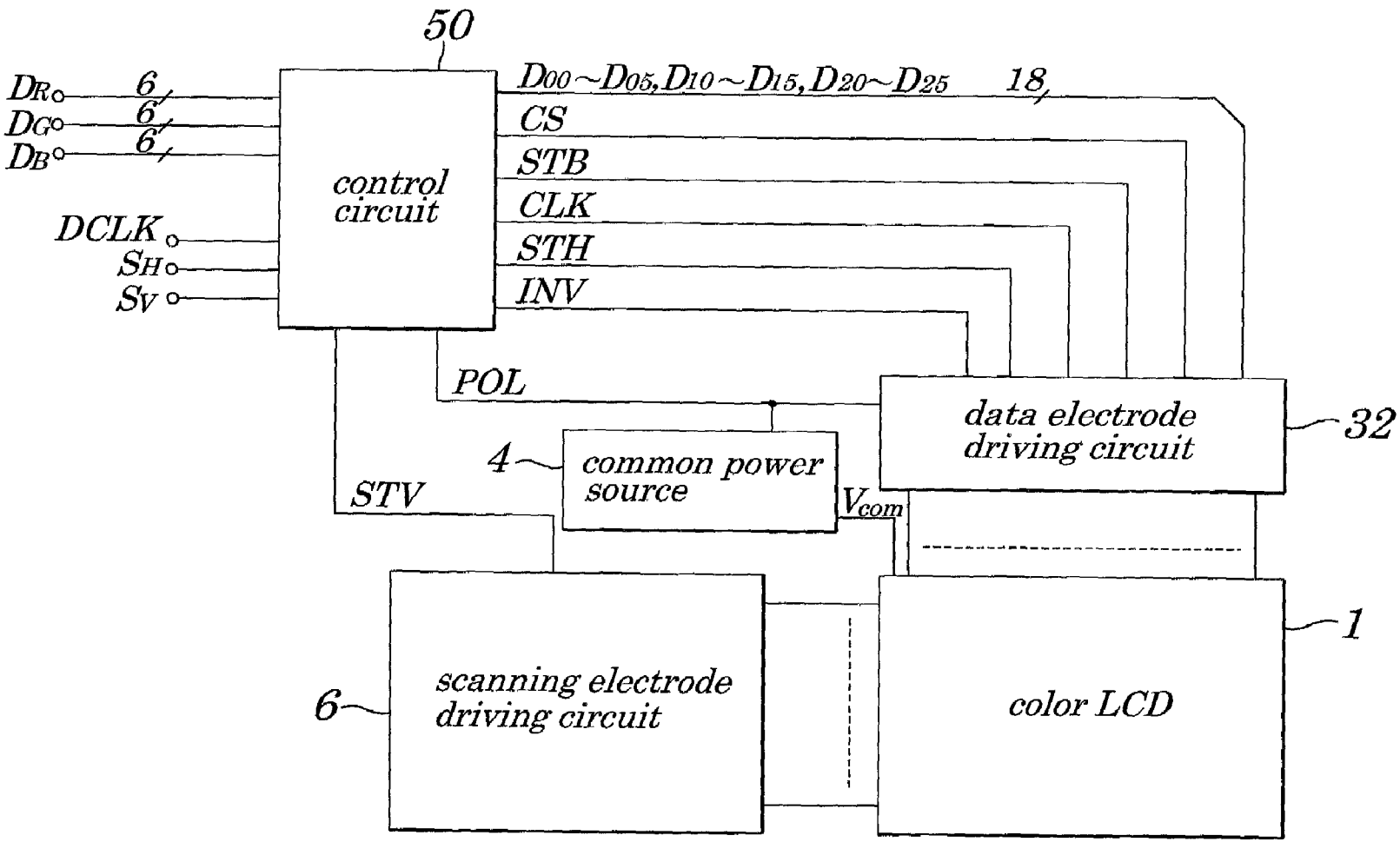
FIG. 1 is a schematic block diagram showing configurations of a driving circuit for a color LCD according to a first embodiment of the present invention.
Figure 20:
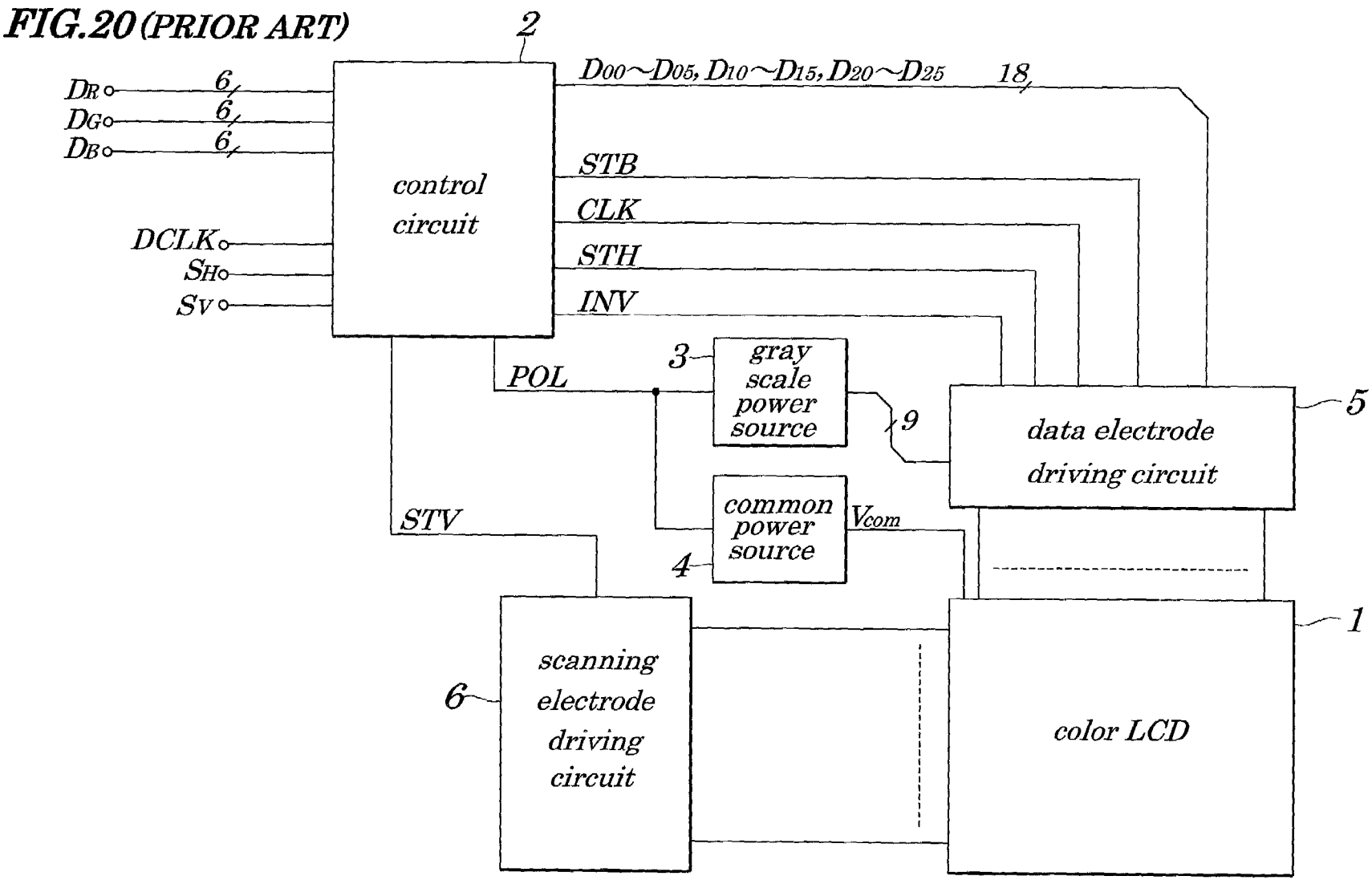
FIG. 20 (PRIOR ART)
FIG. 20 is a schematic block diagram showing configurations of a driving circuit for a conventional color LCD.
Figure 21:
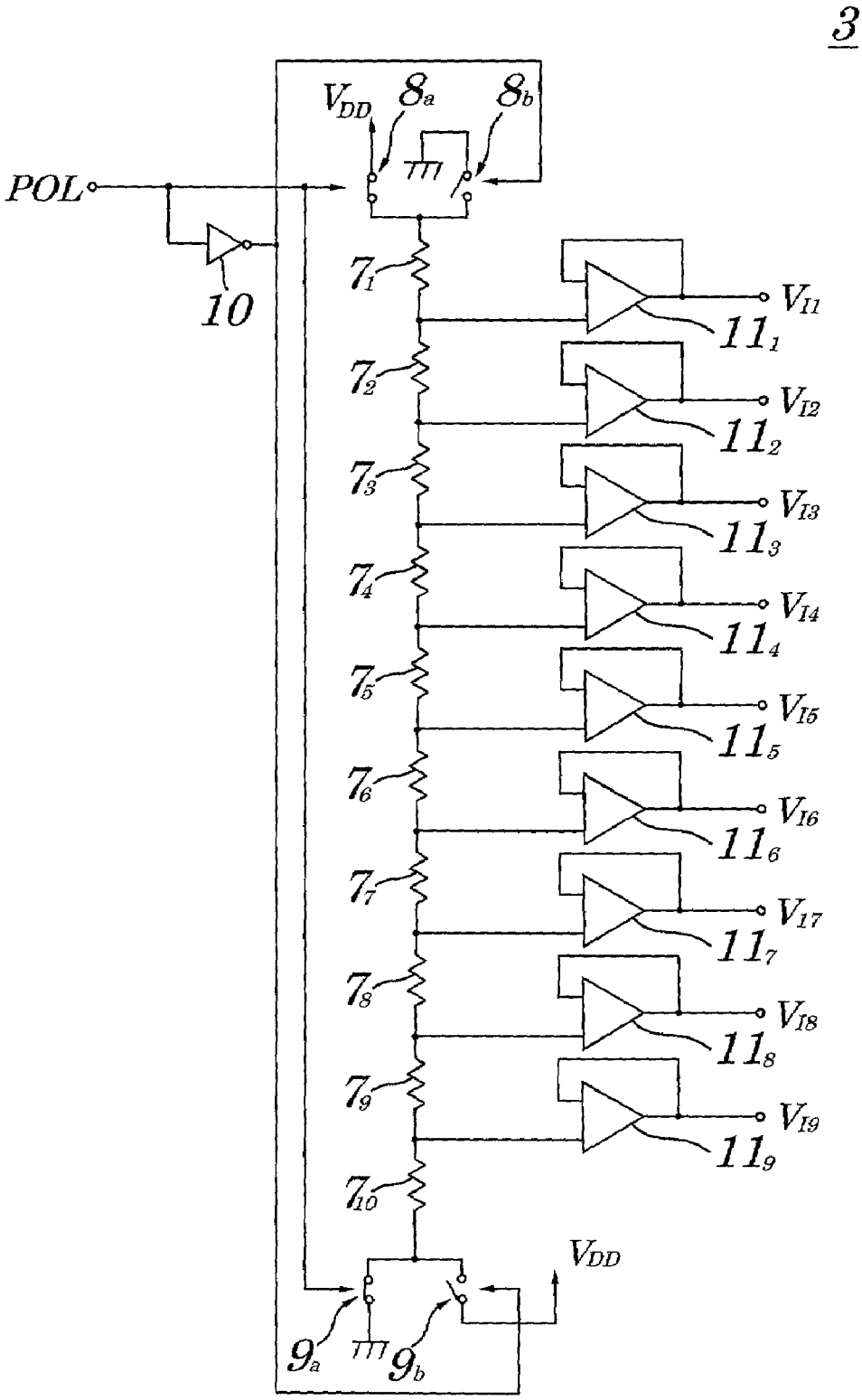
FIG.21 (PRIOR ART)
FIG. 21 is a circuit diagram showing configurations of a gray scale power source making up the driving circuit for the conventional color LCD.

FIG. 1 is a schematic block diagram for showing configurations of a driving circuit for a color LCD 1 according to a first embodiment of the present invention. In FIG. 1, same reference numbers are assigned to components having the same functions as those in the conventional example in FIG. 20 and their descriptions are omitted accordingly. In the driving circuit for the color LCD 1 shown in FIG. 1, instead of a control circuit 2 and a data electrode driving circuit 5 shown in FIG. 20, a control circuit 50 and a data electrode driving circuit 32 are newly placed and a gray scale power source 3 shown in FIG. 20 is removed. In the first embodiment, as in the case of the conventional example, it is presumed that the color LCD 1 provides 176×220 pixel resolution and, therefore, the number of dot pixels is 528×220.

The control circuit 50 is made up of, for example, ASICs and has, in addition to functions provided by the control circuit 2 in FIG. 20, functions of producing a chip select signal CS and feeding it to the data electrode driving circuit 32. The chip select signal CS goes low when the data electrode driving circuit 32 is in a standard mode and goes high when the data electrode driving circuit 32 is set so as to operate in a variation correcting mode. A standard mode and the variation correcting mode will be described in detail later.

Figure 2:
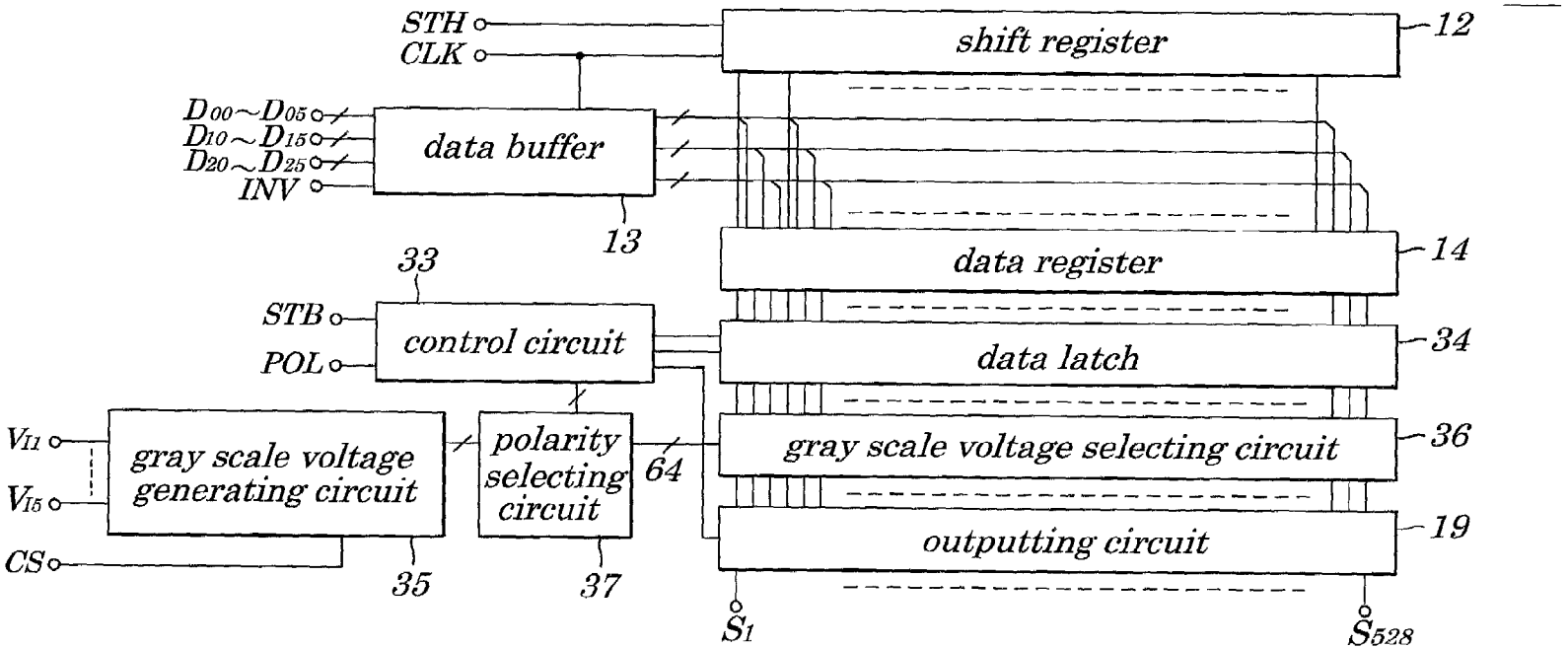
FIG. 2 is a schematic block diagram showing configurations of a data electrode driving circuit employed in the driving circuit for the color LCD according to the first embodiment of the present invention.
Figure 22:
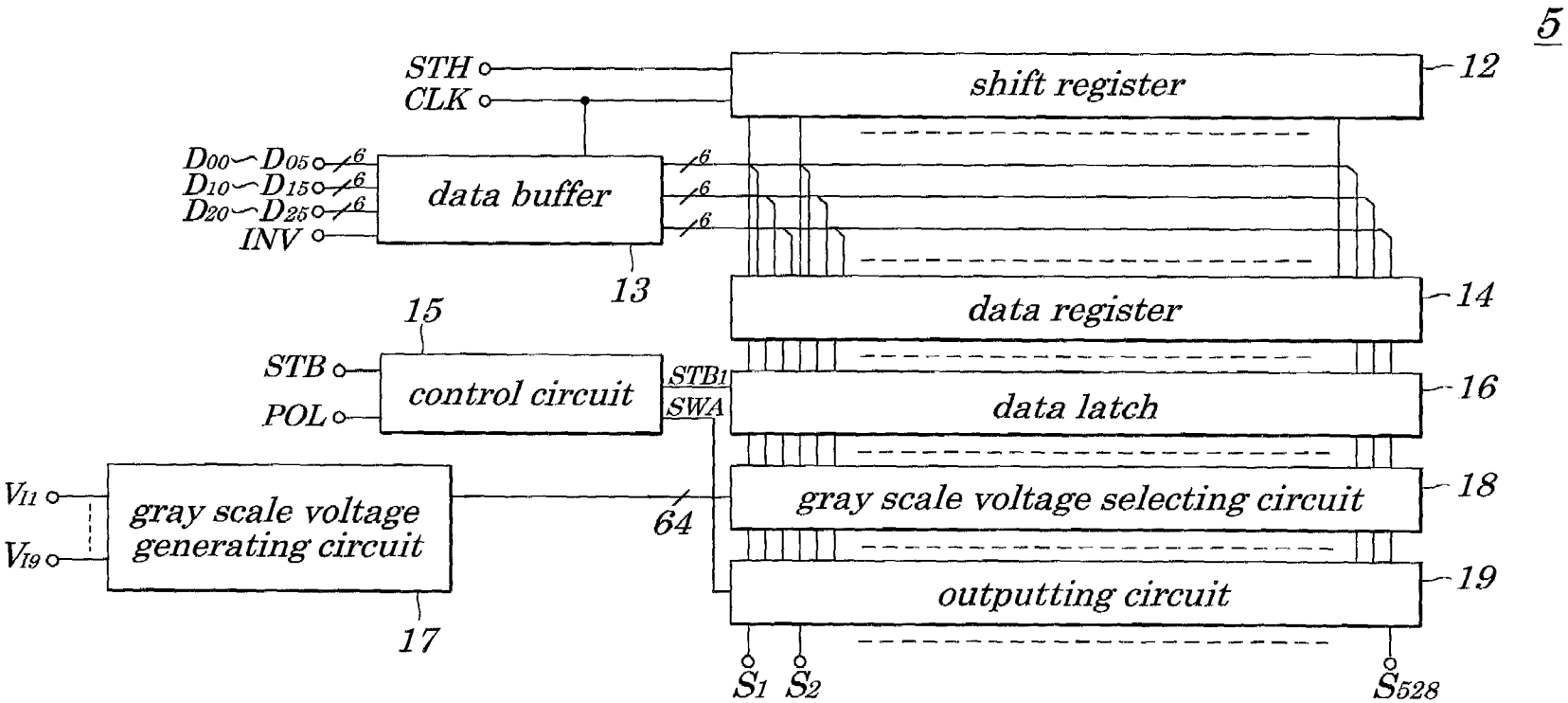
FIG.22(PRIOR ART)
FIG. 22 is a schematic block diagram showing an example of configurations of a data electrode driving circuit making up the driving circuit for the conventional color LCD.

FIG. 2 is a schematic block diagram for showing configurations of the data electrode driving circuit 32 employed in the driving circuit for the color LCD 1 according to the first embodiment of the present invention. In FIG. 2, same reference numbers are assigned to components having the same functions as those in the conventional example in FIG. 22. In the data electrode driving circuit 32 shown in FIG. 2, instead of a control circuit 15, data latch 16, gray scale voltage generating circuit 17, and gray scale voltage selecting circuit 18 shown in FIG. 22, a control circuit 33, a data latch 34, a gray scale voltage generating circuit 35, and a gray scale voltage selecting circuit 36 are newly placed, and a polarity selecting circuit 37 is added. The control circuit 33 produces, based on a strobe signal STB and a polarity signal POL both being fed from the control circuit 50, a strobe signal $STB_1$ being delayed by a fixed time behind the strobe signal STB, a polarity signal $POL_1$ being delayed by a fixed time behind the polarity signal POL, a switching control signal SWA being opposite in phase to the strobe signal $STB_1$, and switching change-over signals $S_{SWP}$ and $S_{SWN}$ used to control the polarity selecting circuit 37. The control circuit 33 feeds the strobe signal $STB_1$ and the polarity signal $POL_1$ to the data latch 34 and the switching control signal SWA to an outputting circuit 19 and the switching change-over signals $S_{SWP}$ and $S_{SWN}$ to the polarity selecting circuit 37.

Figure 3:
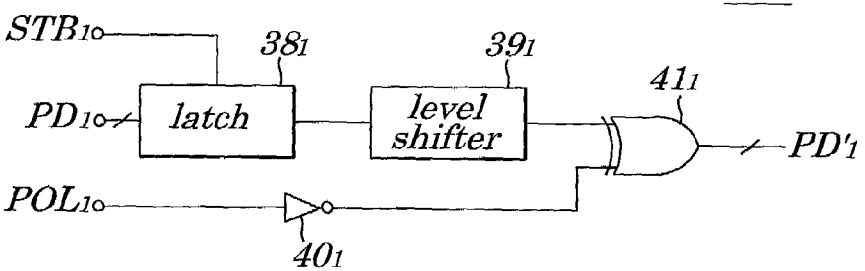
FIG. 3 is a circuit diagram showing configurations of part of a data latch making up the driving circuit for the color LCD according to the first embodiment of the present invention.

The data latch 34 captures, in synchronization with a rise of the strobe signal $STB_1$ being fed from the control circuit 33, display data $PD_1$ to $PD_{528}$ to be fed from a data register 14 and holds the captured display data $PD_1$ to $PD_{528}$ until the strobe signal $STB_1$ is fed next, that is, during one horizontal sync period. Next, the data latch 34, after having converted the held display data $PD_1$ to $PD_{528}$ so as to have a predetermined voltage, based on the polarity signal $POL_1$, feeds the display data $PD_1$ to $PD_{528}$ whose voltages have been converted to the predetermined level or the display data $PD_1$ to $PD_{528}$ which have been inverted after having been converted to the predetermined level, to the gray scale voltage selecting circuit 36 as the display data $PD_1'$ to $PD_{528}'$. FIG. 3 is a circuit diagram showing configurations of part of a data latch $\mathbf{34}_1$ making up the driving circuit for the color LCD 1 according to the first embodiment of the present invention. The data latch 34 is made up of 528 pieces of data latch sections $\mathbf{34}_1$ to $\mathbf{34}_{528}$. Configurations of each of the data latch sections $\mathbf{34}_1$ to $\mathbf{34}_{528}$ are the same, except that subscripts of its components differ from each other and subscripts of signals input and output from and to the data latch sections $\mathbf{34}_1$ to $\mathbf{34}_{528}$ differ from each other and therefore the configurations of only the data latch section $\mathbf{34}_1$ are described.

Figure 4:
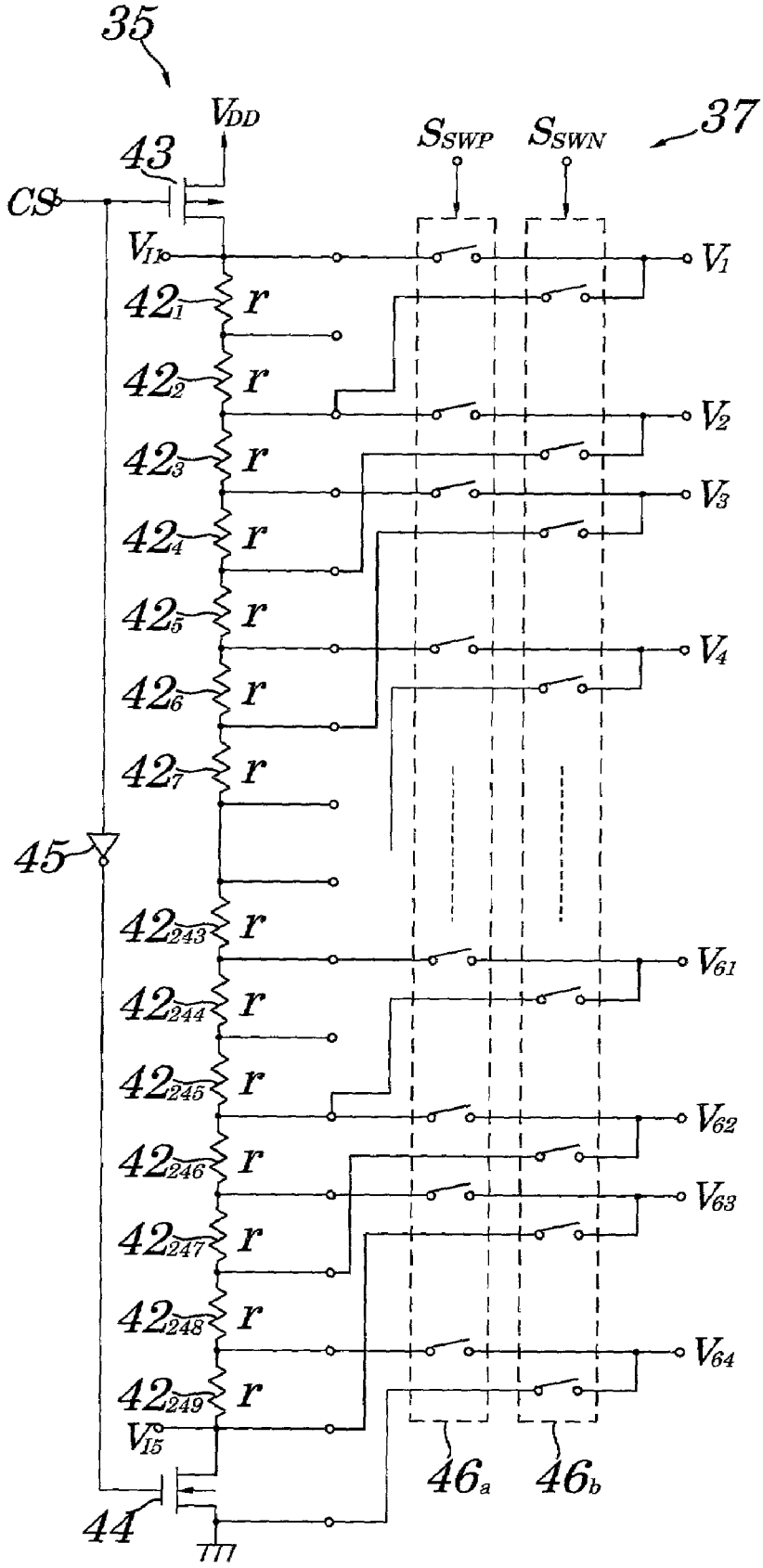
FIG. 4 is a circuit diagram showing configurations of a gray scale voltage generating circuit and a polarity selecting circuit making up the driving circuit for the color LCD according to the first embodiment of the present invention.

The data latch section $\mathbf{34}_1$, as shown in FIG. 3, is made up of a latch $\mathbf{38}_1$, a level shifter $\mathbf{39}_1$, an inverter $\mathbf{40}_1$ and an exclusive OR gate $\mathbf{41}_1$. The latch $\mathbf{38}_1$, in synchronization with a rise of the strobe signal $STB_1$, simultaneously captures 6 bits of parallel display data $PD_1$ and holds the captured display data $PD_1$ until the strobe signal $STB_1$ is fed next. The level shifter $\mathbf{39}_1$ converts a voltage of 6 bits of parallel data output from the latch $38_1$ from 3 V to 5 V. The inverter $40_1$ inverts the polarity signal $POL_1$. The exclusive OR gate $41_1$, when the polarity signal $POL_1$ is at a high level, that is, when an output signal from the inverter $40_1$ is at a low level, outputs 6 bits of parallel data from the level shifter $39_1$, without the parallel data being inverted, as a display data $PD'_1$ of positive polarity and, when the polarity signal $POL_1$ is at a low level, that is, an output signal from the inverter $40_1$ is at a high level, inverts 6 bits of parallel data output from the level shifter $39_1$ and outputs the inverted data as the display data $PD'_1$ of negative polarity. Thus, by outputting the display data $PD_1$ to $PD_{528}$ with or without the display data $PD_1$ to $PD_{528}$ being inverted, in response to the polarity signal POL, unlike in the conventional case, switching of the polarity of gray scale voltages $V_1$ to $V_{64}$ depending on the polarity signal POL is not required. Therefore, in the gray scale voltage generating circuit 35, as shown in FIG. 4, the polarity of the gray scale voltages $V_1$ to $V_{64}$ remains fixed. Moreover, the following are the reason why the level shifter $39_1$ is placed. That is, the data electrode driving circuit 32, in order to reduce power consumption and to make the chip small in size, controls supply voltage to be applied to shift register 12, a data buffer 13, the data register 14, the control circuit 33, and the data latch 34 so as to remain at 3 V. On the other hand, since the color LCD 1 generally operates at a voltage of 5 V, the gray scale voltage selecting circuit 36 and outputting circuit 19 are set so as to operate at a voltage range between 0 V to 5V. Therefore, if the voltage of the output data from the latch $38_1$ remains at 3 V, the gray scale selecting circuit 36 and the outputting circuit 19 cannot be driven. Thus, by placing the level shifter $39_1$ therein, the voltage of the output data from the latch $38_1$ is converted from 3 V to 5 V.

The gray scale voltage generating circuit 35 shown in FIG. 2, as shown in FIG. 4, includes, for example, 249 pieces of resistors $42_1$ to $42_{249}$, P-channel MOS transistor 43, N-channel MOS transistor 44, and inverter 45. Each of the resistors $42_1$ to $42_{249}$ has a same resistance value "r" all of which are cascade-connected. A source of the P-channel MOS transistor 43 is supplied with a supply voltage $V_{DD}$, its gate is supplied with the chip select signal CS being fed from the control circuit 50 and its drain is connected to one terminal of the resistor $42_1$. A drain of the N-channel MOS transistor 44 is connected to one terminal of the resistor $42_{249}$, its gate is supplied with an output from the inverter 45 and its source is connected to a ground. The chip select signal CS is fed to the inverter 45. As described above, in the gray scale voltage generating circuit 35 of the first embodiment, the case of the applied voltage being of positive polarity and the case of the applied voltage being of negative polarity differ from each other in the applied voltage—transmittance characteristic of the liquid crystal cell, and therefore 251 pieces of divided voltages are output to cause the polarity selecting circuit 37 to output gray scale voltages $V_1$ to $V_{64}$ of positive polarity and gray scale voltage $V_1$ to $V_{64}$ of negative polarity. Moreover, the gray scale voltage generating circuit 35 of the embodiment operates in two modes, one being a standard mode in which, unlike the conventional case, divided voltages are output as gray scale voltages of positive polarity $V_1$ to $V_{64}$ and as gray scale voltages of negative polarity $V_1$ to $V_{64}$ only within the data electrode driving circuit 32 without supply of the gray scale voltage from a gray scale power source being placed outside and another being a variation correcting mode in which, like in the conventional case, divided voltages are output as gray scale voltages of positive polarity $V_1$ to $V_{64}$ and as gray scale voltages of negative polarity $V_1$ to $V_{64}$ with supply of five pieces of gray scale voltages $V_1$ to $V_{15}$ from the gray scale power source being placed outside.

In the case of the standard mode, by supply of the chip select signal CS at a low level from the control circuit 50, both the P-channel MOS transistor 43 and the N-channel MOS transistor 44 are turned ON. This causes the supply voltage $V_{DD}$ to be applied to one terminal of the resistors $42_1$ to $42_{249}$ being cascade-connected and another terminal of the resistors $42_1$ to $42_{249}$ to be connected to the ground and, as a result, 251 pieces of divided voltages obtained by dividing a voltage between the supply voltage $V_{DD}$ and a ground voltage using the resistors $42_1$ to $42_{249}$ to be output. Therefore, at a time when the applied voltage—transmittance characteristic of the color LCD 1 is made apparent, setting may be made as to which voltage out of 251 pieces of divided voltages should be taken out as the gray scale voltages $V_1$ to $V_{64}$ to provide a voltage of positive polarity and as the gray scale voltages $V_1$ to $V_{64}$ to provide a voltage of negative polarity, so that the applied voltage—transmittance characteristic is matched.

On the other hand, in the case of a variation correcting mode, the chip select signal CS at a high level is fed from the control circuit 50 and both the P-channel MOS transistor 43 and the P-channel MOS transistor 44 are turned OFF and, at the same time, 5 pieces of gray scale voltages $V_{I1}$ to $V_{15}$ are fed from the gray scale power source being placed outside. As a result, the gray scale voltage $V_{I1}$ is applied to one terminal of the resistor $42_1$, the gray scale voltage $V_{I2}$ is applied to a connection point between the resistor $42_{63}$ and resistor $42_{64}$, the gray scale voltage $V_{I3}$ is applied to a connection point between the resistor $V_{I25}$ and resistor $42_{I26}$, the gray scale voltage $V_{I4}$ is applied to a connection point between the resistor $42_{187}$ and resistor $42_{188}$ and the gray scale voltage $V_{I5}$ is applied to one terminal of the resistor $42_{249}$. Therefore, 251 pieces of voltages obtained by dividing five pieces of the gray scale voltages $V_{I1}$ to $V_{I5}$ based on resistance ratios of the resistors $42_1$ to $42_{249}$ are output. That is, in the variation correcting mode, one case is presumed where, 251 pieces of divided voltages set in the above standard mode cannot match sufficiently each of the applied voltage—transmittance characteristics in the color LCD 1 due to great variations in each of the applied voltage—transmittance characteristics depending on the color LCD 1. In contrast, in the variation correcting mode, despite the above limitation, divided voltages can be output which are used to set the gray scale voltages $V_1$ to $V_{64}$ to provide a voltage of positive polarity and the gray scale voltages $V_1$ to $V_{64}$ to provide a voltage of negative polarity that can match each of the applied voltage—transmittance characteristics in the color LCD 1. Even when the gray scale power source is placed outside, since the fed gray scale voltages $V_{I1}$ to $V_{I5}$ are divided into 250 pieces of voltages within the gray scale voltage generating circuit 35, unlike the conventional case, the gray scale voltages $V_{I1}$ to $V_{I9}$ being as many as nine pieces are not required. Five pieces at the maximum and three pieces at the minimum of gray scale voltages $V_1$ to $V_{13}$ produced in the gray scale power source being placed outside can sufficiently match each of the applied voltage—transmittance characteristics of the color LCD 1. Therefore, even when the gray scale power source is placed, together with the control circuit 50, on the printed board, packaging areas can be reduced more compared with the conventional case. Moreover, if the data electrode driving circuit 32 having the gray scale voltage generating circuit 35 is constructed of integrated circuits (ICs), a mask to form the resistors $42_1$ to $42_{249}$ can be used commonly. Therefore, at the time when the applied voltage—transmittance characteristic is made apparent, which voltage occurring between resistors $42_1$ to $42_{249}$ can be taken out as the gray scale voltage can be determined by connecting wirings. Moreover, there is an advantage in that each of the resistors $42_1$ to $42_{249}$ can be incorporated and formed in an aluminum wiring layer above the IC layer by using aluminum as a material for the resistor.

The polarity selecting circuit 37 shown in FIG. 2 is made up of a switch group 46*a* and a switch group $46_b$ and outputs either the gray scale voltages $V_1$ to $V_{64}$ to provide a voltage of positive polarity or the gray scale voltages $V_1$ to $V_{64}$ to provide a voltage of negative polarity by switching them in every one line, in response to switching change-over signals $S_{SWP}$ and $S_{SWN}$. The switch group $46_a$ is made up of 64 pieces of switches. One terminal of each of switches making up the switch group $46_a$ is connected in advance to a connection point of each corresponding resistor of the resistors $42_1$ to $42_{249}$ being cascade-connected based on the applied voltage of positive polarity—transmittance characteristic of the color LCD 1. Each of the switches making up the switch group $46_a$ is turned ON, all at once, when the switching change-over signal $S_{SWP}$ being supplied from the control circuit 33 is at a high level and 64 pieces of voltages occurring between connection points of each corresponding resistor of resistors $42_1$ to $42_{249}$ are output as the gray scale voltages $V_1$ to $V_{64}$ to provide a voltage of positive polarity.

The switch group $46_b$ is made up of 64 pieces of switches. One terminal of each of switches making up the switch group $46_b$ is connected in advance to a connection point of each of a corresponding resistor of the resistors $42_1$ to $42_{249}$ being cascade-connected based on the applied voltage of negative polarity—transmittance characteristic of the color LCD 1. Each of the switches making up the switch group $46_b$ is turned ON, all at once, when the switching change-over signal $S_{SWN}$ being supplied from the control circuit 33 is at a high level and 64 pieces of voltages occurring between connection points of each corresponding resistor of resistors $42_1$ to $42_{249}$ are output as the gray scale voltages $V_1$ to $V_{64}$ to provide a voltage of negative polarity.

Figure 5:
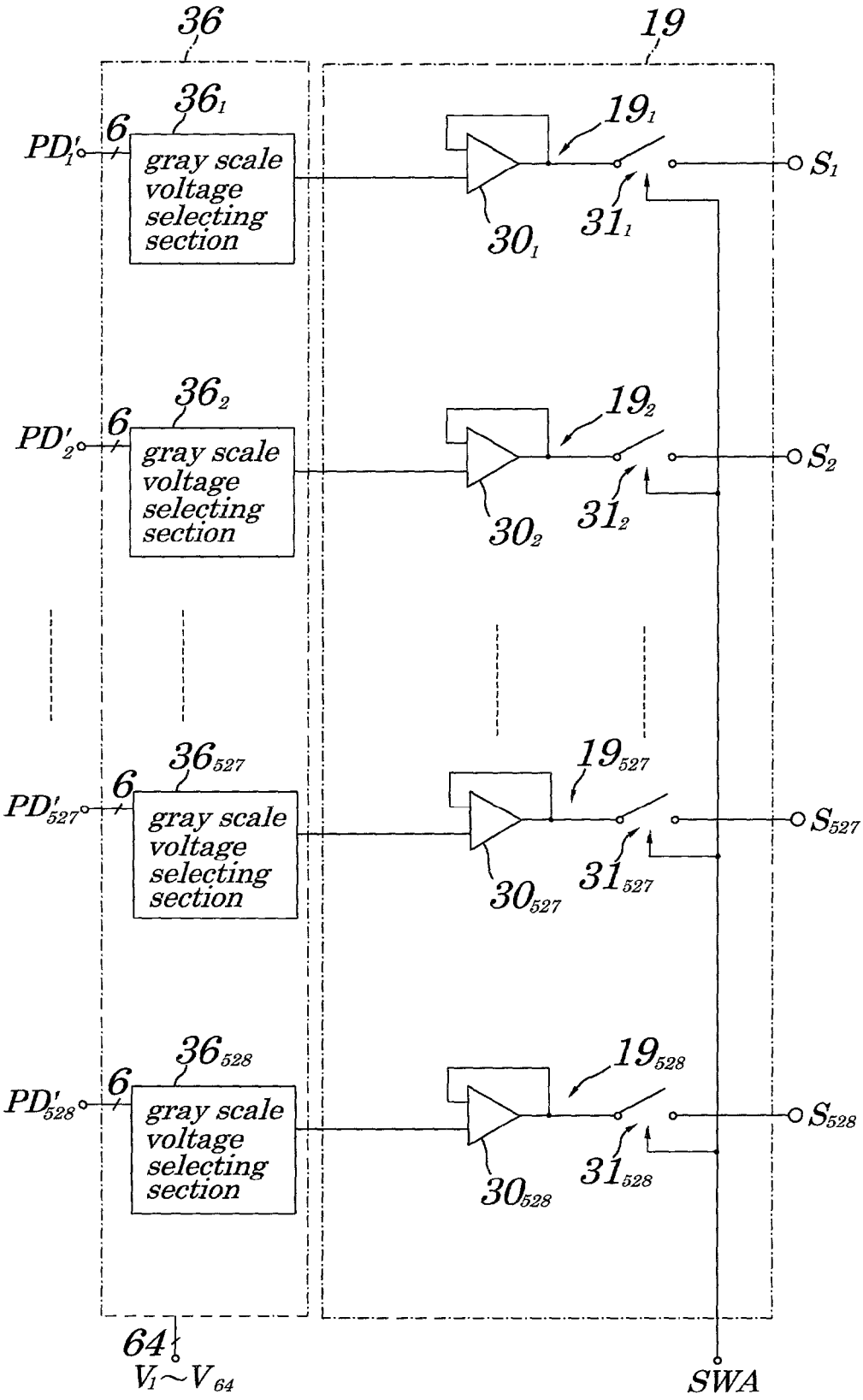
FIG. 5 is a circuit diagram showing configurations of a gray scale voltage selecting circuit and an outputting circuit making up the driving circuit for the color LCD according to the first embodiment of the present invention.
Figure 6:
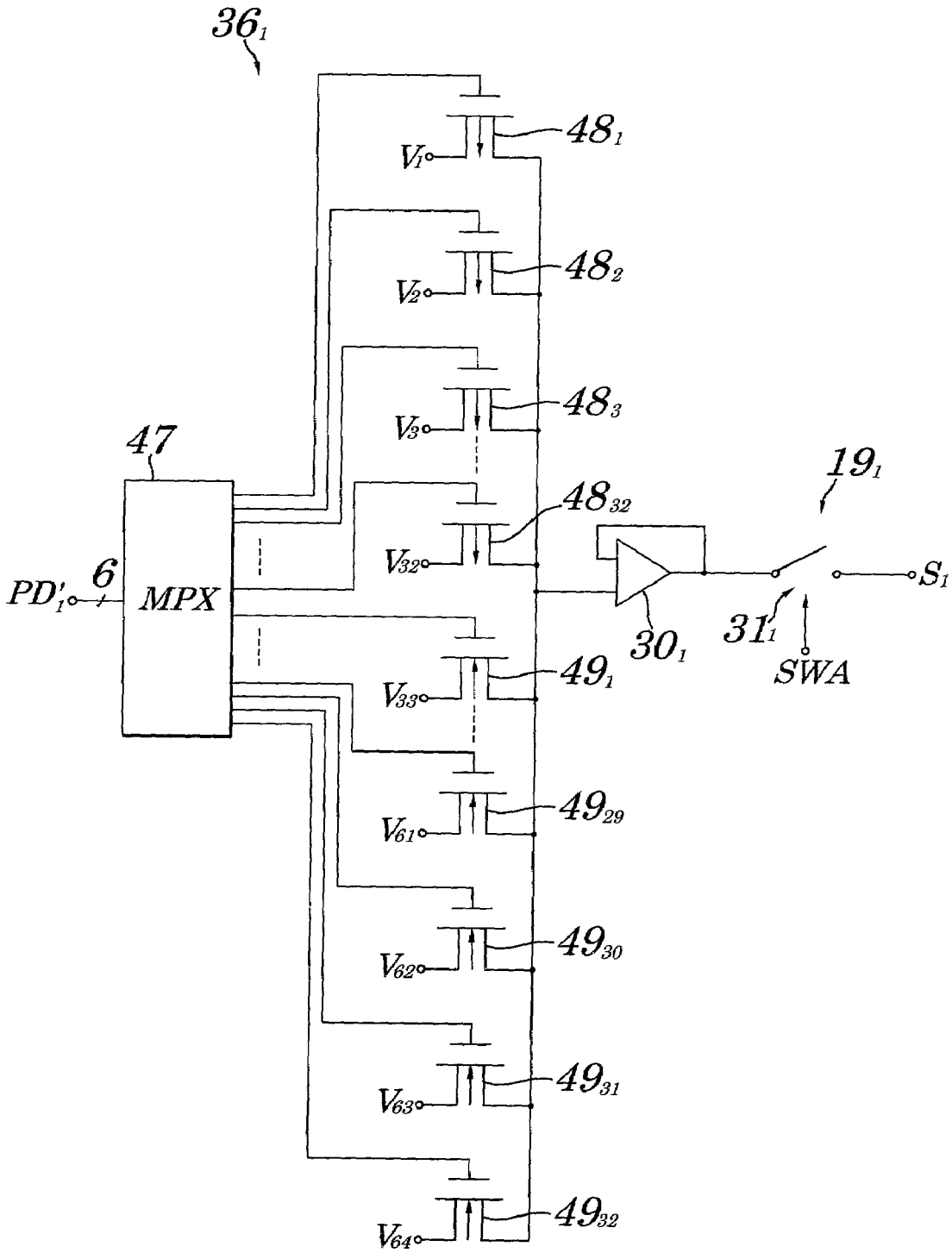
FIG. 6 is a circuit diagram showing configurations of part of the gray scale voltage selecting circuit and of part of the outputting circuit making up the driving circuit for the color LCD according to the first embodiment of the present invention.

The gray scale voltage selecting circuit 36 shown in FIG. 2, as shown in FIG. 5, is made up of gray scale voltage selecting sections $36_1$ to $36_{528}$ and gray scale voltages $V_1$ to $V_{64}$ to provide a voltage of positive polarity or of negative polarity to be fed from the polarity selecting circuit 37 are supplied in parallel to each of the gray scale voltage selecting sections $36_1$ to $36_{528}$. Each of the gray scale voltage selecting sections $36_1$ to $36_{528}$, based on 6 bits of corresponding digital display data $PD'_1$ to $PD'_{528}$, selects one gray scale voltage out of 64 pieces of gray scale voltages $V_1$ to $V_{64}$ to provide a voltage of positive polarity or negative polarity and feeds the selected gray scale voltage to corresponding amplifiers in the outputting circuit 19. Since configurations of each of the gray scale voltage selecting sections $36_1$ to $36_{528}$ are the same and description of only the gray scale voltage selecting sections $36_1$ is provided accordingly. The gray scale voltage selecting sections $36_1$, as shown in FIG. 6, is made up of a MPX 47, P-channel MOS transistors $48_1$ to $48_{32}$, and N-channel MOS transistors $49_1$ to $49_{32}$. The MPX 47, based on values of 6 bits of corresponding digital display data $PD'_1$, turns ON any one of 64 pieces of the P-channel MOS transistors $48_1$ to $48_{32}$ and the N-channel MOS transistors $49_1$ to $49_{32}$. Each of the P-channel MOS transistors $48_1$ to $48_{32}$ to the N-channel MOS transistors $49_1$ to $49_{32}$ is turned ON by the MPX 47 and outputs corresponding gray scale voltage as data red signal, data green signal, or data blue signal. The number of 32 pieces of the P-channel MOS transistors $48_1$ to $48_{32}$ and of 32 pieces of the N-channel MOS transistors $49_1$ to $49_{32}$ may be increased or decreased depending on characteristics of each transistor, for example, the number of one kinds of the P-channel MOS transistors $48_1$ to $48_{32}$ or the N-channel MOS transistors $49_1$ to $49_{32}$ may be increased as appropriate and the number of another kind of the P-channel MOS transistors $48_1$ to $48_{32}$ or the N-channel MOS transistors $49_1$ to $49_{32}$ which corresponds to the increased number of the P-channel MOS transistors $48_1$ to $48_{32}$ or the N-channel MOS transistors $49_1$ to $49_{32}$ may be decreased. The outputting circuit 19 is made up of 528 pieces of outputting sections $19_1$ to $19_{528}$. Each of the outputting sections $19_1$ to $19_{528}$ is made up of each of amplifiers $30_1$ to $30_{528}$, and each of switches $31_1$ to $31_{528}$ placed at a rear stage of each of the amplifiers $30_1$ to $30_{528}$. The outputting circuit 19, after having amplified the corresponding data red signal, data green signal, and data blue signal fed from the gray scale voltage selecting circuit 36, feeds the amplified signal to the corresponding data electrode in the color LCD 1 through the switches $31_1$ to $31_{528}$ that have been turned ON in response to the switching control signal SWA fed from the control circuit 33. In FIG. 6, the amplifier $30_1$ placed to output the data red signal $S_1$ corresponding to the digital display data $PD'_1$ and the switch $31_1$ are shown.

Next, operations of the control circuit 50, a common power source 4, and the data electrode driving circuit 32, out of operations of the driving circuit for the color LCD 1 having configurations described above will be explained by referring to a timing chart shown in FIG. 7. Here, let it be assumed that the chip select signal CS at a low level is being supplied all the time to the data electrode driving circuit 32 from the control circuit 50 and the data electrode driving circuit 32 operates in the standard mode.

Figure 7:
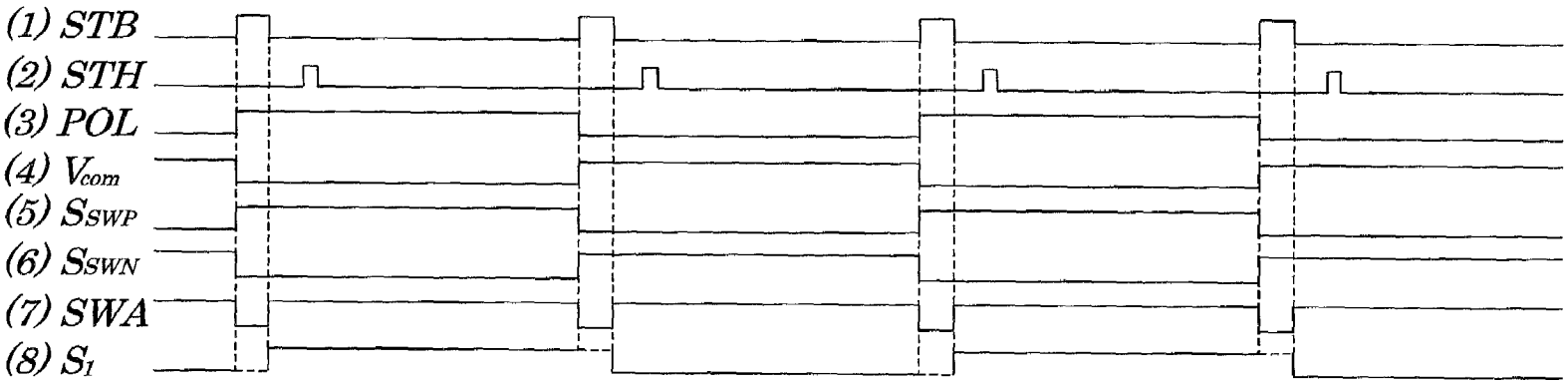
FIG. 7 is a timing chart showing one example of operations of the driving circuit for the color LCD according to the first embodiment of the present invention.

First, the control circuit 50 feeds a clock CLK (not shown), a strobe signal STB shown by (1) in FIG. 7, a horizontal start pulse STH being delayed by several pulses of the clock CLK behind the strobe signal STB shown by (2) in FIG. 7, a polarity signal POL shown by (3) in FIG. 7, to the data electrode driving circuit 32. As a result, the shift register 12 in the data electrode driving circuit 32 performs shifting operations to shift the horizontal start pulse STH, in synchronization with the clock CLK, and, at the same time, outputs 176 bits of parallel sampling pulses $SP_1$ to $SP_{176}$. At almost the same time, the control circuit 50 converts 6 bits of the red data $D_R$, 6 bits of the green data $D_G$, and 6 bits of the blue data $D_B$, all of which are fed from an outside, to 18 bits of display data $D_{00}$ to $D_{05}$, $D_{10}$ to $D_{15}$, and $D_{20}$ to $D_{25}$ and feeds the converted display data to the data electrode driving circuit 32 (not shown). Then, the 18 bits of the display data $D_{00}$ to $D_{05}$, $D_{10}$ to $D_{15}$, and $D_{20}$ to $D_{25}$, after having been held by the data buffer 13 in the data electrode driving circuit 32 for one pulse of a clock $CLK_1$, in synchronization with the clock $CLK_1$ being delayed by a predetermined period of time behind the clock CLK, are fed to the data register 14 as display data $D'_{00}$ to $D'_{05}$, $D'_{10}$ to $D'_{15}$, and $D'_{20}$ to $D'_{25}$. Therefore, the display data $D'_{00}$ to $D'_{05}$, $D'_{10}$ to $D'_{15}$, and $D'_{20}$ to $D'_{25}$, after having been sequentially captured by the data register 14 as the display data $PD_1$ to $PD_{528}$ in synchronization with sampling pulses $SP_1$ to $SP_{17}$, fed from the shift register 12, are captured all at once by the data latch 34 in synchronization with a rise of a strobe signal $STB_1$ and held by each of latches $38_1$ to $38_{528}$ (in FIG. 3, only the latch $38_1$ is shown) for one horizontal sync period.

The display data $PD_1$ to $PD_{528}$ that have been held for one horizontal sync period by each of the latches $38_1$ to $38_{528}$ making up the data latch 34, after a voltage of each of the display data $PD_1$ to $PD_{528}$ has been converted from 3 V to 5 V, when the polarity signal POL is at a high level shown by (3) in FIG. 7, are output, without being inverted, as the display data $PD'_1$ to $PD'_{528}$ of positive polarity and, when the polarity signal POL is at a low level, are inverted by the exclusive OR gates $\mathbf{41}_1$ to $\mathbf{41}_{528}$ and are output as the display data $PD'_1$ to $PD'_{528}$ of negative polarity.

On the other hand, in the gray scale voltage generating circuit 35 shown in FIG. 4, as described above, since the chip select signal CS at a low level is fed from the control circuit 50 and the gray scale voltage generating circuit 35 operates in the standard mode, both the P-channel MOS transistor 43 and the N-channel MOS transistor 44 are ON. This causes the supply voltage $V_{DD}$ to be applied to one terminal of the resistors $\mathbf{42}_1$ to $\mathbf{42}_{249}$ being cascade-connected and 251 pieces of the voltage obtained by dividing a voltage between the supply voltage $V_{DD}$ and the ground by using the resistors $\mathbf{42}_1$ to $\mathbf{42}_{249}$ to be output. Moreover, when the polarity signal POL is at a high level, the high-level switching change-over signal $S_{SWP}$ and the low-level switching change-over signal $S_{SWN}$ are fed from the control circuit 33 with the timing shown by (5) in FIG. 7 and with the timing shown by (6) in FIG. 7 respectively to the polarity selecting circuit 37. Therefore, in the polarity selecting circuit 37 in FIG. 4, in response to the above switching change-over signals $S_{SWP}$ and $S_{SWN}$, the switches making up the switch group $\mathbf{46}_a$ are turned ON all at once and the switches making up the switch group $\mathbf{46}_b$ are turned OFF all at once. This causes 64 pieces of voltages having occurred at a corresponding connection point among resistors $\mathbf{42}_1$ to $\mathbf{42}_{249}$ to be output as the gray scale voltages $V_1$ to $V_{64}$ to provide a voltage of positive polarity and are fed to the gray scale voltage selecting circuit 36. Therefore, in each of the gray scale voltage selecting sections $\mathbf{36}_1$ to $\mathbf{36}_{528}$ in the gray scale voltage selecting circuit 36, the MPX 47 turns ON any one of 64 pieces of the P-channel MOS transistors $\mathbf{48}_1$ to $\mathbf{48}_{32}$ and the N-channel MOS transistors $\mathbf{49}_1$ to $\mathbf{49}_{32}$ based on 6 bits of corresponding display data $PD'_1$ to $PD'_{528}$. This causes the corresponding gray scale voltage to provide a voltage of positive polarity to be output as the data red signal, data green signal, and data blue signal from the MOS transistor having been turned ON. The data red signal, data green signal, and data blue signal are amplified by the corresponding amplifiers $\mathbf{30}_1$ to $\mathbf{30}_{528}$ in the outputting circuit 19. Next, the data output from the amplifiers $\mathbf{30}_1$ to $\mathbf{30}_{528}$ are fed through switches $\mathbf{31}_1$ to $\mathbf{31}_{528}$ having been turned ON in response to the switching control signal SWA (refer to (7) in FIG. 7) which rises with the timing when the strobe signal STB shown by (1) in FIG. 7 falls, to the corresponding data electrode in the color LCD 1 as the data red signal, data green signal, and data blue signal $S_1$ to $S_{528}$. A waveform of the data red signal $S_1$ provided when a value of the display data $PD_1$ is "000000" is shown by (8) in FIG. 7. In this case, the value "000000" of the display $PD_1$ is output from the data latch section $\mathbf{34}_1$ shown in FIG. 3, as it is, as the value for the display data $PD'_1$. Therefore, in the gray scale voltage selecting section $\mathbf{36}_1$, the MPX 47 turns ON the P-channel MOS transistor $\mathbf{48}_1$ based on the value "000000" of the corresponding display data $PD'_1$ to cause the gray scale voltage $V_1$ to provide a voltage of positive polarity being the nearest to the supply voltage $V_{DD}$ to be output as the data red signal $S_1$. Referring to (8) in FIG. 7, the reason why part of the data red signal $S_1$ is shown by the dotted lines when the strobe signal STB is at a high level, is that, since the switch $\mathbf{31}_1$ is turned OFF, the voltage to be applied in response to the data red signal $S_1$ to be output from the outputting section $\mathbf{19}_1$ to the corresponding data electrode in the color LCD 1 is put into a stage of high impedance. On the other hand, the common power source 4, based on the high-level polarity signal POL, makes the common potential Vcom be at a ground level and then feeds it to the common electrode in the color LCD 1, as shown by (4) in FIG. 7. Therefore, a black color is displayed in a corresponding pixel in the color LCD 1 which is of normally white type.

On the other hand, the display data $PD_1$ to $PD_{528}$ that have been held during one horizontal sync period by each of the latches $\mathbf{38}_1$ to $\mathbf{38}_{528}$ making up the data latch 34, after a voltage of each of the display data $PD_1$ to $PD_{528}$ has been converted from 3 V to 5 V, when the polarity signal POL is at a high level shown by (3) in FIG. 7, are inverted by the exclusive OR gates $\mathbf{41}_1$ to $\mathbf{41}_{528}$ and then output as the display data $PD'_1$ of negative polarity.

Moreover, since the gray scale voltage generating circuit 35 is set so as to operate in the standard mode, both the P-channel MOS transistor 43 and the N-channel MOS transistor 44 are ON. This causes the supply voltage $V_{DD}$ to be applied to one terminal of the resistors $\mathbf{42}_1$ to $\mathbf{42}_{249}$ being cascade-connected and 251 pieces of the voltage obtained by dividing a voltage between the supply voltage $V_{DD}$ and the ground by using the resistors $\mathbf{42}_1$ to $\mathbf{42}_{249}$ to be output. Moreover, when the polarity signal POL shown by (3) in FIG. 3 is at a low level, the low-level switching change-over signal $S_{SWP}$ and the high-level switching change-over signal $S_{SWN}$ are fed from the control circuit 33 with the timing shown by (5) in FIG. 7 and with the timing shown by (6) in FIG. 7, respectively, to the polarity selecting circuit 37. Therefore, in the polarity selecting circuit 37 in FIG. 4, in response to the above switching change-over signals $S_{SWP}$ and $S_{SWN}$, the switches making up the switch group $\mathbf{46}_a$ are turned OFF all at once and the switches making up the switch group $\mathbf{46}_b$ are turned ON all at once. This causes 64 pieces of voltages having occurred at a corresponding connection point among resistors $\mathbf{42}_1$ to $\mathbf{42}_{249}$ to be output as the gray scale voltages $V_1$ to $V_{64}$ to provide a voltage of negative polarity and are fed to the gray scale voltage selecting circuit 36.

Therefore, in each of the gray scale voltage selecting sections $\mathbf{36}_1$ to $\mathbf{36}_{528}$ in the gray scale voltage selecting circuit 36, the MPX 47 turns ON any one of the 64 pieces of the P-channel MOS transistors $\mathbf{48}_1$ to $\mathbf{48}_{32}$ and the N-channel MOS transistors $\mathbf{49}_1$ to $\mathbf{49}_{32}$, based on values of the corresponding 6 bits of the inverted display data $PD'_1$ to $PD'_{528}$. This causes the corresponding gray scale voltage to provide a voltage of negative polarity to be output as the data red signal, data green signal, and data blue signal from the MOS transistor having been turned ON. The data red signal $S_1$, data green signal, and data blue signal are amplified by the corresponding amplifiers $\mathbf{30}_1$ to $\mathbf{30}_{528}$ in the outputting circuit 19. Next, the data output from the amplifiers $\mathbf{30}_1$ to $\mathbf{30}_{528}$ are fed through switches $\mathbf{31}_1$ to $\mathbf{31}_{528}$ having been turned ON in response to the switching control signal SWA (refer to (7) in FIG. 7) which rises with the timing when the strobe signal STB shown by (1) in FIG. 7 falls, to the corresponding data electrode in the color LCD 1 as the data red signal, data green signal, and data blue signal $S_1$ to $S_{528}$. A waveform of the data red signal $S_1$ provided when a value of the display data $PD_1$ is "000000" is shown by (8) in FIG. 7. In this case, in the data latch section $\mathbf{34}_1$ shown in FIG. 3, the value "000000" of the display data $PD_1$ is inverted and is output as the display data $PD'_1$ having the value "111111". Therefore, in the gray scale voltage selecting section $\mathbf{36}_1$, the MPX 47 turns ON the P-channel MOS transistor $\mathbf{49}_{32}$ based on the value "111111" of the corresponding display data $PD'_1$ to cause the gray scale voltage $V_1$ to provide a voltage of negative polarity being the nearest to the ground level to be output as the data red signal $S_1$. On the other hand, the common power source 4, based on the low-level polarity signal POL, makes the common potential Vcom be at a level of the supply voltage ($V_{DD}$) and then feeds it to the common electrode in the color LCD 1, as shown by (4) in FIG. 7. Therefore, a black color is displayed in a corresponding pixel in the color LCD 1 which is of normally white type. Moreover, if there is a risk that irregular gray scale voltages $V_1$ to $V_{64}$ are output due to simultaneous ON/OFF of the switch group $\mathbf{46}_a$ and the switch $\mathbf{46}_b$ making up the polarity selecting circuit 37, the timing of a rise and fall of the switching change-over signal $S_{SWP}$ shown by (5) in FIG. 7 may be shifted form a rise and fall of the switching change-over signal $S_{SWN}$ shown by (6) in FIG. 7.

Thus, according to the embodiment, instead of switching the polarity of the gray scale voltages $V_1$ to $V_{64}$ in every one line depending on the polarity signal POL as is in the conventional case, the display data $PD'_1$ to $PD'_{528}$ are output, with or without the display data being inverted, depending on the polarity signal POL. Therefore, unlike the conventional case, construction of the gray scale voltage selecting sections $\mathbf{36}_1$ to $\mathbf{36}_{528}$ using the transfer gates is not required and, as shown in FIG. 6, a high-voltage side of the gray scale voltage selecting sections $\mathbf{36}_1$ to $\mathbf{36}_{528}$ may be configured using P-channel MOS transistors $\mathbf{48}_1$ to $\mathbf{48}_{32}$ and a low-voltage side of the gray scale voltage selecting sections $\mathbf{36}_1$ to $\mathbf{36}_{528}$ may be configured using N-channel MOS transistors $\mathbf{49}_1$ to $\mathbf{49}_{32}$. This enables the number of elements in each of the gray scale voltage selecting sections $\mathbf{36}_1$ to $\mathbf{36}_{528}$ to be reduced to almost one-half. Moreover, the data electrode driving circuit 32 operates in the standard mode, placement of the gray scale power source outside the data electrode driving circuit 32 is not required. Even if the data electrode driving circuit 32 operates in the variation correcting mode, the maximum number of gray scale voltages to be fed is five and even when the gray scale power source is constructed of ICs, their chip size is smaller when compared with the conventional one. Therefore, it is possible to reduce a packing area on a printed board and, moreover, since the IC circuit making up the data electrode driving circuit 32 having the gray scale voltage selecting circuit 36 is made smaller in size, it is possible to reduce a size of a chip. As a result, it is made possible to make small and lightweight portable electronic devices which are driven by the battery, such as the notebook computer, palm-size computer, pocket computer, PDAs, portable cellular phone, PHS or the like.

Moreover, according to the embodiment, as described above, since each of the gray scale voltage selecting sections $\mathbf{36}_1$ to $\mathbf{36}_{528}$ in the gray scale voltage selecting circuit 36 is constructed of the P-channel MOS transistor $\mathbf{48}_1$ to $\mathbf{48}_{32}$ and the N-channel MOS transistors $\mathbf{49}_1$ to $\mathbf{49}_{32}$, their parasitic capacitance is reduced to a half. As a result, power consumption in the gray scale voltage generating circuit 35 and the gray scale voltage selecting circuit 36 is reduced from 2.125 mW in the conventional case to a half. This enables reduction of power consumption in the portable electronic devices and an increase in time during which these portable electronic devices can be operated.

Also, according to the embodiment, both an amount of currents for charging or discharging and time during which the currents for charging or discharging flow can be reduced, unlike the conventional case, no inferior contrast in the screen of the color LCD 1 occurs.

Furthermore, according to the embodiment, the applied voltage—transmittance characteristic differs depending on whether the applied voltage is of positive polarity or of negative polarity and the gray scale voltages $V_1$ to $V_{64}$ to provide a voltage of positive polarity and the gray scale voltages $V_1$ to $V_{64}$ to provide a voltage of a negative polarity are output, which makes it easy to make color correction and possible to obtain image of high quality.

Second Embodiment

Figure 8:
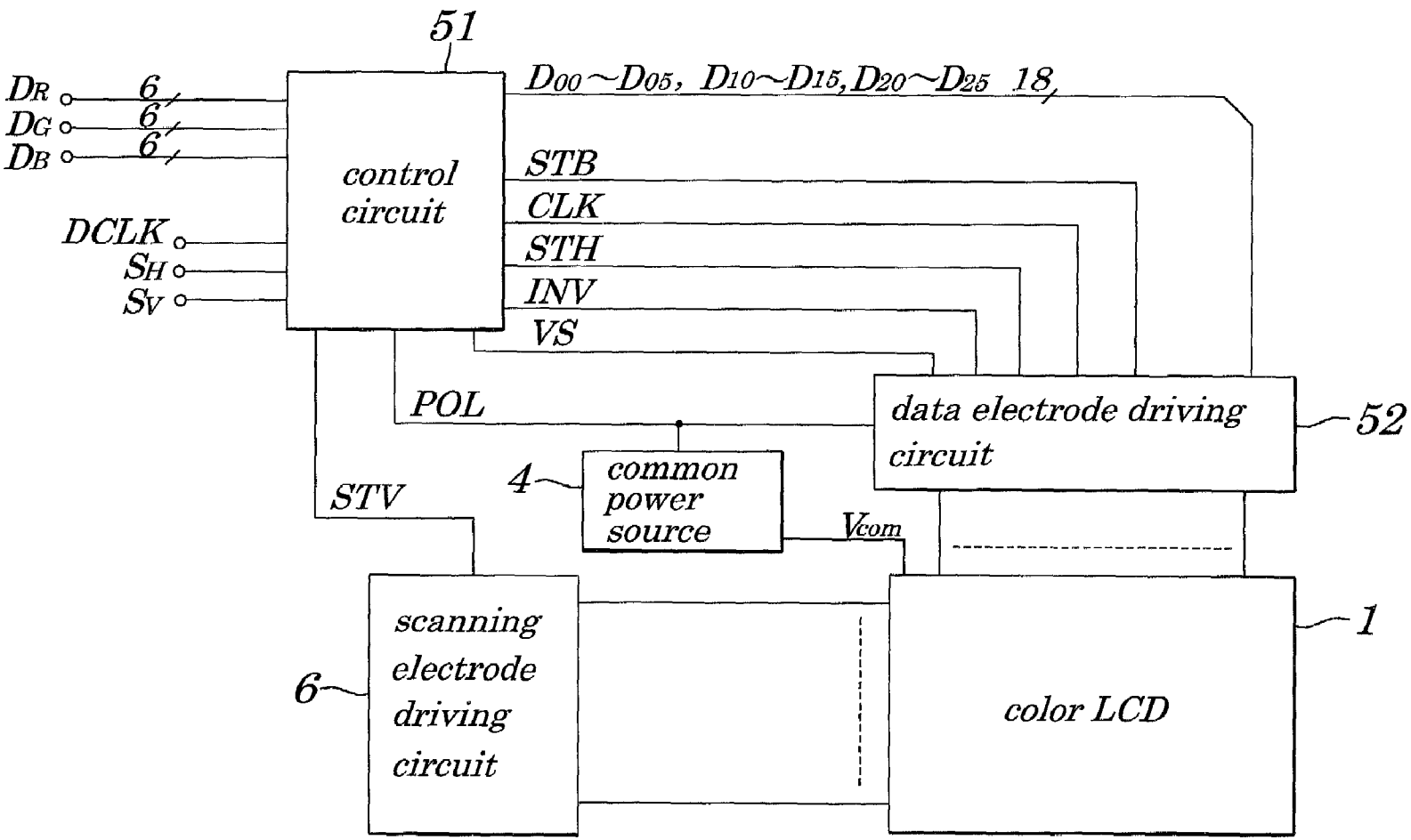
FIG. 8 is a schematic block diagram showing configurations of a driving circuit for a color LCD according to a second embodiment of the present invention.

FIG. 8 is a schematic block diagram for showing configurations of a driving circuit for a color LCD 1 according to a second embodiment of the present invention. In FIG. 8, same reference numbers are assigned to components having same functions as those in FIG. 1 and their descriptions are omitted accordingly. In the driving circuit for the color LCD 1 shown in FIG. 8, instead of a control circuit 50 and a data electrode driving circuit 32 shown in FIG. 1, a control circuit 51 and a data electrode driving circuit 52 are newly placed. In the second embodiment, as in the case of the first embodiment, it is presumed that the color LCD 1 provides 176×220 pixel resolution. Therefore, the number of dot pixels is 528×220. The control circuit 51 is made up of, for example, ASICs and has, instead of functions to produce a chip select signal CS provided in the first embodiment, functions of producing an amplifier control signal VS and feeding it to the data electrode driving circuit 52. The amplifier control signal VS, since it puts each of amplifiers $\mathbf{61}_1$ to $\mathbf{61}_{528}$ (only $\mathbf{61}_1$ is shown in FIG. 10) making up an outputting circuit 56 (shown in FIG. 9) in the data electrode driving circuit 52 into an active state, goes high only during a predetermined period of time (for example, about 10 μsec) in the middle of one horizontal period in one horizontal sync period, while, the amplifier control signal VS, during a period other than the above period, since it puts each of the amplifiers $\mathbf{61}_1$ to $\mathbf{61}_{528}$ into an inactive state, goes low.

Figure 9:
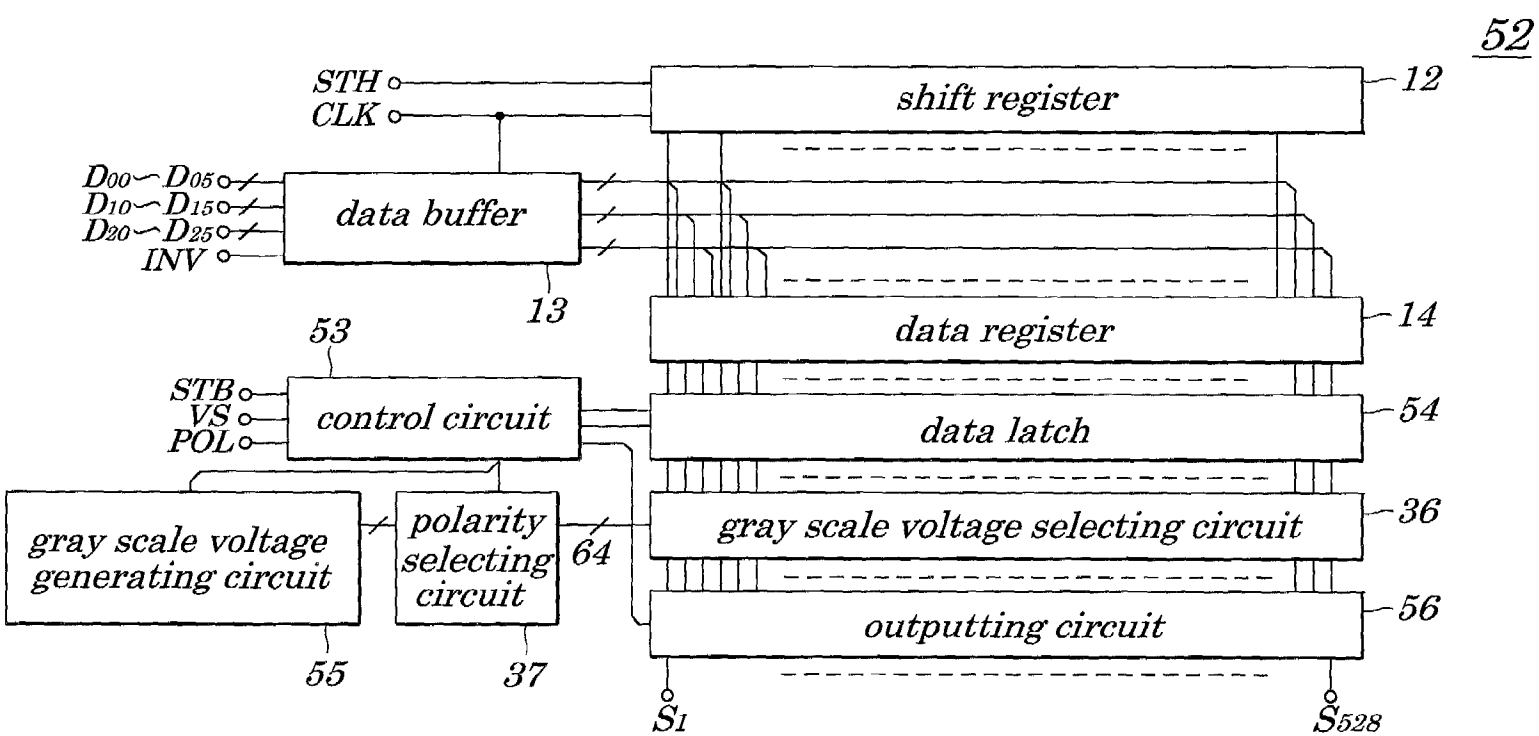
FIG. 9 is a schematic block diagram showing configurations of a data electrode driving circuit employed in the driving circuit for the color LCD according to the second embodiment of the present invention.
Figure 10:
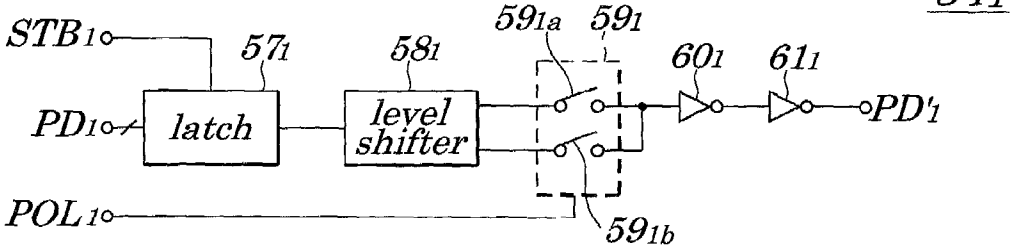
FIG. 10 is a diagram showing configurations of part of a data latch employed in the driving circuit for the color LCD according to the second embodiment of the present invention.

FIG. 9 is a schematic block diagram for showing configurations of the data electrode driving circuit 52 employed in the driving circuit for the color LCD 1 according to the second embodiment of the present invention. In FIG. 9, same reference numbers are assigned to components having same functions as those in the conventional example in FIG. 2 and their descriptions are omitted accordingly. The data electrode driving circuit 52 shown in FIG. 9, instead of a control circuit 33, a data latch 34, a gray scale voltage generating circuit 35, and an outputting circuit 19 shown in FIG. 2, a control circuit 53, a data latch 54, a gray scale voltage generating circuit 55, and the outputting circuit 56 are newly provided. The control circuit 53, based on a strobe signal STB fed from the control circuit 51, a polarity signal POL, and an amplifier control signal VS, produces a strobe signal $STB_1$, a polarity signal $POL_1$ (FIG. 10), amplifier control signals $VS_1$ to $VS_3$ (shown in FIG. 12), switch control signals SWA and SWS, switching change-over signals $S_{SWP}$ and $S_{SWN}$ (shown in FIG. 11). The strobe signal $STB_1$ is a signal being delayed by a fixed period of time behind the strobe signal STB and the polarity signal $POL_1$ is a signal being delayed by a fixed period of time behind the polarity signal POL. The amplifier control signal $VS_1$ is a signal being delayed by a fixed period of time behind the amplifier control signal VS and a signal which goes high only during a predetermined period of time (for example, about 10 μsec) in the middle of one horizontal period out of one horizontal sync period. The amplifier control signal $VS_2$ is a signal which goes high at almost the same time when the amplifier control signal $VS_1$ rises from a low level to a high level. Moreover, the amplifier control signal $VS_2$ is a signal which falls to a low level after a bias voltage to be applied from a bias current control circuit 67 (FIG. 12) making up the outputting circuit 56 to each of outputting sections $\mathbf{56}_1$ to $\mathbf{56}_{528}$ becomes stable (for example, about 3 μsec). The amplifier control signal $VS_3$ is a signal which rises to a high level at almost the same time when the amplifier control signal $VS_2$ falls from a high level to a low level and, after a lapse of, for example, about 7 μsec, at almost the same time when the amplifier control signal $VS_1$ falls from a high level to a low level, falls to a low level. The switch control signal SWA is a signal being delayed by a fixed period of time behind the amplifier control signal $VS_1$. The switch control signal SWS is a signal which rises to a high level, during one horizontal sync period, at almost the same time when the switch control signal SWA falls from a high level to a low level and, after a lapse of, for example, about 30 μsec, at almost the same time when one horizontal sync period ends, falls to a low level. The switching change-over signals $S_{SWP}$ and $S_{SWN}$ are signals used to control a polarity selecting circuit 37. The control circuit 53 feeds the strobe signal $STB_1$ and the polarity signal $POL_1$ to the data latch 54 and the amplifier control signals $VS_1$ to $VS_3$ and switching control signals SWA and SWS to the outputting circuit 56 and switch change-over signals $S_{SWP}$ and $S_{SWN}$ to the polarity selecting circuit 37 and gray scale voltage generating circuit 55.

The data latch 54 captures the display data $PD_1$ to $PD_{528}$ fed from the data register 14, in synchronization with a rise of the strobe signal $STB_1$ fed from the control circuit 53 and, after having held captured display data $PD_1$ to $PD_{528}$ until a subsequent strobe signal $STB_1$ is supplied, that is, during one horizontal sync period, converts them so as to have a predetermined voltage. Moreover, the data latch 54, based on the polarity signal $POL_1$, feeds the display data $PD_1$ to $PD_{528}$ (only $PD_1$ is shown) which have been only converted so as to have the predetermined voltage and the display data $PD_1$ to $PD_{528}$ which have been inverted after having been converted so as to have the predetermined voltage, to a gray scale voltage selecting circuit 36 as display data $PD'_1$ to $PD'_{528}$ FIG. 10 is a diagram showing configurations of part of the data latch 54 employed in the driving circuit for the LCD 1 according to the second embodiment of the present invention. The data latch 54 is made up of 528 pieces of data latch sections $\mathbf{54}_1$ to $\mathbf{54}_{528}$. Configurations of each of the data latch sections $\mathbf{54}_1$ to $\mathbf{54}_{528}$ are the same, except that subscripts of components differ from each other and subscripts of signals input and output from and to the data latch sections $\mathbf{54}_1$ to $\mathbf{54}_{528}$ differ from each other and therefore configurations of only the data latch section $\mathbf{54}_1$ are described. The data latch section $\mathbf{54}_1$ includes, as shown in FIG. 10, a latch $\mathbf{57}_1$, a level shifter $\mathbf{58}_1$, a switching unit $\mathbf{59}_1$ and inverters $\mathbf{60}_1$ and $\mathbf{61}_1$. The latch $\mathbf{57}_1$ captures 6 bits of the display data $PD_1$ in synchronization with a rise of the strobe signal $STB_1$ and holds it until a strobe signal $STB_1$ is fed next. The level shifter $\mathbf{58}_1$ outputs data obtained by converting a voltage of data output from the latch $\mathbf{57}_1$ from 3 V to 5 V and data obtained by inverting the data at the same time of the voltage conversion. The switching unit $\mathbf{59}_1$ is made up of a switch $\mathbf{59}_{1a}$ and $\mathbf{59}_{1b}$ The switching unit $\mathbf{59}_1$ outputs data fed from the level shifter $\mathbf{58}_1$ when a switch $\mathbf{59}_{1a}$ is turned ON while the polarity signal $POL_1$ is at a high level and data fed from the level shifter $\mathbf{58}_1$ when a switch $\mathbf{59}_{1b}$ is turned ON while the polarity signal $POL_1$ is at a low level. The inverter $\mathbf{60}_1$ inverts data fed from the switching unit $\mathbf{59}_1$ and the inverter $\mathbf{61}_1$ inverts data fed from the inverter $\mathbf{60}_1$ and outputs it as display data $PD'_1$. That is, the data latch section $\mathbf{54}_1$ outputs the display data $PD'_1$ of positive polarity while the polarity signal $POL_1$ is at a high level and the display data $PD'_1$ of negative polarity while the polarity signal $POL_1$ is at a low level. That is, the data latch section $\mathbf{54}_1$ has the same function as that of a data latch section $\mathbf{34}_1$ shown in FIG. 3. However, since component counts of the data latch section $\mathbf{54}_1$ are fewer, packaging parts can be reduced more.

Figure 11:
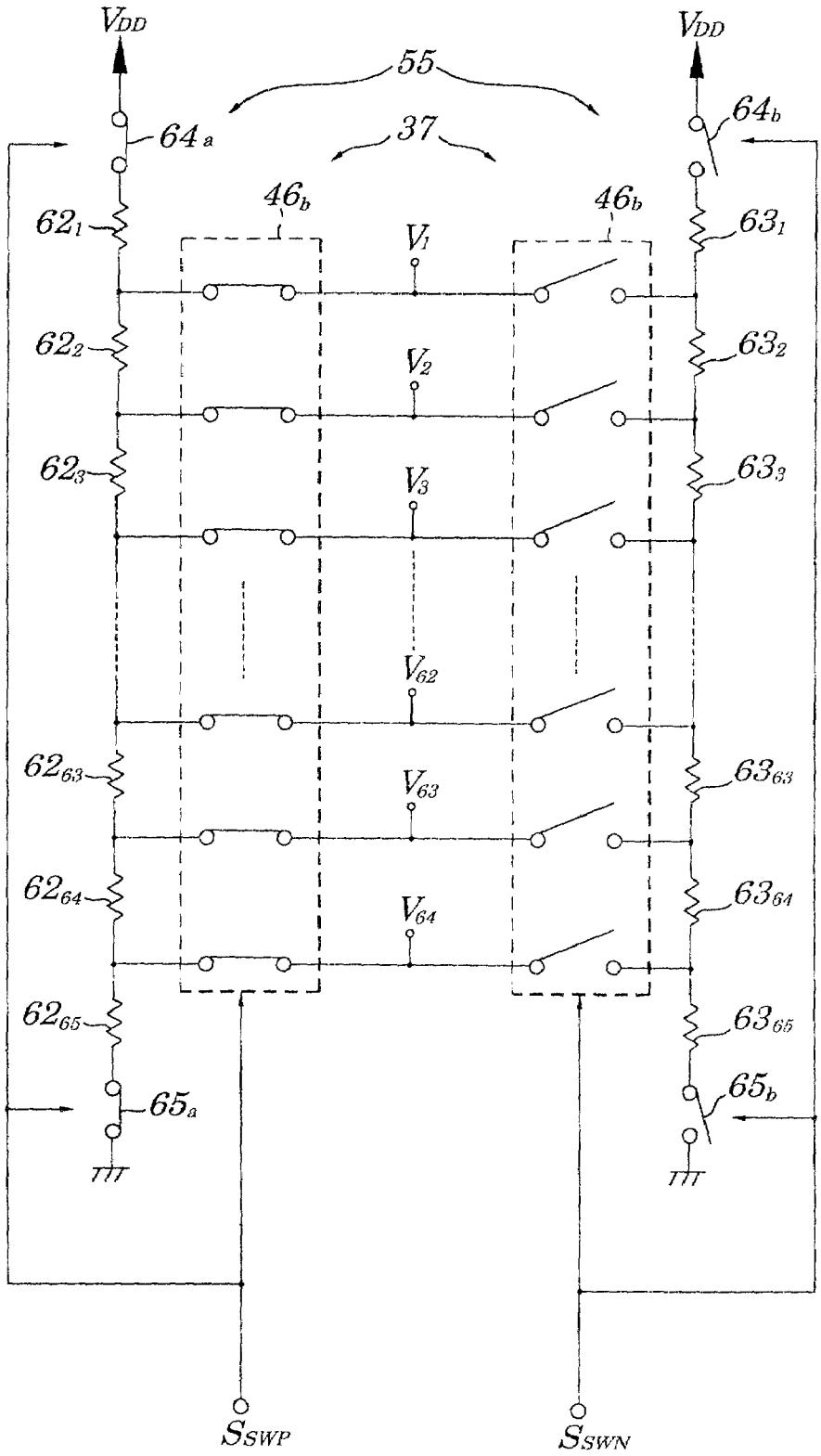
FIG. 11 is a circuit diagram showing configurations of a gray scale voltage generating circuit and a polarity selecting circuit employed in the driving circuit for the color LCD according to the second embodiment of the present invention.

The gray scale voltage generating circuit 55 shown in FIG. 9, as shown in FIG. 11, includes resistors $\mathbf{62}_1$ to $\mathbf{62}_{65}$ and $\mathbf{63}_i$ to $\mathbf{63}_{65}$, switches $\mathbf{64}_a$, $\mathbf{64}_b$, $\mathbf{65}_a$ and $\mathbf{65}_b$. Each of the resistors $\mathbf{62}_1$ to $\mathbf{62}_{65}$, all of which are cascade-connected, has a different resistance so as to match an applied voltage of positive polarity—transmittance characteristic in the color LCD 1.

On the other hand, each of the resistors $\mathbf{63}_1$ to $\mathbf{63}_{65}$, all of which are cascade-connected, has a different resistance so as to match the applied voltage of negative polarity—transmittance characteristic in the color LCD 1. Moreover, distribution of the entire resistance differs depending on the resistors $\mathbf{62}_1$ to $\mathbf{62}_{65}$ and the resistors $\mathbf{63}_1$ to $\mathbf{63}_{65}$. This enables the gray scale voltage (for example, 2.020 V as a gray scale voltage $V_{32}$ and 2.003 V as a gray scale voltage $V_{33}$) to be precisely generated. In the gray scale voltage generating circuit 35 (FIG. 4) according to the first embodiment, only a fixed interval of voltage values (for example, an interval of 20 mV) could be set to provide the gray scale voltage. To solve this problem, a method to make the interval of voltage values decrease may be employed, however, it causes an increase in the number of the resistors 42. When one terminal of the switch 64*a* is supplied with a supply voltage $V_{DD}$ and its another terminal is connected to the resistor $\mathbf{62}_1$, the switching change-over signal $S_{SWP}$ fed from the control circuit 53 goes high and the supply voltage $V_{DD}$ is applied to one terminal of each of the resistors $\mathbf{62}_1$ to $\mathbf{62}_{65}$ being cascade-connected. When one terminal of the switch $\mathbf{64}_b$ is supplied with the supply voltage $V_{DD}$ and its other terminal is connected to the resistor $\mathbf{63}_1$, the switching change-over signal $S_{SWN}$ fed from the control circuit 53 goes high and the supply voltage $V_{DD}$ is applied to one terminal of each of the resistors $\mathbf{63}_1$ to $\mathbf{63}_{65}$ being cascade-connected. When one terminal of the switch $\mathbf{65}_a$ is connected to a ground and its other terminal is connected to one terminal of the resistor $\mathbf{62}_5$, the switching change-over signal $S_{SWP}$ goes high and an other terminal of each of the resistors $\mathbf{62}_1$ to $\mathbf{62}_{65}$ being cascade-connected is connected to a ground. When one terminal of the switch $\mathbf{65}_b$ is connected to the ground and its other terminal is connected to one terminal of the resistor $\mathbf{63}_5$, the switching change-over signal $S_{SWN}$ goes high and an other terminal of each of the resistors $\mathbf{63}_1$ to $\mathbf{63}_{65}$ being cascade-connected is connected to the ground. In FIG. 11, configurations of the polarity selecting circuit 37 are the same as those in the polarity selecting circuit 37 shown in FIG. 4 and their descriptions are omitted accordingly. The gray scale voltage generating circuit 55 of the second embodiment, unlike the gray scale voltage generating circuit 35 shown in FIG. 4, is not provided with functions of switching between the standard mode and variation correcting mode. However, by adding functions of generating a chip select signal CS described above to those of the control circuit 51 and by adding some parts such as a P-channel MOS transistor 43 and an N-channel MOS transistor 44, inverters 45 or a like shown in FIG. 4 to the gray scale voltage generating circuit 55, the gray scale voltage generating circuit 55 can be provided with functions of switching between the standard mode and variation correcting mode.

Figure 12:
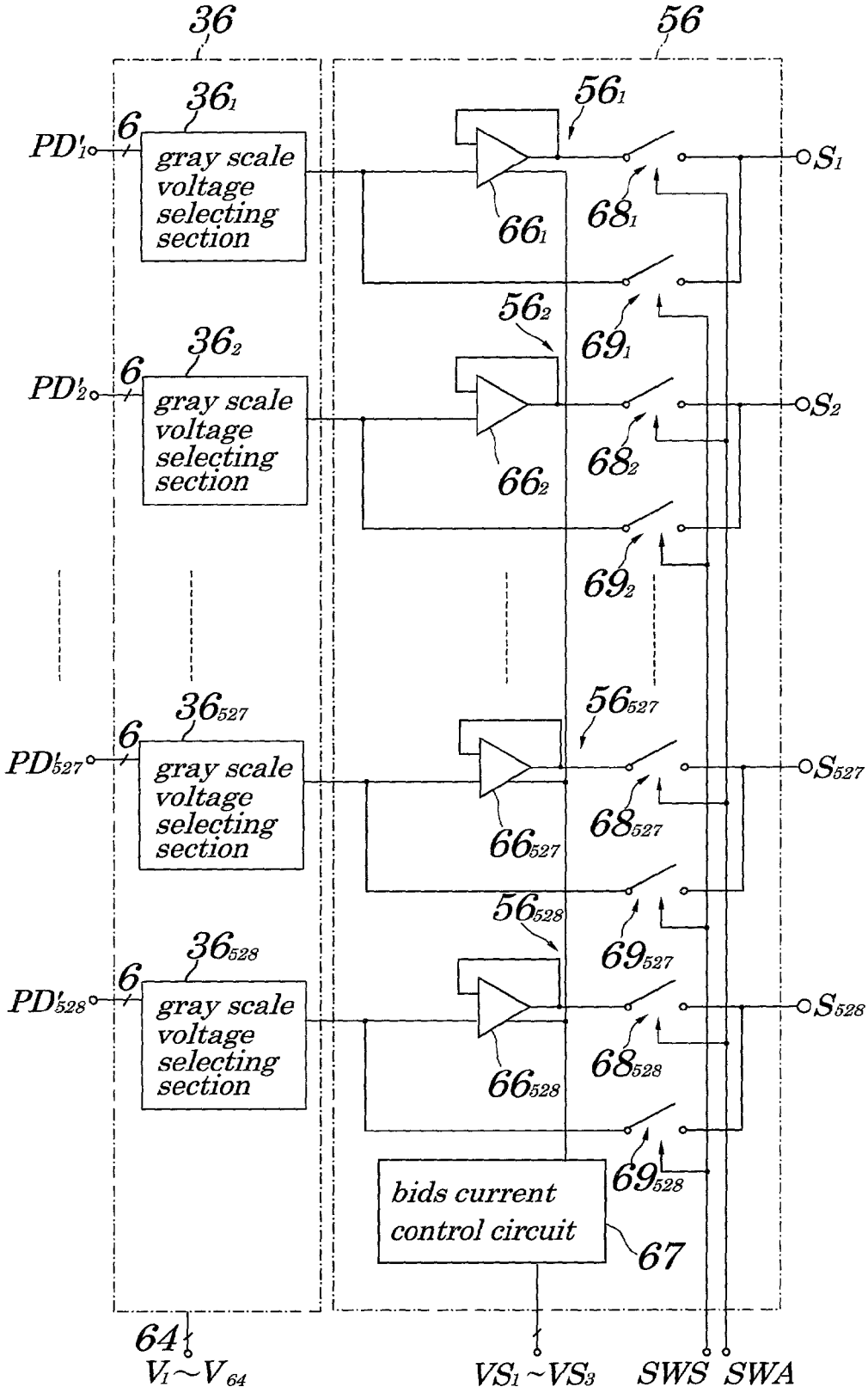
FIG. 12 is a circuit diagram showing configurations of a gray scale voltage selecting circuit and an outputting circuit employed in the driving circuit for the color LCD according to the second embodiment of the present invention.
Figure 13:
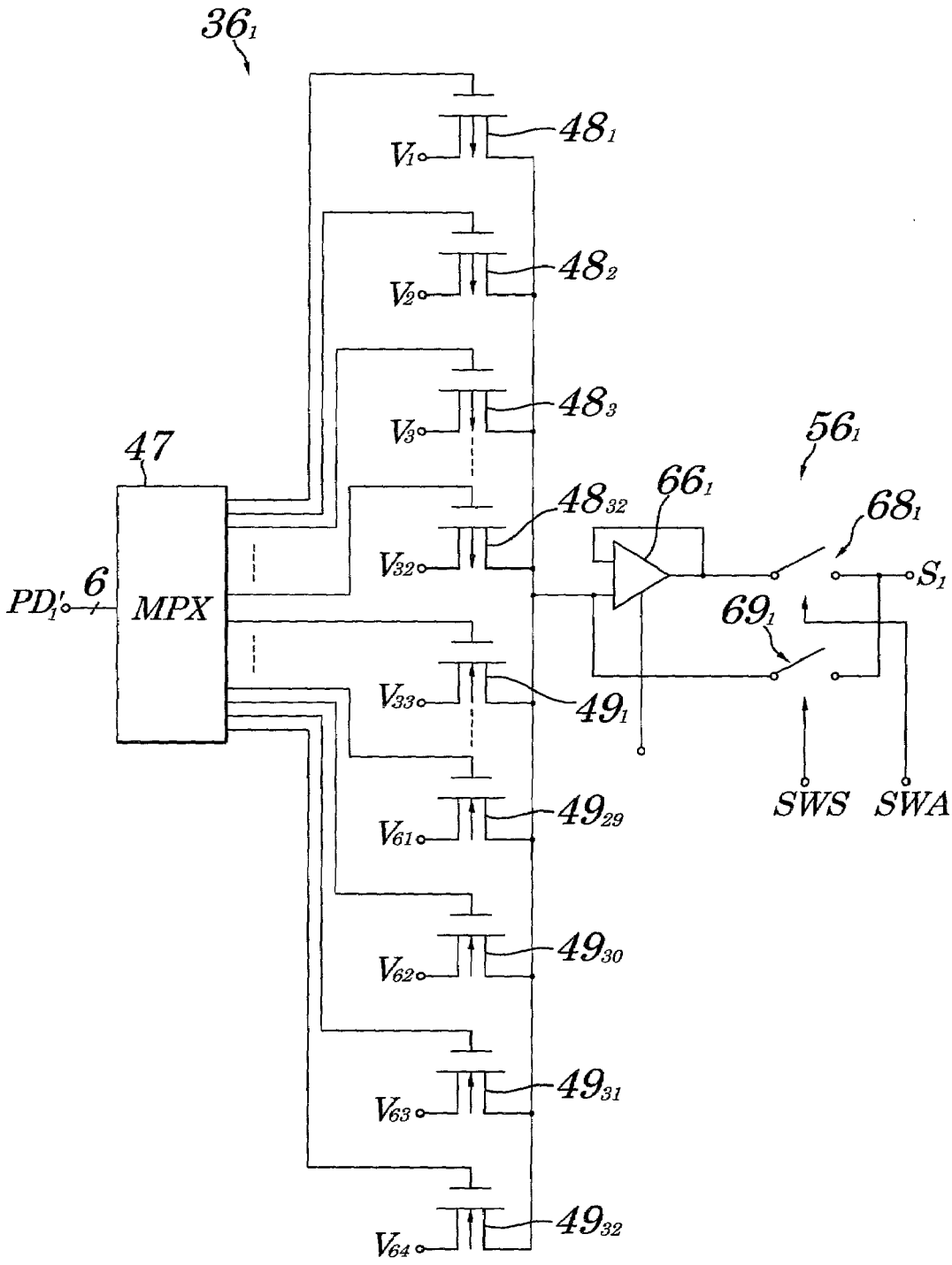
FIG. 13 is a circuit diagram showing configurations of part of the gray scale voltage selecting circuit and part of the outputting circuit employed in the driving circuit for the color LCD according to the second embodiment of the present invention.

The outputting circuit 56 shown in FIG. 9, as shown in FIG. 12, is made up of 528 pieces of outputting sections $\mathbf{56}_1$ to $\mathbf{56}_{528}$ and the bias current control circuit 67. Each of the outputting sections $\mathbf{56}_1$ to $\mathbf{56}_{528}$ includes each of amplifiers $66_1$ to $66_{528}$, each of switches $68_1$ to $68_{528}$ placed at a rear stage of each of the amplifiers $66_1$ to $66_{528}$, and each of switches $69_1$ to $69_{528}$ being connected in parallel between an input terminal of each of the amplifiers $66_1$ to $66_{528}$ and an output terminal of each of the corresponding switches $68_1$ to $68_{528}$. The outputting circuit 56 applies a corresponding data red signal, data green signal, and data blue signal fed from the gray scale voltage selecting circuit 36, with or without these signals being amplified, through the switches $68_1$ to $68_{528}$ or $69_1$ to $69_{528}$ having been turned ON in response to the switching change-over signals SWA and SWS fed from the control circuit 53, to the corresponding data electrode in the color LCD 1. In each of the amplifiers $66_1$ to $66_{528}$, a bias current is controlled by the bias current control circuit 67. FIG. 13 shows the outputting section $56_1$ made up of the amplifier $66_1$ and switches $68_1$ and $69_1$ which is used to output the data red signal $S_1$ corresponding to the display data $PD'_1$. The switch $68_1$ is turned ON when the switching change-over signal $S_{SWA}$ goes high and the switch $69_1$ is turned ON when the switching change-over signal $S_{SWS}$ goes high.

Figure 14:
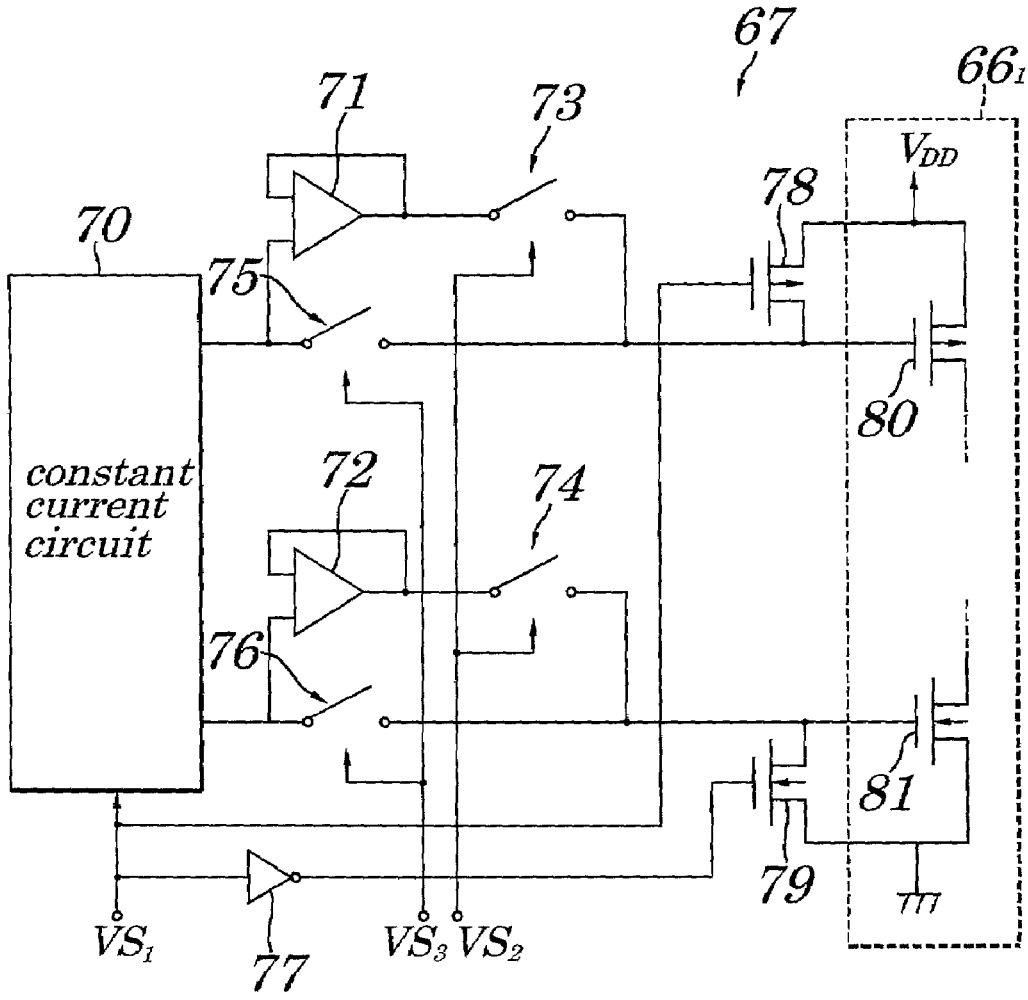
FIG. 14 is a circuit diagram showing configurations of a bias current control circuit employed in the outputting circuit for the color LCD according to the second embodiment of the present invention.

FIG. 14 is a circuit diagram showing configurations of the bias current control circuit 67 and of part of the amplifier $66_1$ in which a bias current is controlled by the bias current control circuit 67 employed in the driving circuit of the second embodiment. The bias current control circuit 67 includes a constant current circuit 70, amplifiers 71 and 72, switches 73 to 76, a P-channel MOS transistor 78 and an N-channel MOS transistor 79. The constant current circuit 70 performs a constant current operation when the amplifier control signal $VS_1$ fed from the control circuit 53 goes high. When the amplifier control signal $VS_1$ goes high, both the P-channel MOS transistor 78 and the N-channel MOS transistor 79 are turned OFF, thus putting a P-channel MOS transistor 80 and a N-channel MOS transistor 81 being constant current source transistors into a state where they are supplied with a bias current. At almost the same time when the amplifier control signal $VS_1$ rises to a high level, the amplifier control signal $VS_2$ rises to a high level. This causes the switches 73 and 74 to be turned ON and a bias current fed from the constant current circuit 70 to be applied at high speed to the P-channel MOS transistor 80 and the N-channel MOS transistor 81 in the amplifier $66_1$ through the amplifiers 71 and 72.

Next, when the bias current fed from the constant current circuit 70 is made stable, the amplifier control signal $VS_2$ falls to a low level and, at almost the same time, the amplifier control signal $VS_3$ rises to a high level. As a result, at almost the same time when both the switches 73 and 74 are turned OFF, the switches 75 and 76 are turned ON all at once and the bias current fed from the constant current circuit 70 is applied directly to the P-channel MOS transistor 80 and the N-channel MOS transistor 81 in the amplifiers $66_1$. When the amplifier control signal $VS_1$ falls to a low level, the constant current circuit 70 stops the constant current operations and, at the same time, the P-channel MOS transistor 78 and the N-channel MOS transistor 79 are turned ON to cause supply of the bias current to the P-channel MOS transistor 80 and the N-channel MOS transistor 81 in the amplifier $66_1$ to be stopped. Moreover, at almost the same time when the amplifier control signal $VS_1$ falls to a low level, since the amplifier control signal $VS_3$ falls to a low level, switches 75 and 76 are turned OFF.

Thus, the reason why the bias current is supplied to the amplifiers $66_1$ to $66_{528}$ only when the amplifier control signal VS is at a high level to put the amplifiers $66_1$ to $66_{528}$ into an operation state, is as follows. That is, as described above, when the color LCD 1 providing 176×220 pixel resolution employed in portable cellar phones or PHSs is operated at a frequency of about 60 Hz, one horizontal sync period is 60 to 70 μsec. However, actual driving time required in the color LCD 1 is about 40 μsec per one horizontal sync period. Moreover, no problem occurs even if, after a voltage of the data signal output from the amplifiers $66_1$ to $66_{528}$ has reached a predetermined value of the gray scale voltage, within the above 40 μsec, the gray scale voltage fed from the gray scale voltage selecting circuit 36 is applied to the data electrode in the color LCD 1. Time required before a voltage of the data signal output from the amplifiers $66_1$ to $66_{528}$ reaches the predetermined value of the gray scale voltage since the amplifiers $66_1$ to $66_{528}$ have been put into an operation state is about 3 μsec in this embodiment.

Thus, in the embodiment, power consumption is reduced by applying, for about 10 μsec existing in the middle of the one horizontal sync period required for screen display, a bias current to the amplifiers to $66_1$ to $66_{528}$ to put them into a state of operations and by stopping the supply of the bias current for about 20 to 30 μsec before the supply of the bias current to the amplifiers $66_1$ to $66_{528}$ and for about 30 μsec after the supply of the bias current to the amplifiers $66_1$ to $66_{528}$ to put them in a state of non-operation. In the conventional case, the operation time of the amplifier per one horizontal sync period is the entire one horizontal sync period, that is, 60 μsec to 70 μsec, while the operation time in the embodiment is about 10 μsec. Therefore, by simple calculation, the power consumption is about one-sixth to one-seventh (about 3.4 mW to 4 mW) of the conventional power consumption of 24 mW.

Next, operations of the control circuit 51, a common power source 4, data electrode driving circuit 52 out of operations of the driving circuit for the color LCD 1 having configurations described above will be explained by referring to a timing chart shown in FIG. 15. First, the control circuit 51 feeds a clock CLK (not shown), a strobe signal STB shown by (1) in FIG. 15, a horizontal start pulse STH being delayed by several pulses of the clock CLK behind the strobe signal STB and a polarity signal POL shown by (3) in FIG. 15, to the data electrode driving circuit 52. As a result, the data electrode driving circuit 52 performs shifting operations, in synchronization with the clock CLK, to shift the horizontal start pulse STH and outputs 176 bits of parallel sampling pulses $SP_1$ to $SP_{176}$. At almost the same time, the control circuit 51 converts 6 bits of red data DR, 6 bits of green data $D_G$, and 6 bits of blue data $D_B$ into 18 bits of display data $D_{00}$ to $D_{05}$, $D_{10}$ to $D_{15}$ and $D_{20}$ to $D_{25}$ and feeds the converted display data to the data electrode driving circuit 52. As a result, the 18 bits of display data $D_{00}$ to $D_{05}$, $D_{10}$ to $D_{15}$, and $D_{20}$ to $D_{25}$, after being held by the data buffer 13, for a period of time being equivalent to one pulse of the clock $CLK_1$, in synchronization with the clock $CLK_1$ being delayed by a predetermined period of time behind the clock CLK are fed to the data register 14 as display data $D'_{00}$ to $D'_{05}$, $D'_{10}$ to $D'_{15}$, and $D'_{20}$ to $D'_{25}$. Therefore, the display data $D'_{00}$ to $D'_{05}$, $D'_{10}$ to $D'_{15}$, and $D'_{20}$ to $D'_{25}$, after having been captured sequentially by the data register 14 as the display data $PD_1$ to $PD_{528}$ in synchronization with sampling pulses $SP_1$ to $SP_{176}$ fed from the shift register 12, are also captured all at once by the data latch 54 in synchronization with a rise of the strobe signal $STB_1$ and then are held by each of latches $57_1$ to $57_{528}$ (only the latch $57_1$ is shown in FIG. 10) for one horizontal sync period.

Figure 15:
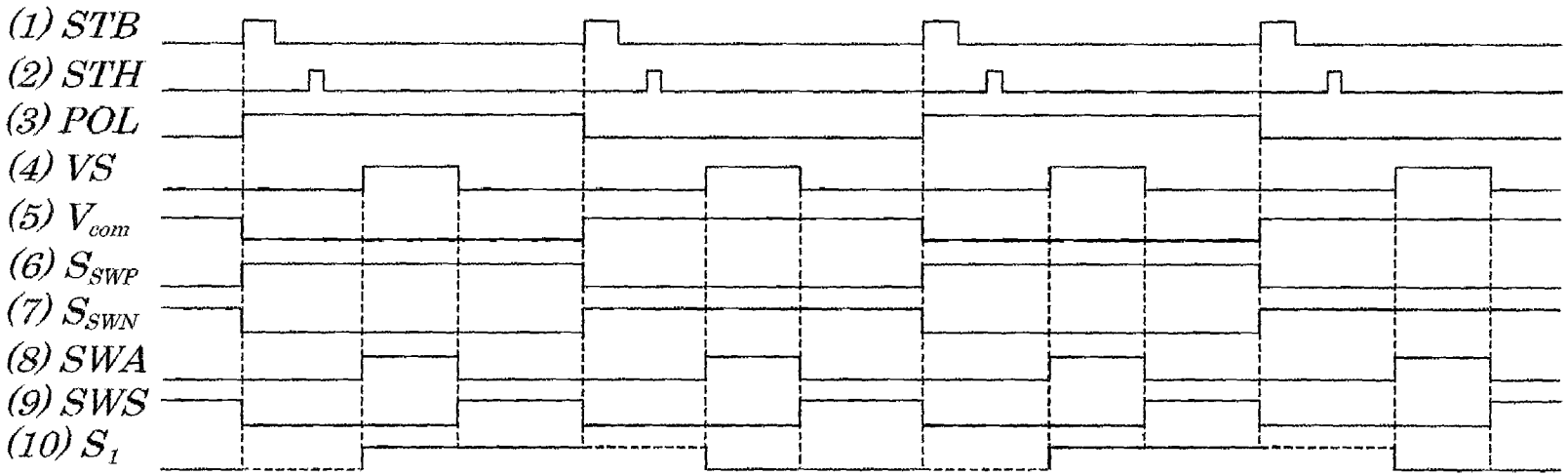
FIG. 15 is a timing chart explaining one example of the driving circuit for the color LCD according to the second embodiment of the present invention.

The display data $PD_1$ to $PD_{528}$ having been held by each of the latches $57_1$ to $57_{528}$ in the data latch 54, after their voltage level is converted from 3 V to 5 V by the level shifters $58_1$ to $58_{528}$ when the polarity signal POL shown by (3) in FIG. 15 is at a high level, are output through switches $59_{1a}$ to $59_{528a}$ in the switching units $59_1$ to $59_{528}$ and the inverters $60_1$ to $60_{528}$ from the inverters $61_1$ to $61_{528}$ as display data $PD'_1$ to $PD'_{528}$ of positive polarity and, after their voltage level is converted from 3 V to 5 V by the level shifters $58_1$ to $58_{528}$ when the polarity signal $POL_1$ is at a low level, are output through the switches $59_{1b}$ to $59_{528b}$ in the switching units $59_1$ to $59_{528b}$ and the inverters $60_1$ to $60_{528}$ from the inverters $61_1$ to $61_{528}$ as display data $PD'_1$ to $PD'_{528}$ of negative polarity.

Moreover, when the polarity signal POL is at a high level, a high-level switching change-over signal $S_{SWP}$ is fed to the gray scale voltage generating circuit 55 and the polarity selecting circuit 37 with the timing shown by (6) in FIG. 15 and a low-level switching change-over signal $S_{SWN}$ is fed with the timing shown by (7) in FIG. 15 to the gray scale voltage generating circuit 55 and polarity selecting circuit 37. As a result, in the gray scale voltage generating circuit 55, switches $64_b$ and $65_b$ are turned OFF in response to the switching change-over signal $S_{SWN}$ and switches $64_a$ and $65_a$ are turned ON in response to the switching change-over signal $S_{SWP}$. Therefore, a supply voltage $V_{DD}$ is applied to one terminal of the resistors $62_1$ to $62_{65}$ being cascade-connected and another terminal is connected to the ground and 64 pieces of gray scale voltages $V_1$ to $V_{64}$ of positive polarity is fed to the polarity selecting circuit 37. Moreover, in the polarity selecting circuit 37, since switches $46_a$ are turned ON all at once in response to the switching change-over signals $S_{SWP}$ and $s_{SWN}$, 64 pieces of the gray scale voltages $V_1$ to $V_{64}$ fed from the gray scale voltage generating circuit 55 are applied to the gray scale voltage selecting circuit 36 through the corresponding switches in the switch group $46_a$.

Therefore, in each of the gray scale voltage selecting sections $36_1$ to $36_{528}$ shown in FIG. 12, an MPX 47 shown in FIG. 13 turns ON any one of 64 pieces of transistors $48_1$ to $48_{32}$ and $49_1$ to $49_{32}$ based on 6 bits of corresponding display data PD' to $PD'_{528}$. This causes the corresponding gray scale voltage of positive polarity to be output from the MOS transistors having been turned ON as the data red signal, data green signal, and data blue signal, and also causes the output gray scale voltage to be fed to the corresponding outputting sections $56_1$ to $56_{528}$ in the outputting circuit 56.

On the other hand, if the polarity signal POL is at a high level (see (3) in FIG. 15) when the strobe signal STB shown by (1) in FIG. 15 rises, a low-level switching control signal SWA and a low-level switching control signal SWS are fed to the outputting circuit 56, as shown by (7) and (9) in FIG. 15. This causes all the switches $68_1$ to $68_{528}$ and $69_1$ to $69_{528}$ in each of the outputting sections $56_1$ to $56_{528}$ in the outputting circuit 56 to be turned OFF. Therefore, while both the switching control signals SWA and SWS are at a low level, no matter what value each of the data red signal, data green signal, and data blue signal fed from the gray scale voltage selecting circuit 36 has, a voltage to be applied by the data red signal, data green signal, and data blue signal output from each of the outputting sections $56_1$ to $56_{528}$ to the corresponding data electrode in the color LCD 1 is put in a high impedance state (only the data red signal $S_1$ is shown in (10) in FIG. 15).

Next, when the amplifier control signal $VS_1$ to be fed from the control circuit 53 rises to a high level (not shown), the constant current circuit 70 starts the constant current operations in the bias current control circuit 67 shown in FIG. 14, causing the P-channel MOS transistor 78 and the N-channel MOS transistor 79 to be turned OFF. This causes the P-channel MOS transistor 80 and the N-channel MOS transistor 81 making up the amplifiers $66_1$ to $66_{528}$ in each of the outputting sections $56_1$ to $56_{528}$ to be put in a state where the bias current can be supplied.

Moreover, when the amplifier control signal $VS_2$ rises to a high level at almost the same time when the amplifier control signal $VS_1$ rises to a high level, switches 73 and 74 in the bias current control circuit 67 are turned ON. As a result, out of two pieces of bias currents fed from the constant current circuit 70, one bias current is fed at high speed to the P-channel MOS transistor 80 in the amplifiers $66_1$ to $66_{528}$ through the amplifiers 71 and the switch 73 and another bias current is fed at high speed to the N-channel MOS transistor 81 in the amplifiers $66_1$ to $66_{528}$ through the amplifier 72 and the switch 74. Therefore, the amplifiers $66_1$ to $66_{528}$ is put into a state of operations. As a result, the gray scale voltage fed from the gray scale voltage selecting circuit 36, after a lapse of fixed time since a rise of the amplifier control signal to a high level after having been amplified by the corresponding amplifiers $66_1$ to $66_{528}$ in the outputting circuit 56, is applied through switches $68_1$ to $68_{528}$ having been turned ON in response to the high-level switching control signal SWA (in (8) in FIG. 15) to the corresponding data electrode in the color LCD 1 as the data red signal, data green signal, and data blue signal $S_1$ to $S_{528}$. An example of a waveform of the data red signal $S_1$ provided when a value of the display data $PD_1$ is "000000" is shown by (8) in FIG. 15. In this case, in the data latch section $54_1$ in FIG. 10, the value "000000" of the display data $PD_1$ is output, as they are, as the value of the display data $PD'_1$. Therefore, in the gray scale voltage selecting section $36_1$, the MPX 47, based on the value "000000" of the corresponding display data $PD'_1$, turns ON the MOS transistors $48_1$ and outputs the gray scale voltage $V_1$ to provide a voltage of positive polarity being the nearest to the supply voltage $V_{DD}$ as the data red signal $S_1$. On the other hand, the common power supply 4, based on the high-level polarity signal POL, as shown in (5) in FIG. 15, makes a common voltage Vcom be at a ground level and applies the voltage to the common electrode in the color LCD 1. A black color is displayed on a corresponding pixel in the normally-white type color LCD 1.

Next, when the bias current fed from the constant current circuit 70 becomes stable, the amplifier control signal $VS_2$ falls to a low level and, at almost the same time, the amplifier control signal $VS_3$ rises to a high level. As a result, at almost the same time when switches 73 and 74 are turned OFF, switches 75 and 76 are turned ON and the bias current fed from the constant current circuit 70 is directly applied to the MOS transistors 80 in the amplifiers $66_1$ to $66_{528}$. Thereafter, since the amplifiers 71 and 72 are put in a state of non-operation, power consumption in the bias current control circuit 67 can be reduced. Then, when the amplifier control signal $VS_1$ falls to a low level, the constant current circuit 70 stops the constant current operation and the P-channel MOS transistor 78 and the N-channel MOS transistor 79 making up the amplifiers $66_1$ to $66_{528}$ are turned ON, causing the supply of the bias current to be stopped. Moreover, at almost the same time when the amplifier control signal $VS_1$ falls to a low level, the amplifier control signal $VS_3$ falls to a low level, thereby turning OFF the switches 75 and 76. Therefore, no constant current flows through the amplifiers $66_1$ to $66_{528}$ and the amplifiers are put in a state of non-operation. Then, the gray scale voltage is applied through switches $69_1$ to $69_{528}$ having been turned ON in response to the switching control signal SWS (see (9) in FIG. 15) which rises to a high level at almost the same time when the amplifier control signal $VS_1$ falls to a low level to the corresponding data electrode in the color LCD 1, as the data red signal, data green signal, and data blue signal $S_1$ to $S_{528}$. At this point, since a voltage of the data signal output from the amplifiers $\mathbf{66}_1$ to $\mathbf{66}_{528}$ has reached a value of the predetermined gray scale voltage, switches $\mathbf{69}_1$ to $\mathbf{69}_{528}$ are used only to hold the voltage.

Next, if the polarity signal POL is at a low level when the strobe signal STB shown in (1) in FIG. 15 rises (see (3) in FIG. 3), the low-level switching change-over signal SWA and the low-level switching change-over signal SWS are again supplied to the outputting circuit 56, as shown in (7) and (9) in FIG. 15. This causes all switches $\mathbf{68}_1$ to $\mathbf{68}_{825}$ and switches $\mathbf{69}_1$ to $\mathbf{69}_{528}$ to be turned OFF in each of the outputting sections $\mathbf{56}_1$ to $\mathbf{56}_{528}$ in the outputting circuit 56. Therefore, while both the switching control signals SWA and SWS are at a low level, no matter what value each of the data red signal, data green signal, and data blue signal fed from the gray scale voltage selecting circuit 36 has, a voltage to be applied by the data red signal, data green signal, and data blue signal output from each of the outputting sections $\mathbf{56}_1$ to $\mathbf{56}_{528}$ to the corresponding data electrode in the color LCD 1 is put in a high impedance state (only the data red signal $S_1$ is shown in (10) in FIG. 15).

Operations thereafter are almost the same as those described above except that the gray scale voltages $V_1$ to $V_{64}$ are used to provide a voltage of negative polarity, the common potential Vcom is at a level of the supply voltage $V_{DD}$, the value of the display data $PD_1$ to $PD_{528}$ is inverted (for example, the value "000000" is inverted to the value "111111") and their descriptions are omitted accordingly.

Thus, in the embodiment, the amplifiers $\mathbf{66}_1$ to $\mathbf{66}_{528}$ making up each of the outputting sections $\mathbf{56}_1$ to $\mathbf{56}_{528}$ in the outputting section 56 are put into a state of operations by applying, only for about 10 μsec existing in the middle of the one horizontal sync period required for screen display, a bias current to these amplifiers, and the amplifiers $\mathbf{66}_1$ to $\mathbf{66}_{528}$ are put into a state of non-operation by stopping the supply of the bias current for about 20 to 30 μsec before the supply of the bias current to these amplifiers, and for about 30 μsec after the supply of the bias current to these amplifiers. As a result, the same results as obtained in the first embodiment can be achieved and power consumption can be reduced more than in the first embodiment. Moreover, in the conventional case, the operation time of the amplifier per one horizontal sync period is the entire one horizontal sync period, that is, 60 μsec to 70 μsec, while the operation time in the second embodiment is about 10 μsec. Therefore, by simple calculation, the power consumption is about one-sixth to one-seventh (about 3.4 mW to 4 mW) of the conventional power consumption of 24 mW.

Moreover, the period during which the amplifiers $\mathbf{66}_1$ to $\mathbf{66}_{528}$ are put in the state of operations can be reduced so that the period is less than the above 10 μsec by increasing frequencies at which the bias current control circuit 67 is driven without changing the one horizontal sync period. This enables further reduction in the power consumption in the driving circuit.

Furthermore, if the driving circuit is so configured that no influence occurs on quality of image even when a period during which the gray scale voltage fed from the gray scale voltage selecting circuit 36 is applied directly to the data electrode in the color LCD 1, that is, a period during which switches $\mathbf{69}_1$ to $\mathbf{69}_{528}$ are held ON, is made longer, power consumption can be further reduced.

Third Embodiment

Figure 16:
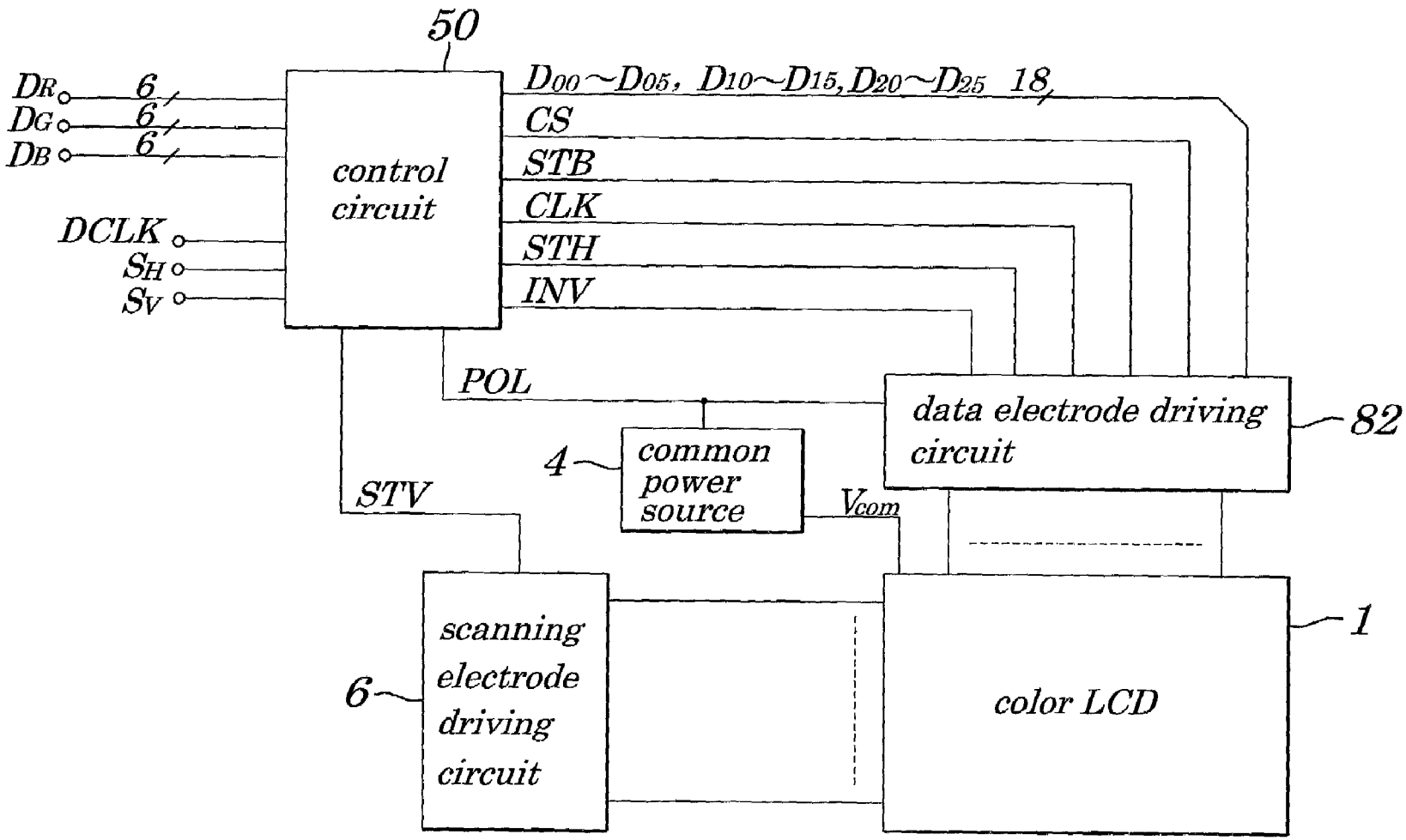
FIG. 16 is a schematic block diagram showing configurations of a driving circuit for a color LCD according to a third embodiment of the present invention.

FIG. 16 is a schematic block diagram for showing configurations of a driving circuit for a color LCD 1 according to a third embodiment of the present invention. In FIG. 16, same reference numbers are assigned to components having same functions as those in FIG. 1 and their descriptions are omitted accordingly. In the driving circuit for the color LCD 1 shown in FIG. 16, instead of a data electrode driving circuit 32 shown in FIG. 1, a data electrode driving circuit 82 is newly provided. In the third embodiment, as in a case of the second embodiment, it is presumed that the color LCD 1 provides 176×220 pixel resolution and therefore the number of dot pixels is 528×220.

Figure 17:
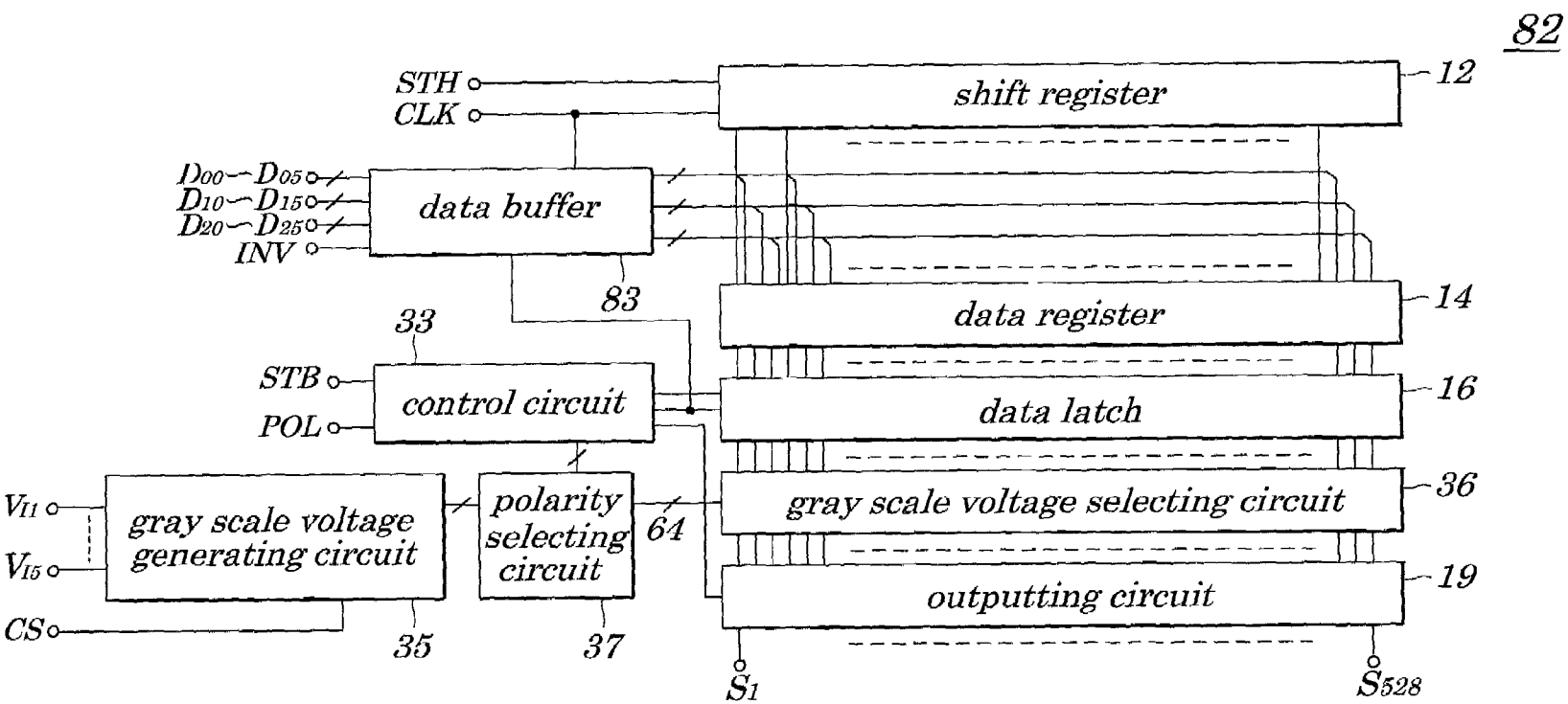
FIG. 17 is a schematic block diagram showing configurations of a data electrode driving circuit employed in the driving circuit for the color LCD according to the third embodiment of the present invention.

FIG. 17 is a schematic block diagram for showing configurations of a data electrode driving circuit employed in the driving circuit for the color LCD 1 according to the third embodiment of the present invention. In FIG. 17, same reference numbers are assigned to components having same functions as those in FIG. 2 and their descriptions are omitted accordingly. In the data electrode driving circuit 82 shown in FIG. 17, instead of a data buffer 13 and a data latch 34 shown in FIG. 2, a data buffer 83 and a data latch 16 are newly provided. Configurations of the data latch 16 are the same as those in the conventional example shown in FIG. 22 and their descriptions are omitted accordingly. The data buffer 83 performs inverting operations, as that were performed, in the prior art, by the data latch 34 shown in FIG. 2, to reduce power consumption in a control circuit 50. The data buffer 83, based on a data inverting signal INV fed from the control circuit 50 and on a polarity signal $POL_1$ fed from a control circuit 33, feeds 18 bits of display data $D_{00}$ to $D_{05}$, $D_{10}$ to $D_{15}$ and $D_{20}$ to $D_{25}$, all of which are supplied from the control circuit 50, with or without the display data $D'_{00}$ to $D'_{05}$, $D'_{10}$ to $D'_{15}$, and $D'_{20}$ to $D'_{25}$ being inverted, to a data register 14, as display data $D'_{00}$ to $D'_{05}$, $D'_{10}$ to $D'_{15}$, and $D'_{20}$ to $D'_{25}$.

Figures 18, 19:
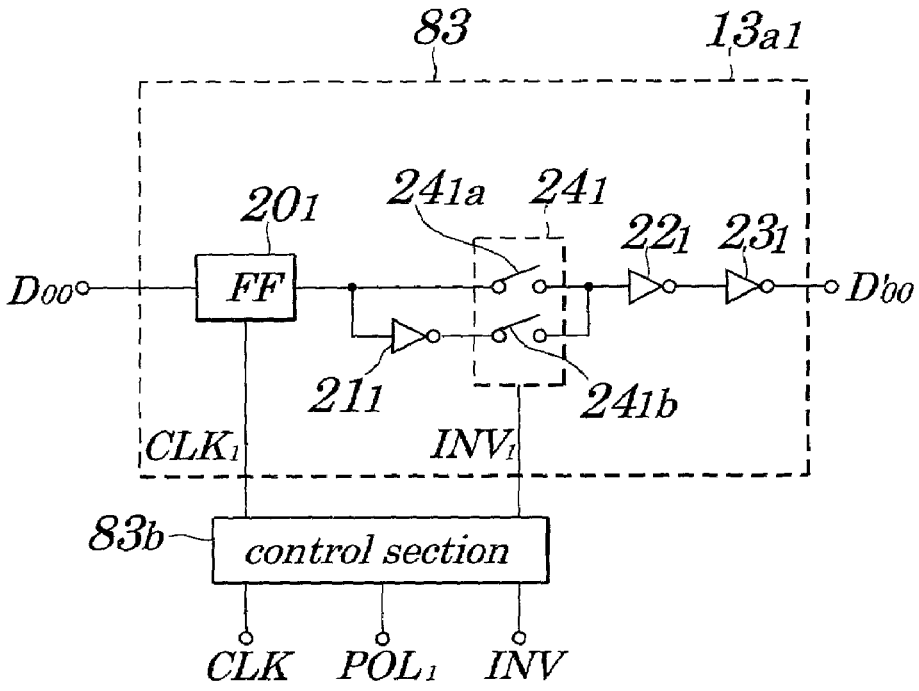
FIG. 18 is a circuit diagram showing part of configurations of a data buffer employed in the driving circuit for the color LCD according to the third embodiment of the present invention.
FIG. 19 is a diagram explaining a logic of signals input or output to and from a control section making up the data buffer employed in the driving circuit for the color LCD according to the third embodiment of the present invention.
Figure 23:
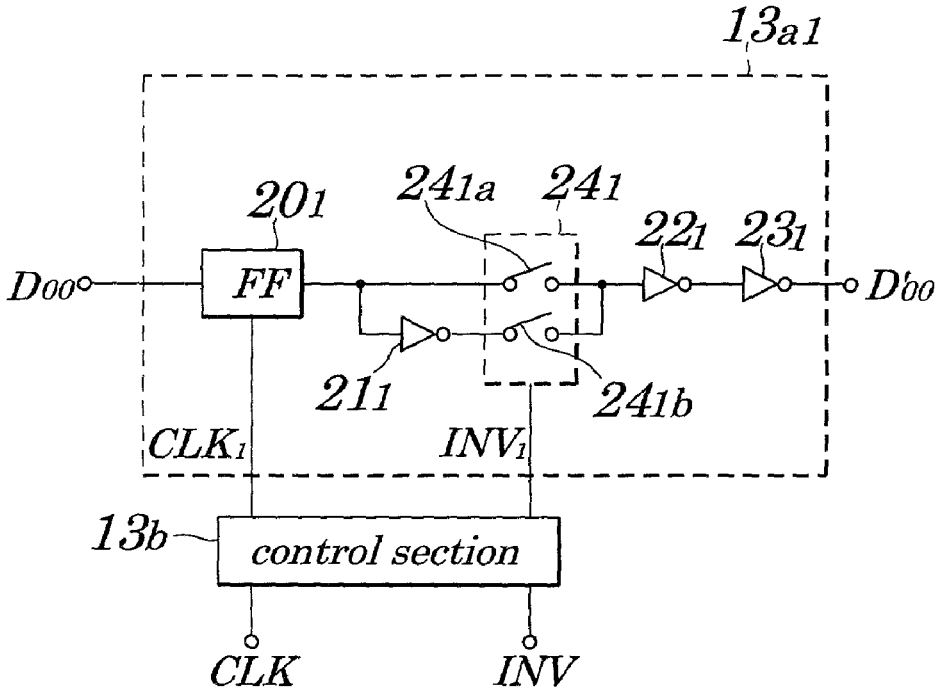
FIG.23(PRIOR ART)
FIG. 23 is a schematic block diagram showing one example of configurations of part of a data buffer making up the driving circuit for the conventional color LCD.
Figure 24:
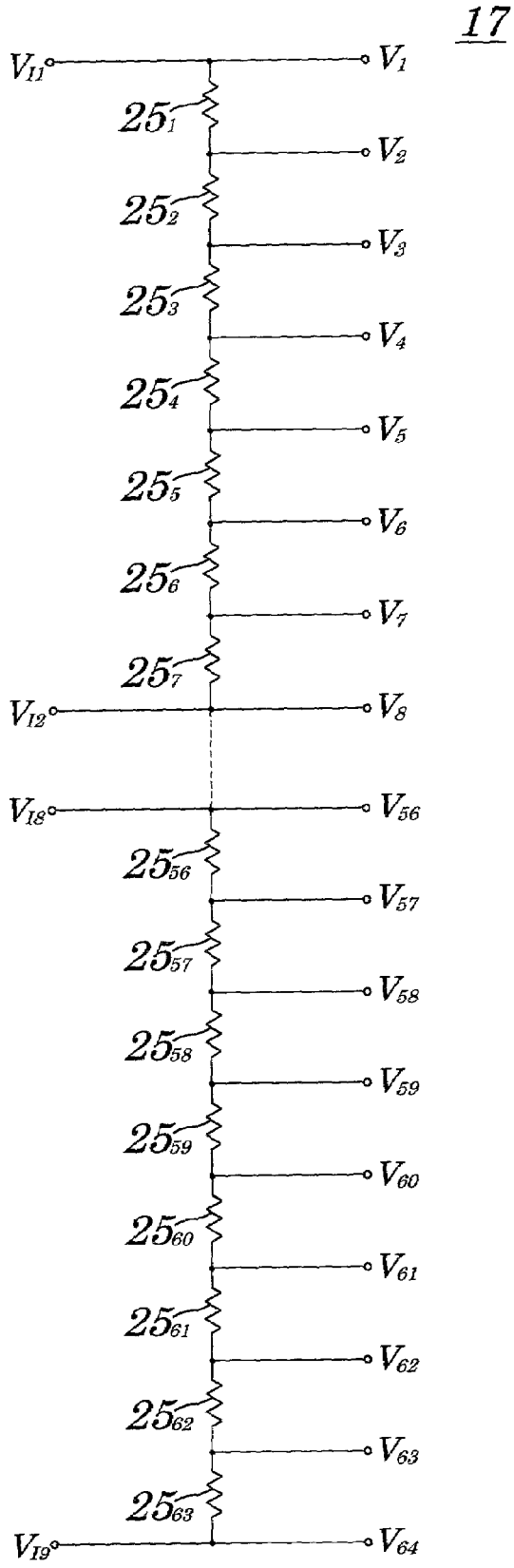
FIG.24 (PRIOR ART)
FIG. 24 is a circuit diagram showing an example of configurations of a gray scale voltage generating circuit making up the driving circuit for the conventional color LCD.
Figure 25:
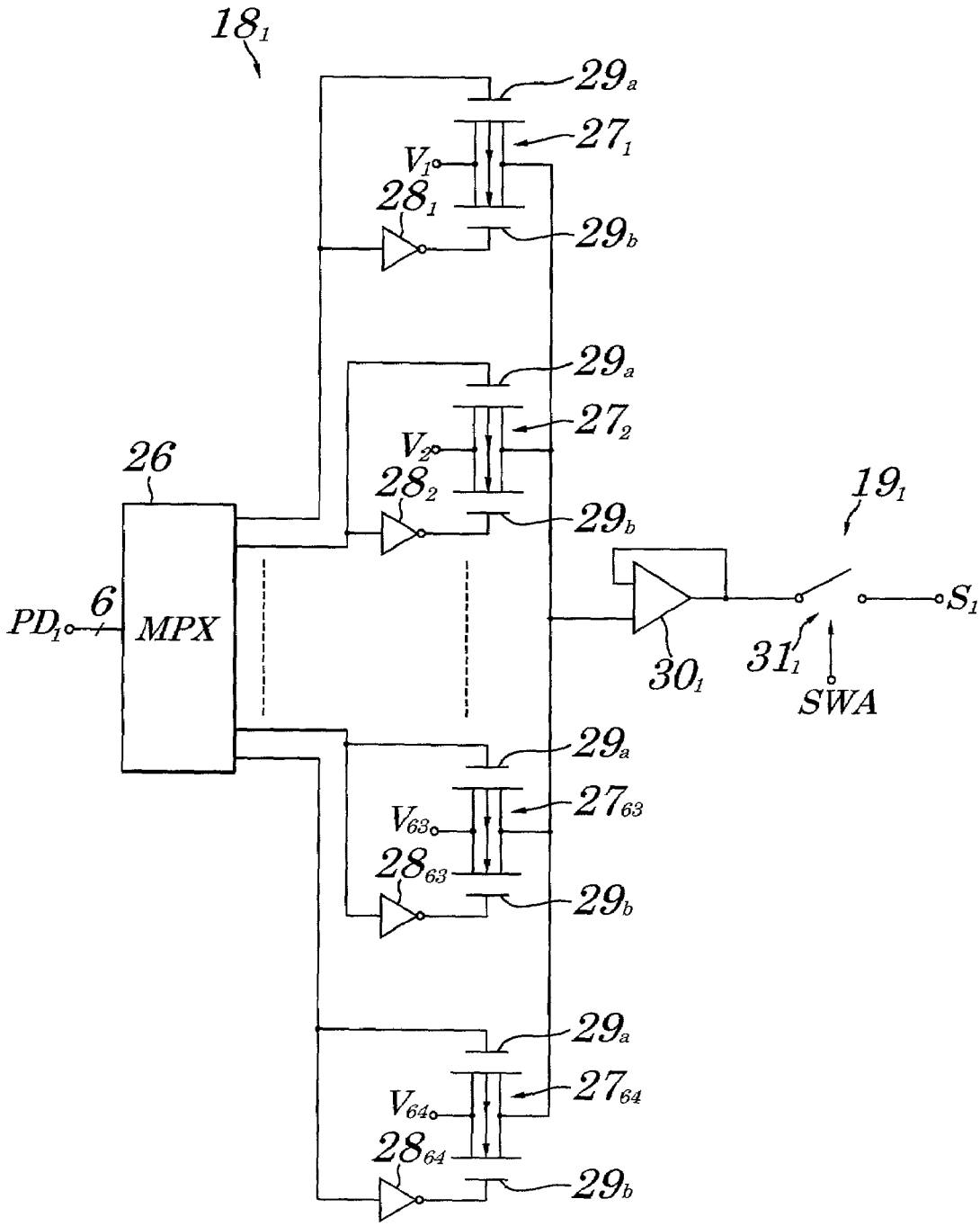
FIG.25 (PRIOR ART)
FIG. 25 is a diagram showing an example of configurations of part of a gray scale voltage selecting circuit and of part of an outputting circuit making up the driving circuit for the conventional color LCD.
Figure 26:
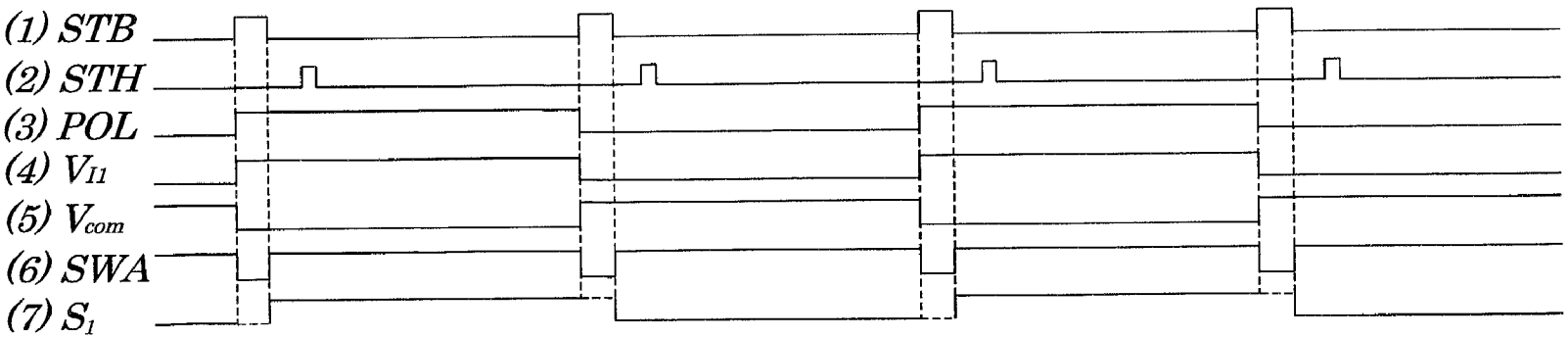
FIG.26 (PRIOR ART)
FIG. 26 is a timing chart explaining one example of operations of the driving circuit for the conventional color LCD.

FIG. 18 is a circuit diagram for showing part of configurations of the data buffer 83 employed in the data electrode driving circuit 82 for the color LCD 1 according to the third embodiment. In FIG. 18, same reference numbers are assigned to components having same functions as those in FIG. 23 and their descriptions are omitted accordingly. In the data buffer 83 shown in FIG. 18, instead of a control section $\mathbf{13}_b$ in FIG. 23, a control section $\mathbf{83}_b$ is newly provided. The control section $\mathbf{83}_b$, after having made a clock CLK fed from the control circuit 50 be delayed for a fixed period of time and feeds the delayed clock to data buffer sections $\mathbf{13}_{a1}$ to $\mathbf{13}_{a18}$ as a clock $CLK_1$. Moreover, the control section $\mathbf{83}_b$, based on the data inverting signal INV and the polarity signal $POL_1$, produces a data inverting signal $INV_1$ and feeds it to the data buffer sections $\mathbf{13}_{a1}$ to $\mathbf{13}_{a18}$. The data inverting signal $INV_1$ is a signal used to the output display data $D_{00}$ to $D_{05}$, $D_{10}$ to $D_{15}$, and $D_{20}$ to $D_{25}$, with or without the display data $D'_{05}$, $D'_{10}$ to $D'_{15}$, and $D'_{20}$ to $D'_{25}$ being inverted, based on a logic shown in FIG. 19, as $D'_{00}$ to $D'_{05}$, $D'_{10}$ to $D'_{15}$ and $D'_{20}$ to $D'_{25}$, to the data buffer sections $\mathbf{13}_{a1}$ to $\mathbf{13}_{a18}$. In FIG. 19, display data $D_{XX}$ is made representative of the display data $D_{00}$ to $D_{05}$, $D_{10}$ to $D_{15}$, and $D_{20}$ to $D_{25}$, and display data $D'_{XX}$ is made representative of the display data $D'_{00}$ to $D'_{05}$, $D_{10}$ to $D'_{15}$ and $D'_{20}$ to $D'_{25}$. That is, a first stage in the table in FIG. 19 shows the following. Since the polarity signal $POL_1$ is at a low level, the display data $D_{XX}$ has to be inverted. However, since the data inverting signal INV is also at a low level, the display data $D_{XX}$ has to be inverted to reduce power consumption in the control circuit 50. Therefore, the control section $\mathbf{83}_b$ cancels out the inversion based on the polarity signal $POL_1$ and the inversion based on the data inversion signal INV and feeds a high-level data inverting signal $INV_1$ to data buffer sections $\mathbf{13}_{a1}$ to $\mathbf{13}_{a1}$. This causes the display data $D'_{00}$ to $D'_{05}$, $D'_{10}$ to $D'_{15}$, and $D'_{20}$ to $D'_{25}$ of positive polarity to be output from the data buffer sections $\mathbf{13}_{a1}$ to $\mathbf{13}_{a18}$. Similarly, a second stage in the table in FIG. 19 shows the following. That is, since the polarity signal $POL_1$ is at a low level, the display data $D_{XX}$ has to be inverted. However, since the data inverting signal INV is at a high level, the inversion of the display data $D_{XX}$ to reduce power consumption in the control circuit 50 is not required. Therefore, the control section $\mathbf{83}_b$ feeds the low-level data inverting signal $INV_1$ to the data buffer sections $\mathbf{13}_{a1}$ to $\mathbf{13}_{a18}$. This causes negative-polarity display data $D'_{XX}$ to be output from the data buffer sections $\mathbf{13}_{a1}$ to $\mathbf{13}_{a18}$. Similarly, a third stage in the table in FIG. 19 shows the following. That is, since the polarity signal $POL_1$ is at a high level, the inversion of the display data $D_{XX}$ is not required. However, since the data inverting signal INV is at a low level, the inversion of the display data $D_{XX}$ to reduce power consumption in the control circuit 50 is required. Therefore, the control section $\mathbf{83}_b$ feeds the low-level data inverting signal $INV_1$ to the data buffer sections $\mathbf{13}_{a1}$ to $\mathbf{13}_{a18}$. This causes the display data $D'_{XX}$ of negative polarity to be output from the data buffer sections $\mathbf{13}_{a1}$ to $\mathbf{13}_{a18}$. Similarly, a fourth stage in the table in FIG. 19 shows the following. That is, since the polarity signal $POL_1$ is at a high level, the inversion of the display data $D_{XX}$ is not required. Since the data inverting signal INV is at a high level, the inversion of the display data $D_{XX}$ to reduce power consumption in the control circuit 50 is not required. After all, the control section $\mathbf{83}_b$ feeds the high-level data inverting signal $INV_1$ to the data buffer sections $\mathbf{13}_{a1}$ to $\mathbf{13}_{a18}$. This causes the display data $D'_{XX}$ of negative polarity to be output from the data buffer sections $\mathbf{13}_{a1}$ to $\mathbf{13}_{a18}$. Moreover, from the fifth to eighth stages in the table in FIG. 19, values of the display data $D_{XX}$ and the display data $D'_{XX}$ are different from those in the first to fourth stages in the table and therefore their descriptions are omitted.

Furthermore, functions and operations of other components making up the driving circuit for the color LCD 1 of the third embodiment are the same as those in the first embodiment and their descriptions are omitted accordingly.

Thus, according to the third embodiment, the data buffer 83 has, in addition to the function of inverting the display data $D_{00}$ to $D_{05}$, $D_{10}$ to $D_{15}$, and $D_{20}$ to $D_{25}$ based on the data inverting signal INV, functions of inverting the display data $D_{00}$ to $D_{05}$, $D_{10}$ to $D_{15}$, and $D_{20}$ to $D_{25}$ based on the polarity signal $POL_1$. By configuring above, the scale of the driving circuit can be made smaller in size when compared with the case where the data latch 34 and the data latch 54 have functions of inverting the display data $D_{00}$ to $D_{05}$, $D_{10}$ to $D_{15}$, and $D_{20}$ to $D_{25}$ based on the polarity signal $POL_1$ as are employed in the first embodiment and the second embodiment. The reason is that, if the data latch 34 and the data latch 54 have the functions of inverting the display data $D_{00}$ to $D_{05}$, $D_{10}$ to $D_{15}$, and $D_{20}$ to $D_{25}$ based on the polarity signal $POL_1$ and even in the case of the data latch 54 having small component counts, 6×528 pieces of switching units $\mathbf{59}_1$ to $\mathbf{59}_{528}$ are required. In contrast, when the data buffer 83 of the third embodiment has the functions of inverting the display data $D_{00}$ to $D_{05}$, $D_{10}$ to $D_{15}$, and $D_{20}$ to $D_{25}$ based on the above polarity signal $POL_1$, 28 pieces of the switching units are sufficient. Additionally, the data buffer 83 also has the function of inverting the data based on the data inverting signal INV. This means that 6×528 pieces of the switching units $\mathbf{59}_1$ to $\mathbf{59}_{528}$ can substantially be reduced.

It is apparent that the present invention is not limited to the above embodiments but may be changed and modified without departing from the scope and spirit of the invention. For example, in the above embodiments, mention is not made of resolution or a size of a display screen of the color LCD 1, however, the present invention may be applied to a driving circuit for the color LCD 1 having the LCD screen whose area is not more than 12 inches to 13 inches or to a driving circuit for an LCD in which no flickers or a like are made remarkable even when the line inverting driving method or frame inverting driving method is employed.

Moreover, configurations and operations provided in each of the above embodiments may be employed commonly in any other embodiments so long as they present no problem in terms of operations of the driving circuit. For example, the data latch 34 shown in FIG. 2 can be replaced with the data latch 54 having the configuration shown in FIG. 9. Also, a gray scale voltage generating circuit 35 having configurations shown in FIG. 4 can be replaced with a gray scale voltage generating circuit 55 having configurations shown in FIG. 11 so long as a control circuit 51 shown in FIG. 8 has a function of producing a chip select signal CS. Similarly, the gray scale voltage generating circuit 35 shown in FIG. 17 can be replaced with the gray scale voltage generating circuit 55 shown in FIG. 11. Moreover, instead of the control circuit 33 and an outputting circuit 19 shown in FIGS. 2 and 17, a control circuit 53 and an outputting circuit 56 shown in FIG. 9 may be employed. By configuring so, power consumption can be reduced more.

Also, in the above embodiments, the driving circuit is used in the color LCD, however, the driving circuit of the present invention may be also used in a monochrome LCD.

Furthermore, the driving circuit for the LCD of the present invention can be applied to portable electronic devices equipped with the LCD whose display screen is comparatively small in size. Specifically, the driving circuit for the LCD of the present invention may be used for portable electronic devices such as notebook computers, palm-size computers, pocket computers, PDAs, portable cellular phones, PHSs, or a like. This enables it to make small and lightweight portable electronic devices which are driven by a battery, such as the notebook computer, palm-size computer, pocket computer, PDAs, portable cellular phone, PHS, or the like.

What is claimed is:

1. A method for driving a display for sequentially feeding a scanning signal to a plurality of scanning electrodes and a data signal to a plurality of data electrodes to drive said display in which a cell is arranged at a point of intersection between each of said plurality of said scanning electrodes placed at regular intervals in a row direction and each of said plurality of said data electrodes placed at regular intervals in a column direction, said method comprising:

outputting digital video data, with or without said digital video data being inverted, based on a polarity signal which is inverted in every one horizontal sync period or in every one vertical sync period;

selecting, based on said polarity signal, one of a first voltage set and a second voltage set, said first voltage set comprising a plurality of gray scale voltages configured to match transmittance versus applied positive voltage characteristics of said display, and said second voltage set comprising a plurality of gray scale voltages configured to match transmittance versus applied negative voltage characteristics of said display which is different from said transmittance versus applied positive voltage characteristics;

selecting, based on the inverted digital video data or the non-inverted digital video data, any one of said plurality of said gray scale voltages making up the selected one of said first and second voltage sets to apply the selected one gray scale voltage as said data signal to a corresponding data electrode; and amplifying said selected one gray scale voltage only for a first period of said one horizontal sync period and applying the amplified said selected one gray scale voltage as said data signal to said corresponding data electrode and feeding said selected one gray scale voltage as said data signal, as it is, to said corresponding data electrode during a period other than said first period of said one horizontal sync period.

2. The method for driving the display according to claim 1, further comprising determining whether said digital video data is output, with or without said digital video data being inverted, based on a combination of a logic between a data inverting signal and said polarity signal, instead of inverting said digital video data, in order to reduce power consumption.

3. A driving circuit to drive a display for sequentially feeding a scanning signal to a plurality of scanning electrodes and a data signal to a plurality of data electrodes to drive said display in which a cell is arranged at a point of intersection between each of said plurality of said scanning electrodes placed at regular intervals in a row direction and each of said plurality of said data electrodes placed at regular intervals in a column direction, said driving circuit comprising:

a data latch used to output digital video data, with or without said digital video data being inverted, based on a polarity signal which is inverted in every one horizontal sync period or in every one vertical sync period;

a gray scale voltage generating circuit used to produce a first voltage set and a second voltage set, said first voltage set comprising a plurality of gray scale voltages configured to match transmittance versus applied positive voltage characteristics of said display, and said second voltage set comprising a plurality of gray scale voltages configured to match transmittance versus applied negative voltage characteristics of said display which is different from said transmittance versus applied positive voltage characteristics;

a polarity selecting circuit used to select, based on said polarity signal, one of said first and second voltage sets produced by said gray scale voltage generating circuit;

a gray scale voltage selecting circuit used to select, based on said inverted digital video data or said non-inverted digital video data, any one of said plurality of gray scale voltages making up the selected one of said first and second voltage sets; and an outputting circuit used to apply the selected one gray scale voltage as said data signal to a corresponding data electrode, wherein said gray scale voltage generating circuit comprises a plurality of resistors being cascade-connected and each having a same resistance, a first switch used to selectively apply either of a highest voltage to be fed from a gray scale power source placed outside or an internal supply voltage to one terminal of said plurality of said resistors, and a second switch used to selectively apply either of a lowest voltage to be fed from said gray scale power source placed outside or an internal ground voltage to another terminal of said plurality of said resistors, in synchronization with said first switch and wherein, out of connection points of adjacent resistors in said plurality of said resistors, a plurality of connection points where plural gray scale voltages making up said first voltage set occur and a plurality of connection points where plural gray scale voltages making up said second voltage set occur are connected to a plurality of corresponding terminals in said polarity selecting circuit and wherein, when said highest voltage and said lowest voltage are applied by said first switch and said second switch across each of said plurality of said resistors, at least one voltage of an intermediate voltage between said highest voltage and said lowest voltage is applied to any one of said connection points of said adjacent resistors in said plurality of said resistors.

4. The driving circuit for driving the display according to claim 3, wherein said gray scale voltage selecting circuit has a plurality of P-channel MOS transistors each being supplied with a plurality of gray scale voltages being generated on a high voltage side, out of a plurality of gray scale voltages including a supply voltage to a ground voltage, of a plurality of N-channel MOS transistors each being supplied with a plurality of gray scale voltages being generated on a low voltage side and wherein any one of said N-channel MOS transistors and said P-channel MOS transistors is turned ON in response to said digital video data to output a corresponding gray scale voltage.

5. The driving circuit for driving the display according to claim 3, wherein said outputting circuit is made up of a first amplifier to amplify said one selected gray scale voltage, a third switch placed on an output side of said first amplifier and a fourth switch being connected in parallel across said first amplifier and said third switch both being connected in series and wherein, during a first period of one horizontal sync period, said third switch is turned ON and gray scale voltage amplified by said first amplifier is applied to a corresponding data electrode as said data signal and, during a period after said first period of said one horizontal sync period, said third switch is turned OFF and said fourth switch is turned ON and said selected one gray scale voltage is applied, as it is, to said corresponding data electrode as said data signal and a bias current is interrupted to put said first amplifier into a state of non-operation.

6. The driving circuit for driving the display according to claim 3, wherein said outputting circuit has a bias current control circuit made up of a constant current circuit, a second amplifier used to amplify a bias current fed from said constant current circuit, a fifth switch placed at an output terminal of said second amplifier and a sixth switch being connected in parallel across said second amplifier and said fifth switch both being connected in series and wherein, during said first period of said one horizontal sync period, said constant current circuit performs constant current operations and, during a first half of said first period of said one horizontal sync period, said fifth switch is turned ON and said bias current amplified by said second amplifier is fed to said first amplifier and, during a second half of said first period of said one horizontal sync period, said fifth switch is turned ON and, at the same time, said sixth switch is turned ON and said bias current fed from said constant current circuit is fed, as it is, to said first amplifier.

7. The driving circuit for driving the display according to claim 6, wherein, when said one horizontal sync period is 60 μsec to 70 μsec, said first period of said one horizontal sync period is 10 μsec and said period after said first period of said one horizontal sync period is 30 μsec.

8. The driving circuit for driving the display according to claim 3, wherein said data latch has a latch used to capture said digital video data in synchronization with a strobe signal having a same period as that of a horizontal sync signal and to hold said captured digital video data during said one horizontal sync period, a level shifter used to convert a voltage of output data of said latch into a fixed voltage and an exclusive OR gate used to output data output from said level shifter, with or without said output data being inverted, based on said polarity signal.

9. The driving circuit for driving the display according to claim 3, wherein said data latch has a latch used to capture said digital video data in synchronization with a strobe signal having a same period as that of a horizontal sync signal and to hold said captured digital video data during one horizontal sync period, a level shifter used to output first data obtained by converting a voltage of data output from said latch into a fixed voltage and second data obtained by performing both voltage conversion and inversion and an output switching unit to output either of said first data or said second data, based on said polarity signal.

10. A driving circuit to drive a display for sequentially feeding a scanning signal to a plurality of scanning electrodes and a data signal to a plurality of data electrodes to drive said display in which a cell is arranged at a point of intersection between each of said plurality of said scanning electrodes placed at regular intervals in a row direction and each of said plurality of said data electrodes placed at regular intervals in a column direction, said driving circuit comprising:

a data latch used to output digital video data, with or without said digital video data being inverted, based on a polarity signal which is inverted in every one horizontal sync period or in every one vertical sync period;

a gray scale voltage generating circuit used to produce a first voltage set and a second voltage set, said first voltage set comprising a plurality of gray scale voltages configured to match transmittance versus applied positive voltage characteristics of said display, and said second voltage set comprising a plurality of gray scale voltages configured to match transmittance versus applied negative voltage characteristics of said display which is different from said transmittance versus applied positive voltage characteristics;

a polarity selecting circuit used to select, based on said polarity signal, one of said first and second voltage sets produced by said gray scale voltage generating circuit;

a gray scale voltage selecting circuit used to select, based on said inverted digital video data or said non-inverted digital video data, any one of said plurality of gray scale voltages making up the selected one of said first and second voltage sets; and an outputting circuit used to apply the selected one gray scale voltage as said data signal to a corresponding data electrode, wherein said gray scale voltage generating circuit comprises a first plurality of resistors being cascade-connected and each of their resistances having been set in advance so that any one of said plural gray scale voltages making up said first voltage set occurs at any one of connection points, of a second plurality of resistors being cascade-connected and each of their resistances having been set in advance so that any one of said plurality of gray scale voltages making up said second voltage set occurs at any one of said connection points, a first switch used to selectively feed either of a highest voltage to be fed from a gray scale power source placed outside or an internal supply power to one terminal of said first plurality of said resistors and said second plurality of said resistors, and a second switch used to selectively feed either of a lowest voltage to be fed from said gray scale power source placed outside or an internal ground voltage to another terminal of said first plurality of said resistors and said second plurality of said resistors, and wherein, when said highest voltage and said lowest voltage are applied by said first switch and said second switch across each of said first plurality of said resistors and said second plurality of said resistors, at least one voltage of an intermediate voltage between said highest voltage and said lowest voltage is applied to any one of said connection points of said adjacent resistors in said first plurality of said resistors and said second plurality of said resistors.

11. A driving circuit including a gray scale voltage generating circuit, said gray scale voltage generating circuit comprising:

a first switch coupled between a first power source line and first node, said first node being able to receive a first internal voltage;

a second switch coupled between a second power source line and a second node, said second node being able to receive a second internal voltage;

a plurality of resistors which are cascade connected between said first and second nodes to define a plurality of intermediate nodes between the adjacent resistors;

a third switch coupled between a first terminal and a first one of said first node, said second node, said plurality of intermediate nodes and said power source lines; and a fourth switch coupled between said first terminal and a second one of said first node, said second node, said plurality of intermediate nodes and said power source lines, said second one being different from said first one.

12. The driving circuit as claimed in claim 11, wherein said first one is said first node.

13. The driving circuit as claimed in claim 11, wherein said second one is said second power source line.

14. The driving circuit as claimed in claim 11, further comprising:

a fifth switch coupled between a second terminal and said fourth switch.

15. The driving circuit as claimed in claim 14, further comprising:

a sixth switch coupled between a third terminal and the first intermediate node, and a seventh switch coupled between said third terminal and the second intermediate node, wherein the first and second intermediate nodes are coupled to terminals other than said third terminal.

16. A driving circuit including a gray scale voltage generating circuit, said gray scale voltage generating circuit comprising:

a plurality of first resistors which are cascade connected and have a plurality of first nodes between adjacent first resistors;

a first switch coupled between a first power source line and a first end of said first resistors, said first switch being activated by a first control signal;

a second switch coupled between a second power source line and a second end of said first resistors, said second switch being activated by said first control signal;

a plurality of second resistors which are cascade connected and have a plurality of second nodes between adjacent second resistors;

a third switch coupled between said first power source line and a first end of said first resistors, said third switch being activated by said second control signal;

a fourth switch coupled between said second power source line and a second end of said second resistors, said fourth switch being activated by said second control signal;

a plurality of fifth switches each coupled between a corresponding one of said first nodes and a corresponding one of terminals, said firth switches being activated by said first control signal; and a plurality of sixth switches each coupled between a corresponding one of said second nodes and a corresponding one of said terminals, said sixth switches being activated by said second control signal.

* * * * *